US006424954B1

(12) United States Patent
Leon

(10) Patent No.: US 6,424,954 B1
(45) Date of Patent: Jul. 23, 2002

(54) POSTAGE METERING SYSTEM

(75) Inventor: JP Leon, San Carlos, CA (US)

(73) Assignee: Neopost Inc., Hayward, CA (US)

( * ) Notice: Subject to any disclaimer, the term of this patent is extended or adjusted under 35 U.S.C. 154(b) by 0 days.

(21) Appl. No.: 09/250,990

(22) Filed: Feb. 16, 1999

Related U.S. Application Data

(60) Provisional application No. 60/074,947, filed on Feb. 17, 1998, provisional application No. 60/075,934, filed on Feb. 25, 1998, provisional application No. 60/093,849, filed on Jul. 22, 1998, provisional application No. 60/094,065, filed on Jul. 24, 1998, provisional application No. 60/094,073, filed on Jul. 24, 1998, provisional application No. 60/094,116, filed on Jul. 24, 1998, provisional application No. 60/094,120, filed on Jul. 24, 1998, provisional application No. 60/094,122, filed on Jul. 24, 1998, and provisional application No. 60/094,127, filed on Jul. 24, 1998.

(51) Int. Cl.[7] ..... G07B 17/60

(52) U.S. Cl. ..... 705/401; 705/60; 705/410

(58) Field of Search ..... 705/60, 61, 62, 705/401, 403, 404, 405, 410

(56) References Cited

U.S. PATENT DOCUMENTS

| | | | | |
|---|---|---|---|---|
| 4,447,890 A | | 5/1984 | Duwel et al. | 364/900 |
| 4,657,697 A | * | 4/1987 | Chaing | 252/301.35 |
| 4,725,718 A | | 2/1988 | Sansone et al. | 235/495 |
| 4,743,747 A | | 5/1988 | Fougere et al. | 235/494 |
| 4,757,537 A | | 7/1988 | Edelmann et al. | 380/51 |
| 4,775,246 A | | 10/1988 | Edelmann et al. | 380/23 |
| 4,812,994 A | | 3/1989 | Taylor et al. | 364/464 |
| 4,813,912 A | * | 3/1989 | Chickneas et al. | 705/408 |
| 4,831,555 A | | 5/1989 | Sansone et al. | 364/519 |
| 4,853,865 A | | 8/1989 | Sansone et al. | 364/464 |

(List continued on next page.)

FOREIGN PATENT DOCUMENTS

| | | |
|---|---|---|
| EP | 0 825 565 | 2/1998 |
| EP | 0 845 762 | 4/1998 |
| GB | 1 536 403 | 12/1978 |
| WO | WO 98/13790 | 4/1998 |
| WO | WO 98 20461 | 5/1998 |
| WO | WO-00/49580 A1 * | 8/2000 |

OTHER PUBLICATIONS

Barker–Benfield: "First Union Offers Online Transactions"; Florida Times–Union, Jan. 28, 1997.*

(List continued on next page.)

*Primary Examiner*—Edward R. Cosimano
(74) *Attorney, Agent, or Firm*—Townsend and Townsend and Crew LLP

(57) ABSTRACT

A postage metering system that includes a host PC, an SMD, and a printer. The host PC includes a user interface to receive postage information. The SMD operatively couples to the computer via a communications link and includes a processor and a tamper evident enclosure. The processor is configured to receive the postage information from the computer, direct generation of an indicium, and account for the indicium. The tamper evident enclosure houses the processor and other security sensitive elements of the SMD. The printer couples to the SMD and is configured to receive and print the indicium. The SMD can further include a memory element, an interface circuit, and an enclosure. The memory element is configured to store accounting information and information related to the operation of the metering device. The interface circuit is configured to receive a message that includes a code that identifies that message. The processor operatively couples to the memory element and the interface circuit. The processor is configured to receive the message, process the message to generate an indicium, and update the accounting information to account for the generated indicium. The enclosure houses the processor and indicates tampering of elements within the enclosure.

38 Claims, 35 Drawing Sheets

U.S. PATENT DOCUMENTS

| | | | | | |
|---|---|---|---|---|---|
| 4,853,961 | A | | 8/1989 | Pastor | 380/21 |
| 4,949,381 | A | | 8/1990 | Pastor | 380/51 |
| 5,142,577 | A | | 8/1992 | Pastor | 380/21 |
| 5,181,245 | A | | 1/1993 | Jones | 380/23 |
| 5,231,668 | A | | 7/1993 | Kravitz | |
| 5,280,531 | A | * | 1/1994 | Hunter | 705/404 |
| 5,377,268 | A | | 12/1994 | Hunter | 380/23 |
| 5,448,641 | A | | 9/1995 | Pintsov et al. | 380/51 |
| 5,625,694 | A | * | 4/1997 | Lee et al. | 705/60 |
| 5,638,442 | A | * | 6/1997 | Gargiulo et al. | 380/2 |
| 5,666,421 | A | | 9/1997 | Pastor et al. | 380/51 |
| 5,688,056 | A | | 11/1997 | Peyret | 400/61 |
| 5,715,164 | A | * | 2/1998 | Liechti et al. | 705/410 |
| 5,742,683 | A | | 4/1998 | Lee et al. | 380/23 |
| 5,781,438 | A | | 7/1998 | Lee et al. | 364/464.14 |
| 5,793,867 | A | | 8/1998 | Cordery et al. | 380/4 |
| 5,822,738 | A | | 10/1998 | Shah et al. | 705/410 |
| 5,920,850 | A | * | 7/1999 | Hunter et al. | 705/405 |
| 5,963,928 | A | * | 10/1999 | Lee | 705/401 |

OTHER PUBLICATIONS

FIBS PUB 140–1, Federal Information Processing Standards Publication, (Jan. 11, 1994) Security Requirements for Cryptographic Modules, U.S. Department of Commerce, Ronald H. Brown, Secretary, National Institute of Standards and Technology; pp: 1–51.

"Information–Based Indicia Program (IBIP), Performance Criteria for Information–Based Indicia and Security Architecture for Closed IBI Postage Metering Systems (PCIBI–C)" Jan. 12, 1999, United States Postal Service, dated Jan. 12, 1999.

"Information Based Indicia Program (IBIP) Indicium Specification," United States Postal Service, dated Jun. 13, 1996.

Information Based Indicia Program Postal Security Device Specification, United States Postal Service, dated Jun. 13, 1996.

"Information Based Indicia Program Host System Specification [Draft]," United States Postal Service, dated Oct. 9, 1996.

"Information–Based Indicia Program (IBIP), Performance Criteria for Information–Based Indicia and Security Architecture for IBI Postage Metering Systems (PCIBISAIBI-PMS)," United States Postal Service, dated Aug. 19, 1998.

* cited by examiner

890

Device Status

THIS IS THE CURRENT STATUS OF THE POSTAGE DEVICE:

This information is provided in case you need to contact Neopost Technical Support. Generally, you do not need to understand the significance of the fields listed below.

| | |
|---|---|
| Device ID: | 0004000000001309 |
| Device State: | Funded |
| Ascending Register: | 000000009150 |
| Descending Register: | 0000240850 |
| Cycle Count: | 0000000B |
| Device Software Version: | 8052 |
| Licensing ZIP Code: | 000000094544 |
| Device Initialization Date & Time: | 07-31-1998 17.46 43.00 |
| License ID: | 0000004444 |
| Maximum Indicium Value: | Unknown |
| Minimum Indicium Value: | Unknown |
| Audit Pending Status: | Unknown |

OK

892

FIG. 8F

POSTAGE METERING SYSTEM

This application claims priority from the following U.S. provisional and non-provisional applications, the disclosures of which, including software appendices and all attached documents, are incorporated by reference in their entirety for all purposes:

Application Ser. No. 60/074,947, filed Feb. 17, 1998, of JP Leon, entitled "POSTAGE PRINTING SYSTEM";

Application Ser. No. 60/075,934, filed Feb. 25, 1998, of JP Leon, entitled "POSTAGE PRINTING SYSTEM";

Application Ser. No. 60/093,849, filed Jul. 22, 1998, of JP Leon and David A. Coolidge, entitled "METHOD AND APPARATUS FOR POSTAGE LABEL AUTHENTICATION";

Application Ser. No. 60/094,065, filed Jul. 24, 1998, of JP Leon, entitled "METHOD AND APPARATUS FOR RESETTING POSTAGE METER";

Application Ser. No. 60/094,073, filed Jul. 24, 1998, of JP Leon, Albert L. Pion, and Elizabeth A. Simon, entitled "METHOD, APPARATUS, AND CODE FOR MAINTAINING SECURE POSTAGE INFORMATION";

Application Ser. No. 60/094,116, filed Jul. 24, 1998, of JP Leon, entitled "METHOD AND APPARATUS FOR DOCKABLE SECURE METERING DEVICE";

Application Ser. No. 60/094,120, filed Jul. 24, 1998, of Chandrakant J. Shah, JP Leon, and David A. Coolidge, entitled "METHOD AND APPARATUS FOR REMOTELY PRINTING POSTAGE INDICIA";

Application Ser. No. 60/094,122, filed Jul. 24, 1998, of JP Leon, entitled "POSTAGE METERING SYSTEM EMPLOYING POSITIONAL INFORMATION"; and Application Ser. No. 60/094,127, filed Jul. 24, 1998, of JP Leon, entitled "METHOD AND APPARATUS FOR OPERATING A REMOVABLE SECURE METERING DEVICE."

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

BACKGROUND OF THE INVENTION

The present invention relates to the field of postage metering systems, and more particularly to a portable, secure, low cost, and flexible postage metering system.

A postage meter allows a user to print postage or other indicia of value on envelopes or other media. Conventionally, the postage meter can be leased or rented from a commercial group (e.g., Neopost Inc.). The user purchases a fixed amount of value beforehand and the meter is programmed with this amount. Subsequently, the user is allowed to print postage up to the programmed amount.

Historically, postage meters have been dedicated, stand-alone devices, capable only of printing postage indicia on envelopes (or labels, in the case of parcels). These devices normally reside at a single user location and only provide postage metering for that location. Such postage meters often require the user to physically transport the device to a post office for resetting (i.e., increasing the amount of postage contained in the meter). An advance over this system is the ability to allow the user to reset the meter via codes that are provided by either the manufacturer or the postal authority once payment by the user had been made.

Modem electronic meters are often capable of being reset directly by a registered party, on-site (at the user's location) via a communications link. A system that performs meter resetting in this manner is known as a Computerized Meter Resetting System (or "CMRS"). The party having authority to reset the meter and charge the user (usually the manufacturer or the postal authority) thus gains access to and resets the meter.

Even with these advancements, postage meters are still, for the most part, restricted to use at a single physical location. As such devices are dedicated (and rather sophisticated in their fail-safe attributes and security), their price tends to be prohibitive for small entities. Moreover, the items requiring postage must often be brought to the device because of the device's physical size and the need for supporting connections (i.e., power, communications, and the like).

As can be seen, a postage metering system that is portable, low-cost, secure, and flexible in operation is highly desirable. Moreover, a system that centralizes both postage accounting and security features is also highly desirable. Such a system would allow the printing of postage indicia at locations that are convenient to the end-user by allowing the user to take a portion of the system to the item in need of postage, rather than the reverse.

SUMMARY OF THE INVENTION

The invention provides a postage metering system that is portable, low-cost, secure, and flexible in operation. A secure metering device (SMD) maintains important postal information and provides the required secure processing. A computer (or host PC) provides the user interface and coordinates transactions between the SMD, a user, and a provider. By careful partitioning of the various features of the metering system, the SMD can be manufactured in a (relatively) small-size and low-cost unit. Similarly, the use of a small, dedicated printer enhances portability and low cost.

An embodiment of the invention provides a postage metering system that includes a host PC, an SMD, and a printer. The host PC includes a user interface to receive postage information. The SMD operatively couples to the computer via a communications link and includes a processor and a tamper evident enclosure. The processor is configured to receive the postage information from the computer, direct generation of an indicium, and account for the indicium. The tamper evident enclosure houses the processor and other security sensitive elements of the SMD. The printer couples to the SMD and is configured to receive and print the indicium.

Another embodiment of the invention provides a metering device that includes a memory element, an interface circuit, a processor, and an enclosure. The memory element is configured to store accounting information and information related to the operation of the metering device. The interface circuit is configured to receive a message that includes a code that identifies that message. The processor operatively couples to the memory element and the interface circuit. The processor is configured to receive the message, process the message to generate an indicium, and update the accounting information to account for the generated indicium. The enclosure houses the processor and indicates tampering of elements within the enclosure.

Yet another embodiment of the invention provides a method for printing an indicium. In accordance with this embodiment, an SMD is first registered with a provider. The SMD is then funded via a funding transaction with the provider, wherein the funding is performed via an electronic communications link. After funding, the SMD receives a request to print the indicium. The SMD verifies if sufficient funds exist in the SMD to cover the value of the indicium. If sufficient funds exist, the SMD generates a signed message that includes the indicium. The signed message is verified for authenticity and, if authentic, the indicium is printed.

The foregoing, together with other aspects of this invention, will become more apparent when referring to the following specification, claims, and accompanying drawings.

BRIEF DESCRIPTION OF THE DRAWINGS

FIGS. 8A through 8F show diagrams of an embodiment of a main menu screen, a registration screen, a funding screen, an indicium printing screen, an audit screen, and a device status screen, respectively, displayed by the host application software.

DESCRIPTION OF THE SPECIFIC EMBODIMENTS

System Description

Figure 1A:
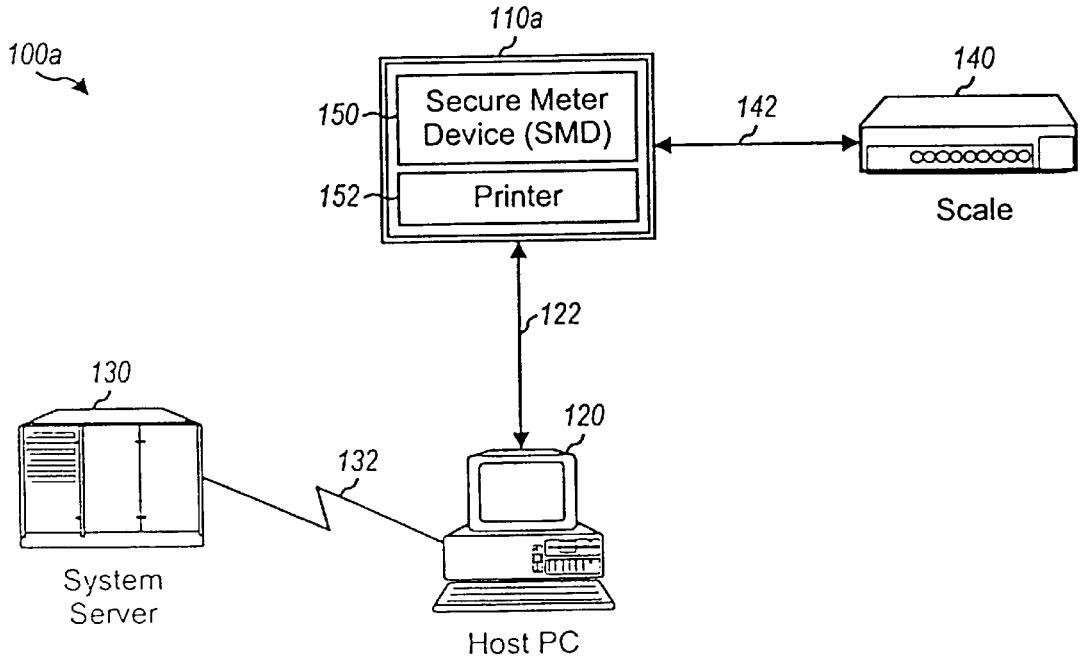
FIGS. 1A and 1B show diagrams of two embodiments of a postage metering system of the invention.

FIG. 1A shows a diagram of an embodiment of a postage metering system 100*a* of the invention. System 100*a* includes a postage metering device 110*a* that couples to a host personal computer (host PC) 120 via a communications link 122. Host PC couples to a system server 130 (also referred to as a POSTAGE-ON-CALL™ system or POC system) via another communications link 132. Communications link 122 can be a serial link such as an RS-232 interface. Communications link 132 can be a telephone link, a wireless link, or other links. Metering device 110*a* can further couples to an optional scale 140, or other peripheral devices, via a communications link 142 that may also be an RS-232 interface. In this embodiment, metering device 110*a* includes a secure meter device (SMD) 150 and a printer 152. The operation of each element in system 100*a* is further described below.

Figure 1B:
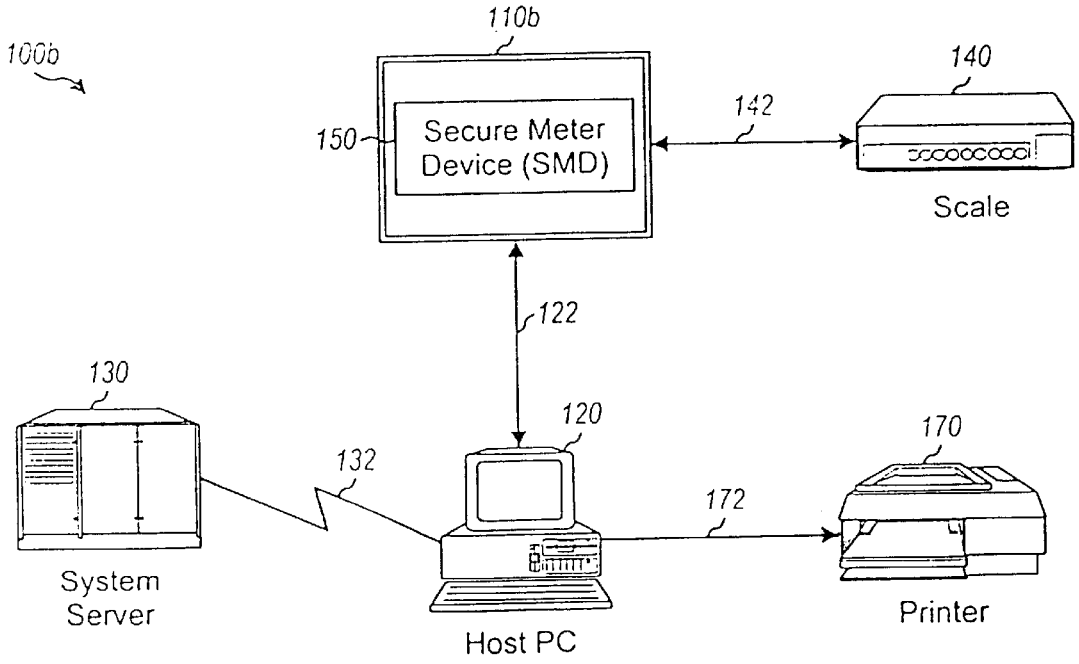

FIG. 1B shows a diagram of an embodiment of another postage metering system 100*b* of the invention. System 100*b* is similar to system 100*a* in FIG. 1A and includes a postage metering device 110*b* that couples to host PC 120 via communications link 122 and to optional scale 140 via communications link 142. Host PC 120 couples to system server 130 via communications link 132 and to a printer 170 via a communications link 172. Communications link 172 can also be a serial link such as an RS-232 interface. In this embodiment, metering device 110*b* includes SMD 150 but no printer.

Figure 2A:
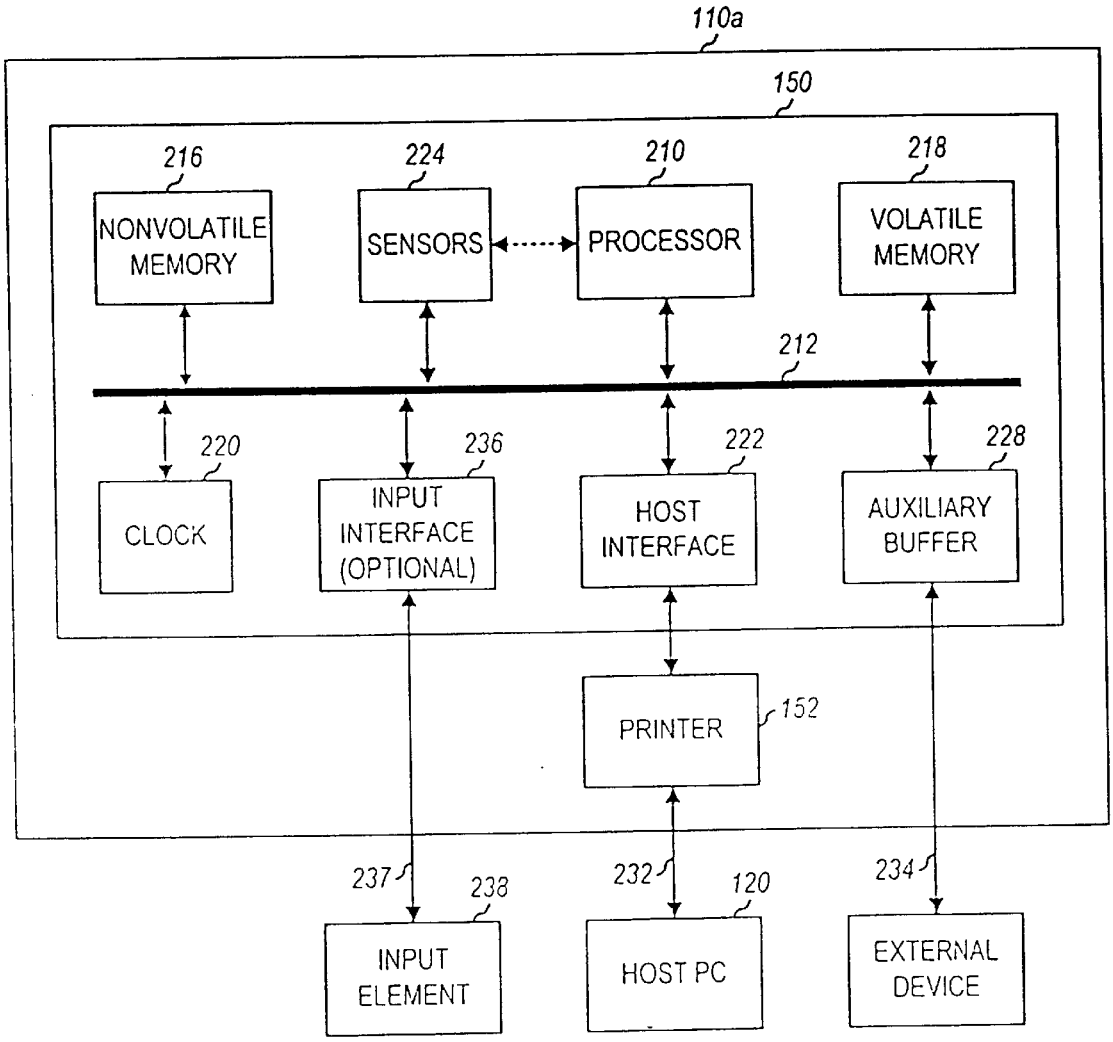
FIG. 2A shows a block diagram of an embodiment of a metering device.

FIG. 2A shows a block diagram of an embodiment of metering device 110*a*. Metering device 110*a* includes SMD 150 and printer 152. Within SMD 150, a processor (also referred to as a CPU) 210 couples to a bus 212 that also interconnects a non-volatile memory 216, a volatile memory 218, a clock 220, and a host interface 222. Sensors 224 can be dispersed throughout metering device 110*a* to detect tampering with the device and to report such event to processor 210. Sensors 224 can couple directly to processor 210 or to bus 212, or a combination of both. Processor 210 performs data processing and coordinates communication with the host PC. Processor 210 also performs the secure processing of the metering device. Non-volatile memory 216 stores data, information, and codes used by the metering device, such as accounting information and information that defines and describes the operation of the metering device. Volatile memory 218 store data and program instructions. Clock 220 provides indication of current time when requested by the processor. Host interface 222 provides the interface with the host PC, and can be a standard interface such as RS-232. Host interface 222 couples to printer 152 via an RS-232 interface or other interfaces.

In accordance with an aspect of the invention, the SMD is responsible for maintaining the contents of certain security relevant data items (SRDIs). The SRDIs include revenue registers, cryptographic keys used for secure data transfer, and others. In an embodiment, the SMD comprises a cryptographic module that performs the secure processing required by the postage metering system. In an embodiment, the cryptographic module includes processor 210, memories 216 and 218, clock 220, and communication interfaces 222 and 228. The cryptographic module is enclosed in a tamper-evident enclosure, and removal of the cryptographic module from the enclosure is possible only upon destruction of the enclosure.

Figure 2B:
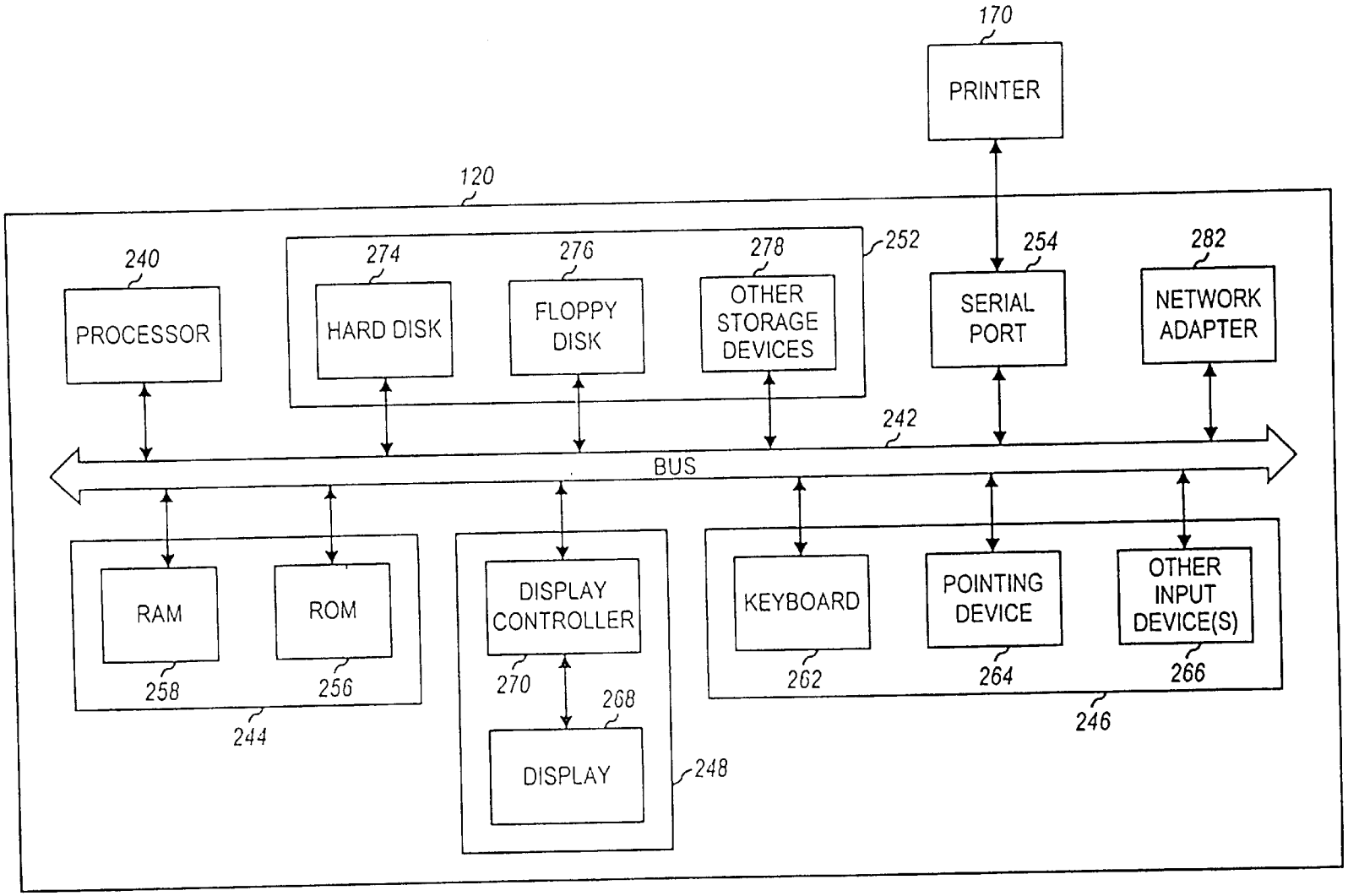
FIG. 2B shows a block diagram of an embodiment of a host PC.

FIG. 2B shows a block diagram of an embodiment of host PC 120. Host PC 120 may be a desktop general-purpose computer system, a portable system, a server, or may be a larger "mainframe" system. Host PC 120 includes a processor 240 that communicates with a number of peripheral devices via a bus 242. These peripheral devices typically include a memory subsystem 244, a user input facility 246, a display subsystem 248, output devices such as a file storage system 252 and printer 170 via a serial port 254. Memory subsystem 244 may include a number of memory units, including a non-volatile memory 256 and a volatile memory 258 in which instructions may be stored. User input facility 246 typically includes a keyboard 262 and may further include a pointing device 264 (e.g., a mouse, trackball, or the like) or other common input devices 266. Display subsystem 248 typically includes a display device 268 (e.g., a cathode ray tube (CRT) or similar devices) coupled to a display controller 270. File storage system 252 may include a hard disk 274, a floppy disk 276, other storage media 278, or a combination of the above. Network connections are usually established through a device such as a network adapter 282 coupled to bus 242, or a modem via serial port 254.

Processors 210 and 240 can be implemented as an application specific integrated circuit (ASIC), a digital signal processor, a microcontroller, a microprocessor, or others electronics units designed to perform the functions described herein. Non-volatile memories 216 and 256 can be a read only memory (ROM), a FLASH memory, a programmable ROM (PROM), an erasable PROM (EPROM), an electronically erasable PROM (EEPROM), a battery augmented memory (BAM), a battery backed-up RAM (BBRAM), or other memory technologies. Volatile memories 218 and 258 can be a random access memory (RAM), a FLASH memory, or other memory technologies. Clock 220 is a real-time clock or a secured timer, which is battery backed, to provide accurate time indication even if the metering device is powered down.

As used herein, the term "bus" generically refers to any mechanism for allowing the various elements of the system to communicate with each other. Buses 212 and 242 are each shown as a single bus but may each include a number of buses. For example, a system typical has a number of buses such as a local bus and one or more expansion buses (e.g., ADB, SCSI, ISA, EISA, MCA, NuBus, or PCI), as well as serial and parallel ports.

Printers 152 and 170 can be specially designed printers or conventional printers. Printers 152 and 170 are capable of printing one-dimensional barcodes, two-dimensional barcodes, FIM (facing identification mark) markings, human readable information, and others. In a specific embodiment, printer 152 is a specially designed printer that is used to print indicia only, although it may be capable of printing other information such as address label, tax stamp, secured ticket, money order, and the like. One such printer is a thermal printer having a resolution of, for example, approximately 200 dots per inch.

In the embodiment shown in FIG. 1A, the printer is enclosed within the metering device. The host interface can be designed to operate on a command set written to reject external print commands, as described below.

With the exception of the input devices and the display, the other elements need not be located at the same physical site. For example, portions of the file storage system could be coupled via various local-area or wide-area network links, including telephone lines. Similarly, the input devices and display need not be located at the same site as the processor, although it is anticipated that the present invention will most often be implemented in the context of general-purpose computers and workstations.

Figure 3A:
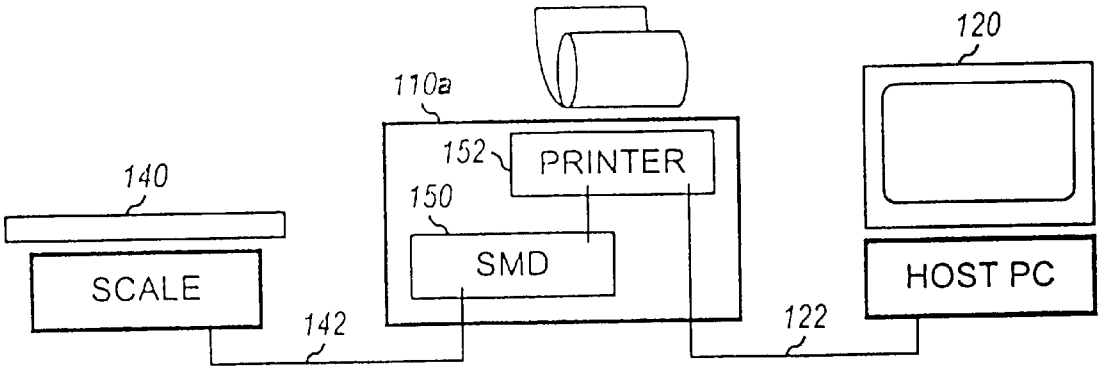
FIGS. 3A and 3B show diagrams of embodiments of the interconnection between the two different metering devices and the host PC.

FIG. 3A shows a diagram of an embodiment of the interconnection between metering device 110*a* and host PC 120. As shown in FIG. 3A, host PC 120, metering device 110*a*, and scale 140 couple in a daisy-chain communications link. Within metering device 110*a*, SMD 150 and printer 152 couple in series and form part of the daisy chain. With the daisy chain link, only one communications port on host PC 120 is required to support the metering device of the invention, and the interconnection between these elements is simplified. The daisy chain architecture also allows for additional (optional) elements to be coupled to the system by simply inserting the elements in the daisy chain. An example of such element is a display unit that displays the value of the transaction, the results of the processing, and other information.

Figure 3B:
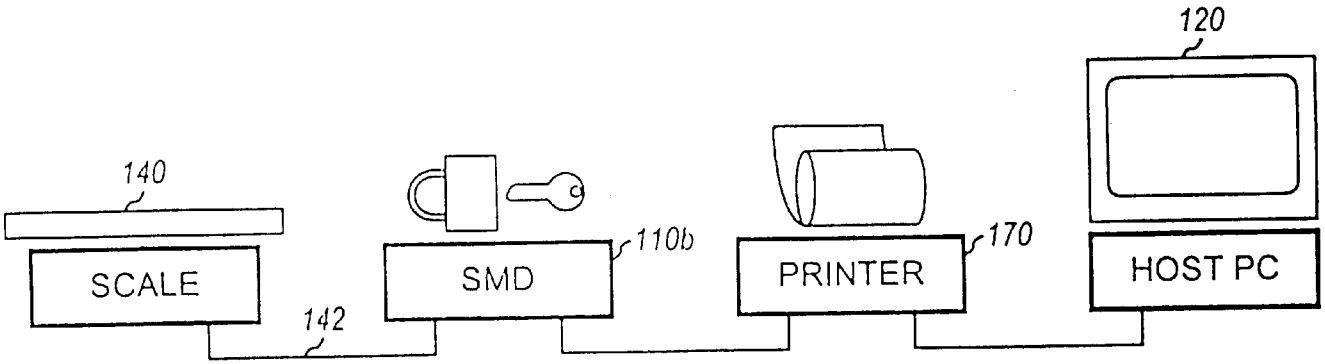

FIG. 3B shows a diagram of an embodiment of the interconnection between metering device 110*b* and host PC 120. As shown in FIG. 3B, host PC 120, printer 170, metering device 110*b*, and scale 140 couple in a daisy-chain communications link. This configuration is similar to that of FIG. 3A, and the system operates in similar manner even though printer 170 is not enclosed within metering device 110*b*. In fact, printer 170 can be any standard printer designed to operate with a general-purpose PC.

As shown in the specific implementations in FIGS. 3A and 3B, the printer couples between the host PC and the SMD. This is advantageous since only one communications port (e.g., a serial port) on the host PC is required for the postage metering system. Moreover, the host PC does not need to be reconfigures for used with the metering system since metering device 110*a* can be directly coupled to a serial port of the host PC and metering device 110*b* can be coupled to a (normally unconnected) auxiliary port on the printer that couples to the serial port. However, other configurations between the metering device, the printer, and the host PC are possible and are within the scope of the invention. For example, the metering device and printer can be coupled to the host PC in a star configuration (as shown in FIG. 1B). In the star configuration, any communication between the metering device and the printer pass via the host PC.

In a specific embodiment, the daisy chain communications link has the following characteristics:

1) Messages sent by the host PC and intended for the SMD are passed unmodified by the printer. The printer does not analyze or store the data included in these messages, with the exception of few specific messages (e.g., a LABELMODE1 message) as described below.
2) Messages send by the SMD and intended for the host PC are normally passed unmodified by the printer. Again, the printer does not analyze or store the data included in these messages, with the exception of few specific printer-directed messages (e.g., an INDICRUM2 message). The printer intercepts messages specifically directed to it, and processes these printer-directed messages.

In a specific embodiment, when the printer intercepts a printer-directed message, the following actions occur:

1) The printer sends a confirmation message (e.g., an INDICIUM3 message) to the host PC. This confirmation message is received by the host PC and interpreted as an indication that the printer has received the printer-directed message. In an embodiment, the confirmation message includes a status field that indicates whether the printer-directed message contained an error, but does not include information (e.g., the indicium) about the action taken in response to the printer-directed message. If the printer-directed message was received in error (i.e., as indicated by a CRC error), the confirmation message sent to the host PC indicates this error. The confirmation message includes a Packet ID field having a value obtained from the Packet ID field of the printer-directed message.
2) When the host PC receives the confirmation message with an "accepted" status field, the host PC responds with an acknowledgment (ACK) message. Alternatively, when the host PC receives the confirmation message with an "rejected" status field, the host PC responds with a negative acknowledgment (NACK) message. The ACK or NACK message includes a Packet ID field having a value obtained from the Packet ID field of the confirmation message.

3) The printer passes the ACK or NACK message, unmodified, to the SMD.

By including the value in the Packet ID field of a received message in a transmitted message, a mechanism is provided to ensure that the values of the Packet ID stored within the SMD and the host PC remain correct, even with the interception of the printer-directed message by the printer. This feature is further described below.

Figure 4:
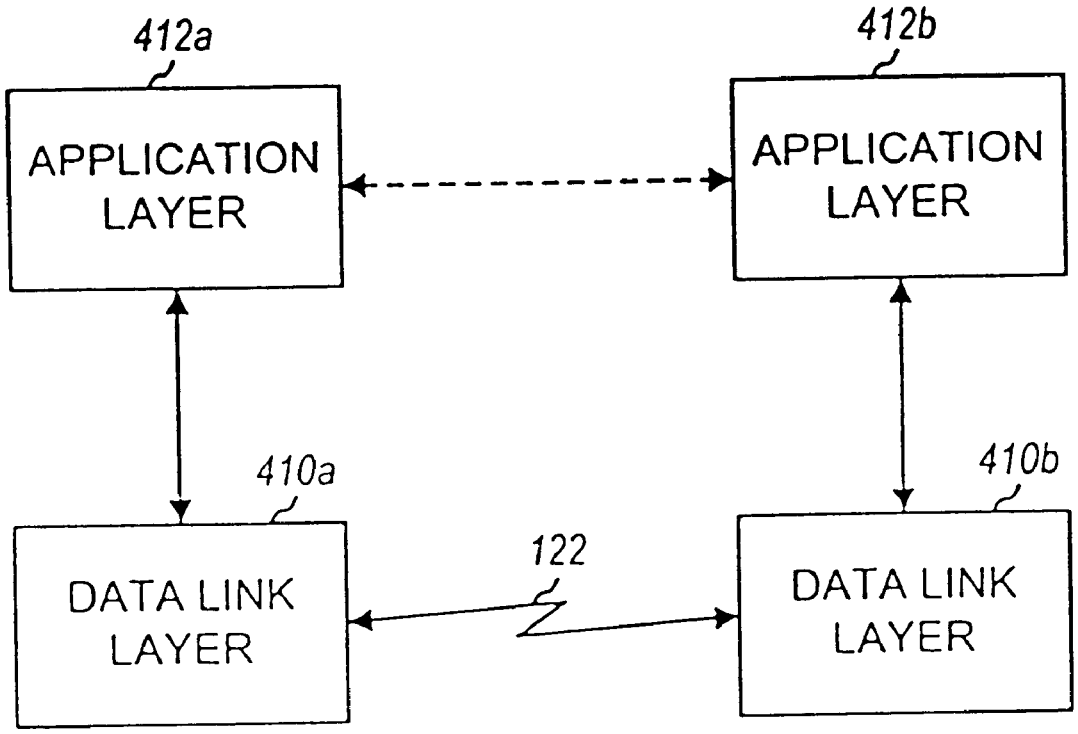
FIG. 4 shows a diagram of an embodiment of a communications protocol between the metering device and the host PC.

FIG. 4 shows a diagram of an embodiment of a communications protocol between metering device 110 and host PC 120. As shown in FIG. 4, metering device 110*a* and host PC 120 communicate with each other using a two-layer (software) protocol supported by communications link 122 (e.g., a serial interface such as RS-232). Data link layer 410*a* residing on metering device 110*a* interacts via communications link 122 with data link layer 410*b* residing on host PC 120. Data link layers 410*a* and 410*b* provide reliable transportation of application layer messages between metering device 110*a* and host PC 120. Data link layers 410*a* and 410 are further described below and also in the aforementioned U.S. provisional patent Application Serial No. 60/075,934. Application layers 412*a* and 412*b* communicate with data link layers 410*a* and 410*b*, respectively, and support the various features and functionality of the metering device. Accordingly, various aspects of the invention are described in the context of the Application Level protocol.

As shown in FIG. 2A, two communications channels extend outside the SMD's enclosure. Processor 210 of the SMD communicates with host PC 120 via host interface 222 that couples to a main communications channel 232 (also referred to as the main port). An auxiliary communications channel 234 (also referred to as the auxiliary port) is used in a "pass-through" mode to replace the serial port on the host PC taken up by the SMD. An external device such as a postal scale can couple to the SMD's auxiliary port. The SMD passes data from the external device to the host PC via the main port. In an embodiment, data received from the auxiliary port is not interpreted by the SMD, and there are no services in the SMD that can be activated by data sequences applied to the auxiliary port (i.e., for security reason, as described below). In an embodiment, all secure communication occurs over the main port, and the SRDIs are not received from or written to the auxiliary port by the SMD. In an embodiment, the SMD processes Application Level protocol messages received on the main port and no other ports, including the auxiliary port, again for security reasons.

The host PC can communicate indirectly with the external device coupled to the auxiliary port via Application Level protocol messages presented to the main port. These messages include, for example, CONFIG AUX PORT, ENABLE AUX PORT, GET AUX STATUS, GET AUX DATA, SEND AUX DATA, AUX STATUS and AUX DATA messages that are further described in Exhibit A. Host interface 222 includes mechanism that facilitates bi-directional communication between the host PC and the external device. The communication is routed through the SMD, but the SMD does not interpret data sent to, or received from the auxiliary port.

The host PC can configure various parameters associated with the auxiliary port, such as the baud rate, parity, and so on. This configuration is achieved by sending a CONFIG AUX PORT message to the SMD. The host PC may then enable communication with the external device by sending the SMD an ENABLE AUX PORT message with an Enable Flag parameter of 0×FF.

In an embodiment, the SMD includes an auxiliary buffer 228 coupled to the auxiliary port. While the auxiliary port is enabled, the SMD receives data from the port and stores it into the buffer. If an Automatic Report Flag is turned ON, the SMD packages the contents of the buffer into an AUX DATA message whenever the buffer reaches a predetermined limit. This message is then sent to the host PC and the buffer is cleared. The buffer then resumes accumulating data from the auxiliary port. AUX DATA messages are sent whenever the buffer reaches the predetermined limit and as long as the auxiliary port is enabled. If the Automatic Report Flag is turned ON and the buffer is not full but a timeout period is reached, the SMD transmits the contents of the buffer in another AUX DATA message.

While the auxiliary port is enabled, the host PC may at any time send a GET AUX DATA message. Upon receipt of a GET AUX DATA message, the SMD sends an AUX DATA message that includes the current contents of the buffer. The SMD then clears the,buffer, whether or not the buffer has reached its fill limit, and resumes accumulating data.

The host PC may also send data to the external device by sending a SEND AUX DATA message to the SMD. Upon receipt of this message, the SMD receives all data following the Message Type code and sends the unaltered data to the auxiliary port. After completing communication with the auxiliary port, the host PC may disable the port by sending to the SMD an ENABLE AUX PORT message with an Enable Flag parameter of 0×00.

The communication protocol described above between the host PC and SMD provides many advantages. First, communication between the host PC and the external device (s) is maintained even in the presence of the SMD interposed within the communications path. For example, if a printer is coupled to the auxiliary port, the host PC can send normal print commands to this printer without alteration by the SMD. The SMD appears transparent to the host PC for messages that are directed to the external device(s). Second, a secured communications link is maintained between the host PC and SMD for security sensitive processes.

SMD Roles

The SMD supports a number of different roles during various transactions and services in which it participates. In a specific implementation, the SMD supports the roles of a Crypto-Officer, a provider, a controlling authority (CA), and a user. The SMD performs predetermined functions and provides predetermined services to each of the roles. The provider is an entity (i.e., a vendor such as Neopost Inc.) that operates a finding system (such the Neopost funding computer, which is also called the POC system). The controlling authority is an entity (such as the U.S. Postal Service (USPS) that "approves" devices (e.g., the SMD) for postal operation. Greater, fewer, or different roles can be supported by the SMD, and this is within the scope of the invention. Greater, fewer, or different services than those described below can be provided by the SMD, and this is also within the scope of the invention. The following describes a specific implementation of the actions performed to each of the roles.

A Crypto-Officer initializes the SMD at the factory (i.e., after the metering device has been manufactured). The Crypto-Officer role is available at the factory, before the SMD is sealed in its tamper-evident enclosure. The SMD validates the Crypto-Officer when the Crypto-Officer installs a FIT (field initialization transaction) flag that is located on the SMD. The SMD performs the Initialization service after the flag has been installed. The Initialization service causes the SMD to generate a pair of public and private keys, export the public key, and load a Provider X.509 certificate that includes the provider's public key. The Crypto-Officer obtains and provides the Provider X.509 certificate to the SMD and archives the SMD's public key. After initializing the SMD, the Crypto-Officer removes the flag and closes the tamper-evident cover.

The SMD supports the provider role by providing the following services: Registration, Funding, Audit, and Withdrawal. These services are described in detail below. Whenever one of these services is requested, the SMD validates that the requester is an authorized provider. This is achieved by using the provider's public key to validate the signature on the service request that has been signed using the provider's private key. The provider's public key is retrieved from the Provider X.509 certificate that is loaded by the Crypto-Officer during initialization.

The SMD supports the user role by providing the following services: Indicium, Status, Self-Tests, Read & Adjust RTC, Read X.509 Certificates, and Configure Aux. Serial Port. These services are described in detail below. The SMD does not verify the requester in the user role. If one of these services is requested after the SMD has been initialized, the SMD performs the service without requesting a role validation.

The SMD supports the controlling authority role by providing an Inspection service. A request to perform an Inspection is signed using the CA's private key. The SMD validates the signature using the CA's public key stored in the CA X.509 certificate loaded by the Authorize service, as described below.

SMD Operating States

In a specific implementation, SMD operates in one of a predetermined number of operating states. The current operating state depends on the contents of a set of registers or locations in the SMD's non-volatile memories. These contents define and describe the operation of the SMD. The SMD generally transitions between the operating states as a result of a transaction with the host PC and the system server (for some transactions). However, some of the operating states can be reached in response to other conditions (e.g., detection of tampering with the SMD), as described below.

In a specific embodiment, the SMD includes two types of operating state: persistent states and intermediate states. A persistent state is one in which the SMD may remain for an indefinite period of time, even if power is removed and reapplied. An intermediate state is one that the SMD occupies for a short period of time, and is not occupied by the SMD upon power-up. Intermediate states are reached during transactions that include the transmission of more than one request/response message pair. In an embodiment, if the SMD is in an intermediate state and an unexpected event occurs (e.g., power is removed or an unexpected message is received), the SMD reverts, when operation resumes, back to the previous persistent state it occupied prior to the beginning of the transaction.

Figure 6A:
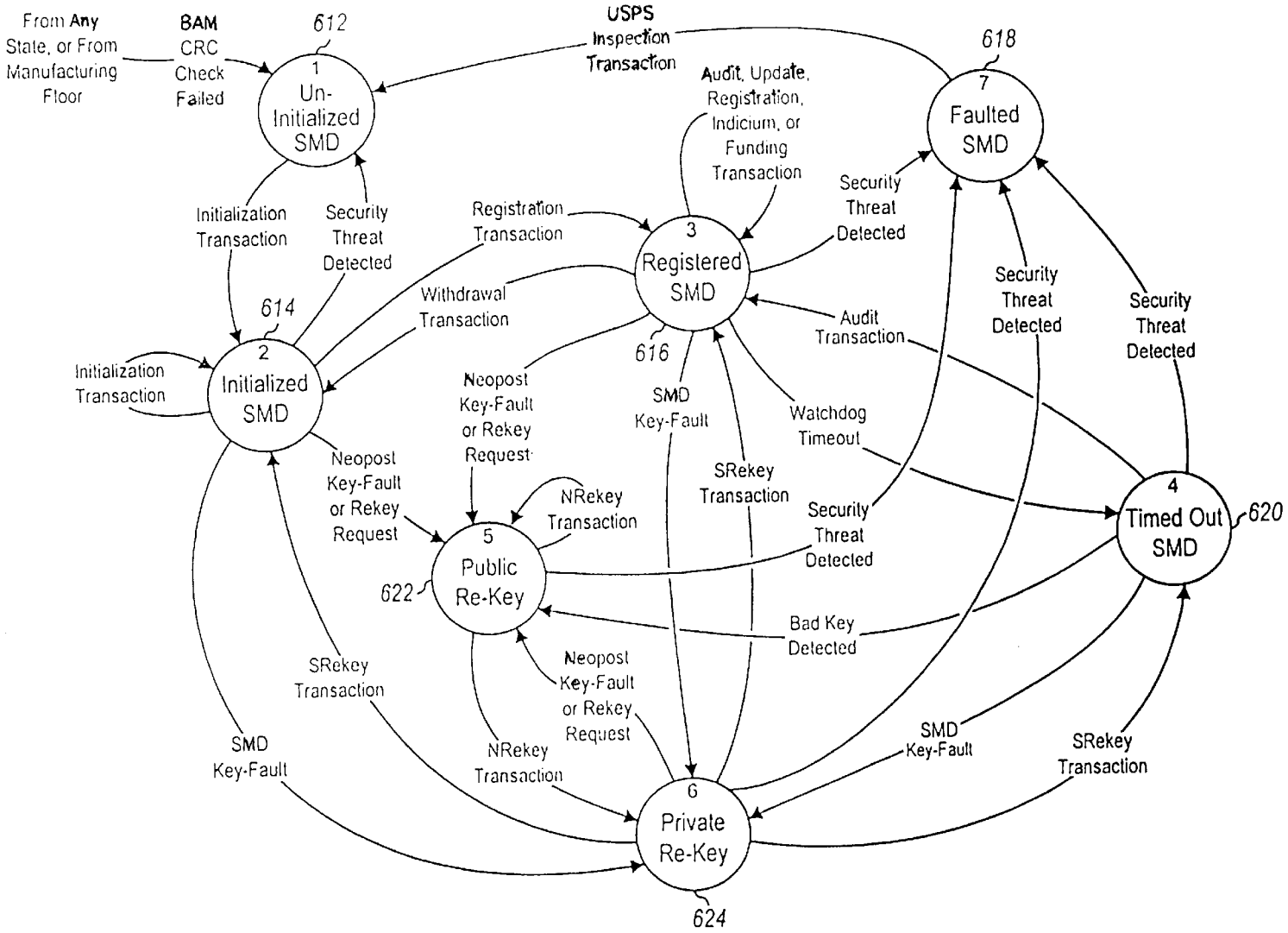
FIG. 6A shows a state diagram of a specific embodiment of the operating states of the SMD.

FIG. 6A shows a state diagram of a specific embodiment of the operating states of the SMD. In the embodiment shown in FIG. 6A, the SMD includes an Uninitialized state 612, an Initialized state 614, an Registered state 616, a Faulted state 618, a Time-Out state 620, a Public Rekey state 622, and a Private Rekey state 624. Greater, fewer, or different operating states may be used and are within the scope of the invention. The following describes a specific implementation of the operating states.

Uninitialized State: The SMD enters the Uninitialized state when it is determined on power-up that the SMD has not been initialized. Newly manufactured SMDs and SMDs that have been reset enter this state upon their first power-up. When in the Uninitialized state, the SMD does not allow SRDIs to be altered except via a valid Initialization transaction. Such a transaction is typically performed at the factory since it involves the generation and cataloging of the SMD's private and public keys.

Initialized State: The SMD transitions from the Uninitialized state to the Initialized state after completing a successful Initialization transaction. An initialized SMD is unable to dispense revenue, but can transmit the contents of revenue and identification registers to the host PC. In an embodiment, an initialized SMD is not assigned to any particular user.

Registered State: The SMD transitions from the Initialized state to the Registered state after completing a Registration transaction. The Registration transaction may be performed outside the factory, and is usually performed at the user's premises using the user's PC as the host PC. A Registered SMD is registered to a particular user, but is still unable to dispense revenue because no revenue has been loaded into the SMD. A Registered SMD is able to issue zero valued indicia to allow the user to test the operation of the system.

A Registered SMD may be funded by performing a Funding transaction with the system server via the host PC. The Funding transaction adds revenue to the revenue registers within the SMD. A funded SMD is capable of issuing non-zero valued indicia, up to an authorized maximum value. Once the SMD has dispensed enough revenue such that the amount remaining in the revenue registers is less than an authorized minimum value, the SMD can no longer issue non-zero valued indicia until another Funding transaction is completed.

A Registered SMD may also process a request to print indicium by performing an Indicium transaction.

Faulted State: The SMD transitions to the Faulted state if the SMD has been registered and a security threat is detected. While in the Faulted state, the SMD does not perform transactions that can alter the revenue registers. The SMD can transition out of the Faulted state with a signed message from the USPS or other controlling agencies. The agency typically inspects a faulted SMD before sending this signed message to the SMD.

Time-Out State: The SMD maintains a timer that is initialized with a time-out value transferred to the SMD during the Registration transaction. The timer counts down in real time until it reaches zero, at which point the timer "times out." If the timer times out while the SMD is in the Registered state, the SMD transitions to the Timed-Out state and sends the host PC a message (e.g., a STATECHG message) indicating that it has transitions to the Time-Out state. The SMD does not transition out of the Timed-Out state unless it successfully completes an Audit transaction, in which case it transitions back to the Registered state. If a security threat is detected while in the Time-Out state, the SMD transitions to the Faulted state.

In an embodiment, a timed-out SMD does not dispense indicia, even if there is sufficient revenue within the revenue registers. This specific implementation forces the user to perform periodic Audit transactions to allow the provider to audit and track the SMD from time to time to ensure that it is not being used in a fraudulent manner.

Intermediate States: If a transaction comprises more than one request/response message pair, the SMD waits in an intermediate state, upon sending the response for a particular message pair, for the next request message in the transaction sequence. Intermediate states are designed such that the SMD expects a particular request message. The action taken by the SMD depends on the next request message received by the SMD and the time the message is received.

While in the intermediate state, the SMD terminates the transaction if any of the following conditions occurs: (1) a message other than the next expected request is received, (2) the SMD receives from the host PC a signed message that includes an invalid signature, (3) the SMD does not receive the expected message to continue the transaction within a predetermined period (e.g., two minutes). Termination of the transaction includes sending the host PC an error message that includes an appropriate error code and returning to the operating state the SMD occupied prior to the start of the transaction. If power is removed from the SMD while it is in an intermediate state the SMD, upon subsequent power-up, reverts to the state it occupied previous to the start of the transaction. Upon receipt of the last request message in the transaction and after sending the final response message, the SMD transitions to the operating state appropriate for that particular transaction.

Upon power up, the SMD performs checks to determine which one of the allowable operating states to enter. The power-up checks include checks necessary to insure proper operation of the metering device and checks of the SRDIs within the SMD. The checks may further include the verification of the CRC or the signature of the contents of the SRDIs. If it is determined upon power-up that the SMD has not been initialized, the SMD transitions to the Uninitialized state. The SMD transitions to the Faulted state if the power-up checks determine that the SMD has been initialized but some SRDIs contain invalid data.

Transactions

The SMD provides services by exchanging messages between itself and the host PC via the SMD's main port. A service is a set of operations performed by the SMD on behalf of an entity operating in a particular role. Communications software is installed on the host PC to access SMD services. The software is readily available from the provider, and no special security is associated with obtaining or installing the software.

The messages are structured into groups called transactions. A transaction is a series of one or more request/response message pairs comprising the performance of a particular service. A request message is a message sent from the host PC to the SMD. A response message is a message sent from the SMD to the host PC following the SMD's processing of the request message.

The SMD interacts with the host PC to carry out various transactions and functions. As an example, the SMD cooperates with the host PC to generate revenue certificates referred to as indicia. An indicium may be generically viewed as a printed certificate that can be used as evidence that a certain amount of money has been paid, similar to a postage stamp. Indicia can in fact be used for postage stamps.

In an embodiment, the SMD provides the following functions: (1) secure data storage for the SRDIs, (2) secure storage and processing for indicia information, (3) security processing (e.g., verification of a signed message using digital signature algorithm (DSA)), (4) I/O communications with the host PC, (5) processing as required by the postage metering system, and others. Some of these functions are performed by the SMD without input or intervention from external devices, while some other functions are performed in cooperation with the host PC and (for some transactions) the system server. The various services and functions performed by SMD are further described below.

The host PC performs various functions in support of the SMD. For example, the host PC acts as a user interface to receive user inputs and to display messages and results. The host PC also provides some processing of the received data, such as calculation of the proper postage amount for an indicium based on user input data. The host PC sends requests to the SMD, receives responses from the SMD, and processes the responses. For example, the host PC can store the responses from the SMD and displays the responses such that the user can be informed of success or failure of a request. The various functions performed by the host PC are further described below.

The SMD also interacts with the system server (via the host PC as shown in FIGS. 1A and 1B) to engage in specific transactions, as required or allowed by the postage metering system. Some of the requirements may be imposed by the USPS. In an embodiment, the SMD can be directly coupled to the system server via communications channels such as a (dedicated) wide area network (WAN), the Internet, and others. Transactions between the SMD and system server can include the following: (1) system registration (including lockout and update), (2) postage value download, (3) device audit, (4) device withdrawal, (5) error state correction of the metering device, and others. The various transactions between SMD and system server are further described below.

Figure 5A:
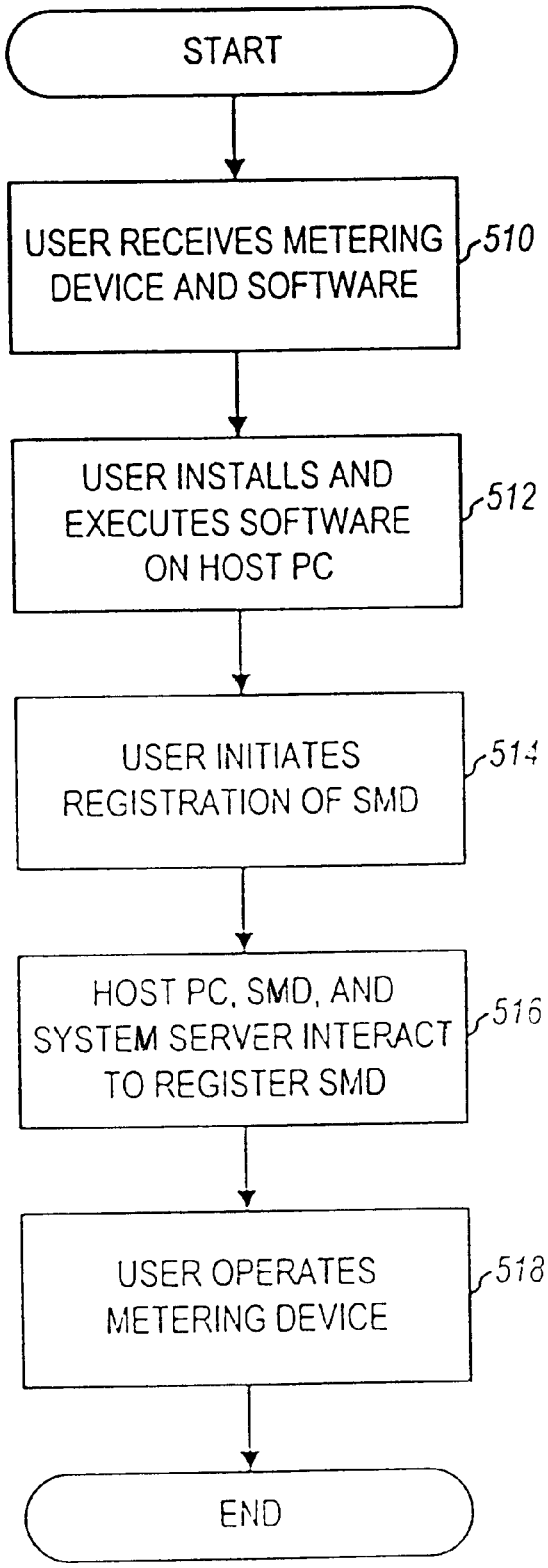
FIG. 5A shows a flow diagram of an embodiment of an operational process of the metering device.

FIG. 5A shows a flow diagram of an embodiment of an operational process of the metering device. At a step 510, a user receives the metering device with the associated software from the provider (Neopost Inc.). The user then installs the software on a host PC and executes the software, at a step 512. Via the software, the user initiates an online registration of the SMD, at a step 514. Alternatively, the registration can be performed through other techniques such as calling a customer representative of the provider. The host PC, SMD, and system server then interact and cooperate to register the SMD, at a step 516. After a successful registration, the user is allowed to operate the metering device, at a step 518, for various transactions such as printing indicia.

In a specific implementation, the SMD supports the following services: Initialization, Registration, Indicium, Funding, Audit, Withdrawal, Status, Self Tests, Adjust RTC, Get X.509 Certificate, and Enable, Disable, and Configure Auxiliary Serial Port. Greater, fewer, or different services than those listed above can be provided by the SMD, and this is within the scope of the invention. Each of these services is performed to a particular role, as tabulated in Table 1.

TABLE 1

Roles versus Services Matrix

| | Roles | | | |
|---|---|---|---|---|
| Services | Crypto-Officer | Provider | Controlling Authority | User |
| Initialization | X | | | |
| Registration | | X | | |
| Indicium | | | | X |
| Funding | | X | | |
| Audit | | X | | |
| Inspection | | | X | |
| Withdrawal | | X | | |
| Status | | | | X |
| Self Tests | | | | X |

TABLE 1-continued

| Roles versus Services Matrix | | | | |
|---|---|---|---|---|
| | Roles | | | |
| Services | Crypto-Officer | Provider | Controlling Authority | User |
| Adjust RTC | | | | X |
| Read X.509 | | | | X |
| Certificates | | | | X |
| Auxiliary Port Ops | | | | X |

The SMD processes transaction requests that are appropriate for the current operating state of the SMD. Exhibit C tabulates the messages that are appropriate for the various operating states. If the SMD receives a request message that is not appropriate for the current operating state, the SMD sends an error response message to the host PC and returns to the operating state it occupied before receiving the request.

Initialization transaction: An Initialization transaction prepares the SMD for operation. The following is a specific implementation of the Initialization transaction, and other implementations are available.

Figure 5B:
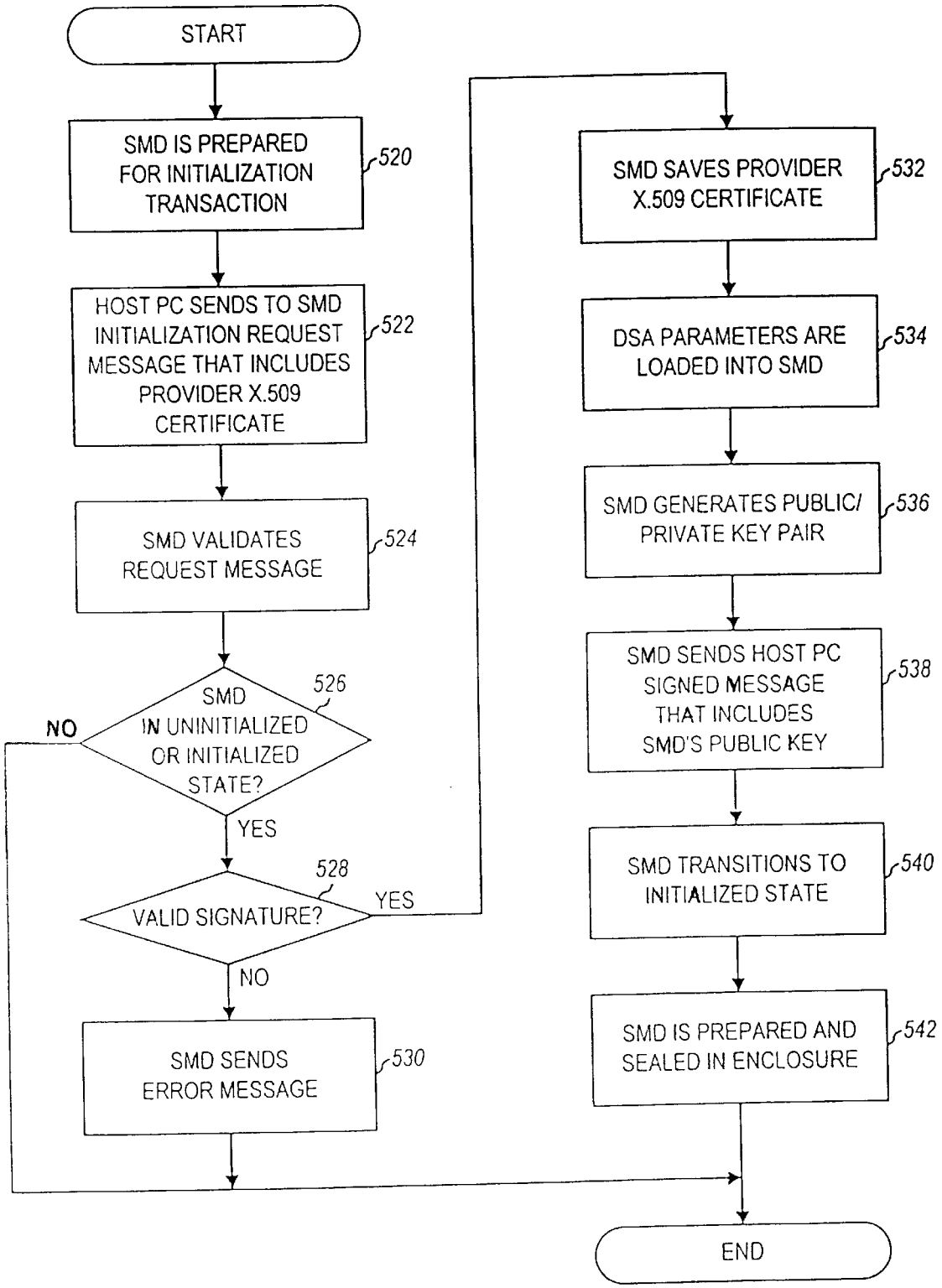
FIGS. 5B, 5C and 5C-2, 5D and 5D-2, 5E and 5E-2, 5F and 5F-2, and 5G and 5G-2 show flow diagrams of an embodiment of the Initialization, Registration, Funding, Indicium, Audit, and Withdrawal transactions, respectively.

FIG. 5B shows a flow diagram of an embodiment of the Initialization transaction. At a step 520, the SMD is prepared for the Initialization transaction. This preparation can comprise installing a FIT flag located on the SMD. The Crypto-Officer then, via a host PC, sends the SMD an initialization request message that includes the Provider X.509 certificate and the device ID number, at a step 522. This request message is signed using the provider's private key. The SMD receives and validates the request message, at a step 524.

The SMD accepts a request to perform an Initialization transaction if it is in an Uninitialized or Initialized state. This determination is performed at a step 526. If the SMD receives a request to perform an Initialization transaction and the FIT flag is not installed or if the SMD is not in the Uninitialized or Initialized state, the SMD ignores the request and the transaction terminates. The validation of the request message includes verification of the signature in the request message using the provider's public key from the Provider X.509 certificate, at a step 528. If the signature is invalid, the SMD sends an error message, at a step 530, and the transaction terminates.

If the signature is valid, the SMD saves the Provider X.509 certificate provided in the request message, at a step 532. The DSA (digital signature algorithm) parameters p, q, and r are then loaded into the SMD, at a step 534. The SMD uses these parameters to generate a pair of public and provide keys, at a step 536. The SMD retains the private key in secrecy and exports the public key. The SMD sends the host PC a signed message that includes the SMD's public key, at a step 538. This message is signed using the SMD's private key and can be verified by the host PC using the SMD's public key that is included in the message. The SMD then transitions to the Initialized state, at a step 540. Before an initialized SMD leaves the factory, the Crypto-Officer removes the FIT flag and seals the tamper-evident enclosure, at a step 542.

The SMD does not accept a request to perform any transaction other than an Initialization transaction if it is in the Uninitialized state. After a successful Initialization transaction, the SMD transitions to the Initialized state. The SMD tests for the presence of the FIT flag when a request is received to perform any transaction that alters the SRDIs. If the FIT flag is present and the requested transaction is not the Initialization transaction, the SMD enters the Faulted state.

In summary, the following operations are performed by the Initialization transaction:

Load the DSA parameters p, q, and g into the SMD.

Load the Provider X.509 certificate that includes the provider's public key into the SMD.

Instruct the SMD to generate a public/private key pair.

Instruct the SMD to export the public key.

Place the SMD the Initialized operating state.

Registration transaction: A Registration transaction prepares the SMD for operation at a user site and notifies the system server to activate the user's account. In an embodiment, registration of the SMD is performed before the SMD is allowed to process other transactions. The Registration transaction is achieved between the host PC, SMD, and system server via the SMD's main port. The following is a specific implementation of the Registration transaction, and other implementations are available.

Figure 5C:
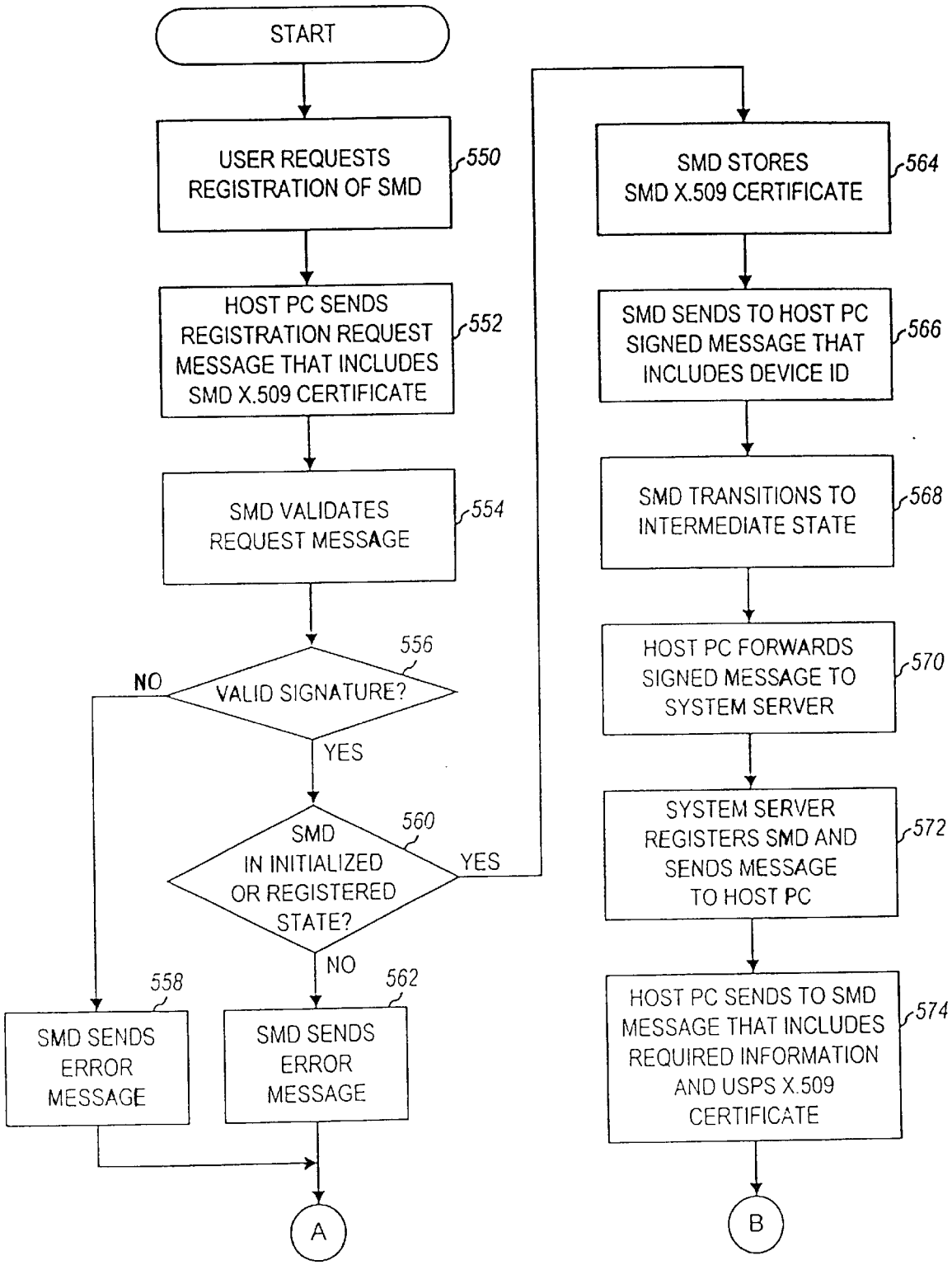
Figures 2, 5C:
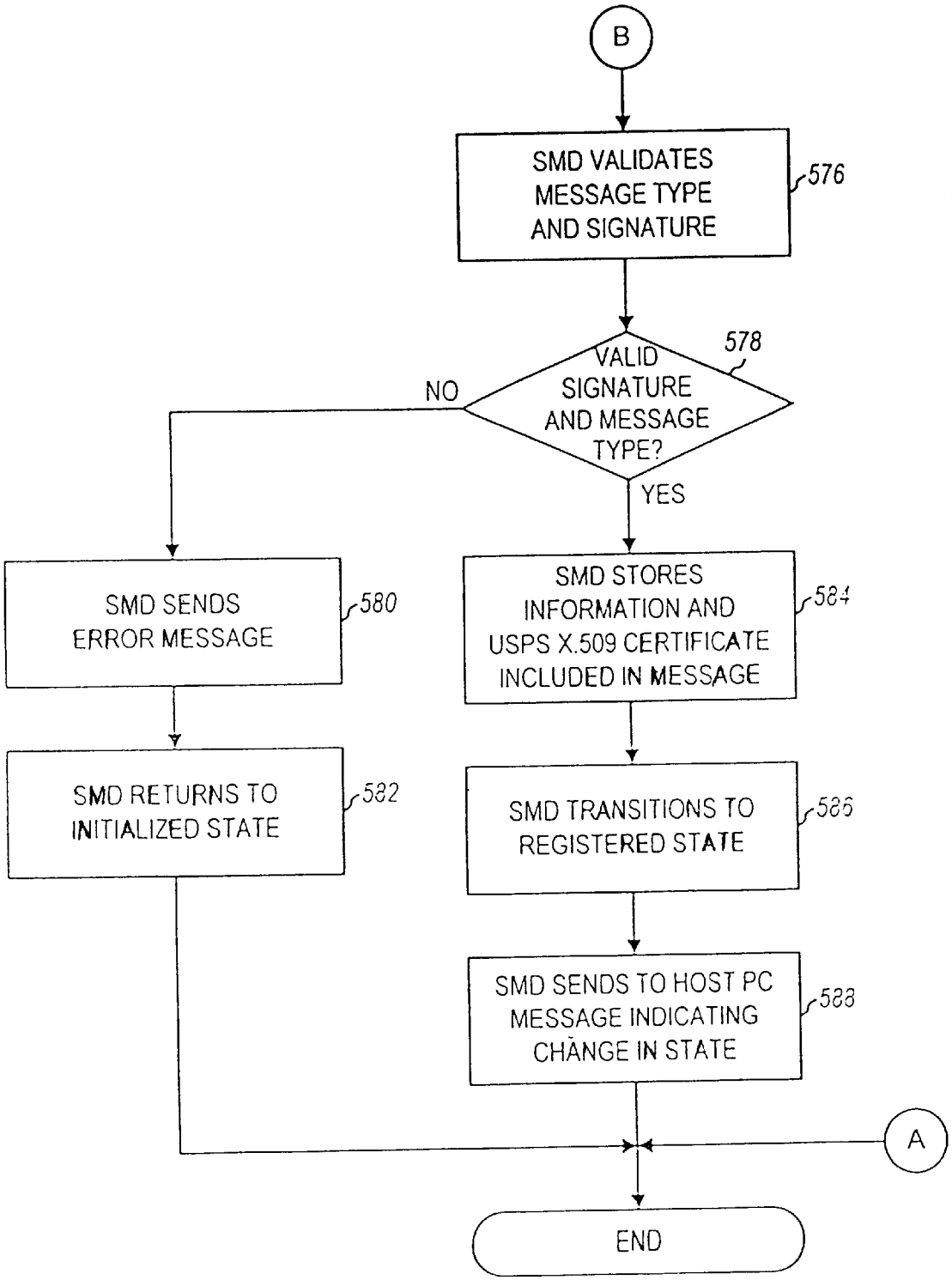

FIGS. 5C and 5C-2 show a flow diagram of an embodiment of the Registration transaction. At a step 550, the user requests, via the host PC, registration of the SMD. The user typically initiates an online registration when the user first installs the application software on the host PC. In response, the host PC sends the SMD a registration request message that includes the SMD X.509 certificate, at a step 552. This request message is signed using the provider's private key. The SMD receives and validates the request message, at a step 554.

The SMD X.509 certificate includes the SMD's public key, and is sent along with messages signed by the SMD. The SMD X.509 certificate allows entities receiving the SMD signed messages to validate the signatures included in the signed messages. The SMD X.509 certificate is generated by the USPS based on the SMD's public key that was sent to the Crypto-Officer during the Initialization transaction.

The registration can be performed by an entity operating in the provider role, and this role is validated by requiring that the registration request message from the host PC be signed using the provider's private key. Thus, the validation of the request message includes a verification of the signature in the request message, at a step 556. The SMD verifies the signature using the provider's public key from the Provider X.509 certificate loaded into the SMD during the Initialization transaction. If the signature is invalid, the SMD sends an error message, at a step 558, and the transaction terminates. If the signature is valid, the transaction continues.

The SMD accepts a request to perform a Registration transaction if it is in an Initialized or Registered state. This determination is performed at a step 560. If the SMD receives a request to perform an Initialization transaction and is not in the Initialized or Registered state, the SMD sends an error message, at a step 562, and the transaction terminates.

Otherwise, if the SMD is in the proper operating state, it stores the SMD X.509 certificate includes in the request message, at a step 564, The SMD then sends the host PC a signed message that includes the device ID, at a step 566, and transitions to an intermediate state, at a step 568. The host PC receives and forwards the signed message to the system server, at a step 570. The system server registers the SMD and sends the host PC a message, at a step 572. The host PC receives the message from the system server and sends the SMD a signed message that includes the USPS X.509 certificate and other information, at a step 574. The SMD receives and validates the message, at a step 576.

During the Registration transaction, the SRDIs are included in a request message signed using the provider's private key and loaded into the SMD. The SMD does not accept any data included in such message unless it verifies the signature using the provider's public key. The validation of the message includes verification of the signature and the message type, at a step 576. If it is determined, at a step 578, that the signature is invalid or the message is of an unexpected type, the SMD sends an error message, at a step 580. The SMD then returns to the Initialized state, at a step 582, and the transaction terminates.

Otherwise, if the signature is valid and the message is of an expected type, the SMD stores the USPS X.509 certificate and the information included in the message, at a step 584. The SMD then transitions to the Registered state, at a step 586, and sends the host PC a message indicating a change in operating state, at a step 588.

In summary, the Registration transaction performs the following operations:

Load the SMD X.509 certificate into the SMD.

Load the user's account number and licensing information into the SMD.

Load a maximum and a minimum indicium revenue value, and a Watchdog Timer increment value into the SMD.

Load the CA X.509 certificate into the SMD. A controlling authority (such as the USPS) provides a certificate to the SMD that includes the authority's public key so the SMD can verify signature on messages signed by the authority.

Funding transaction: A Funding transaction allows an entity operating in the provider role to authorize the SMD to add more revenue to its revenue registers so it can generate more indicia. The user requests the host PC to begin a Funding transaction. The entity operating in the user role cannot authorize the Funding service, but can request initiation of the service. The entity operating in the provider role participates in, and authorizes the Funding service. Funding of the SMD is allowed after the SMD has been registered with the system server, which is achieved by the process described above in FIGS. 5C and 5C-2.

In an embodiment, funding is authorized by the system server based on, for example, funds that have been previously deposited and credited to the user's account. Alternatively, the funds can be provided by the user during the funding transaction through the use of, for example, a debit card, a charge card, a charge account, or other credit mechanisms. At the completion of the funding process, the SMD revenue registers are incremented by an amount specified by the system server, and the system server debits the user's account accordingly. The following is a specific implementation of the Funding transaction, and other implementations are available.

Figure 5D:
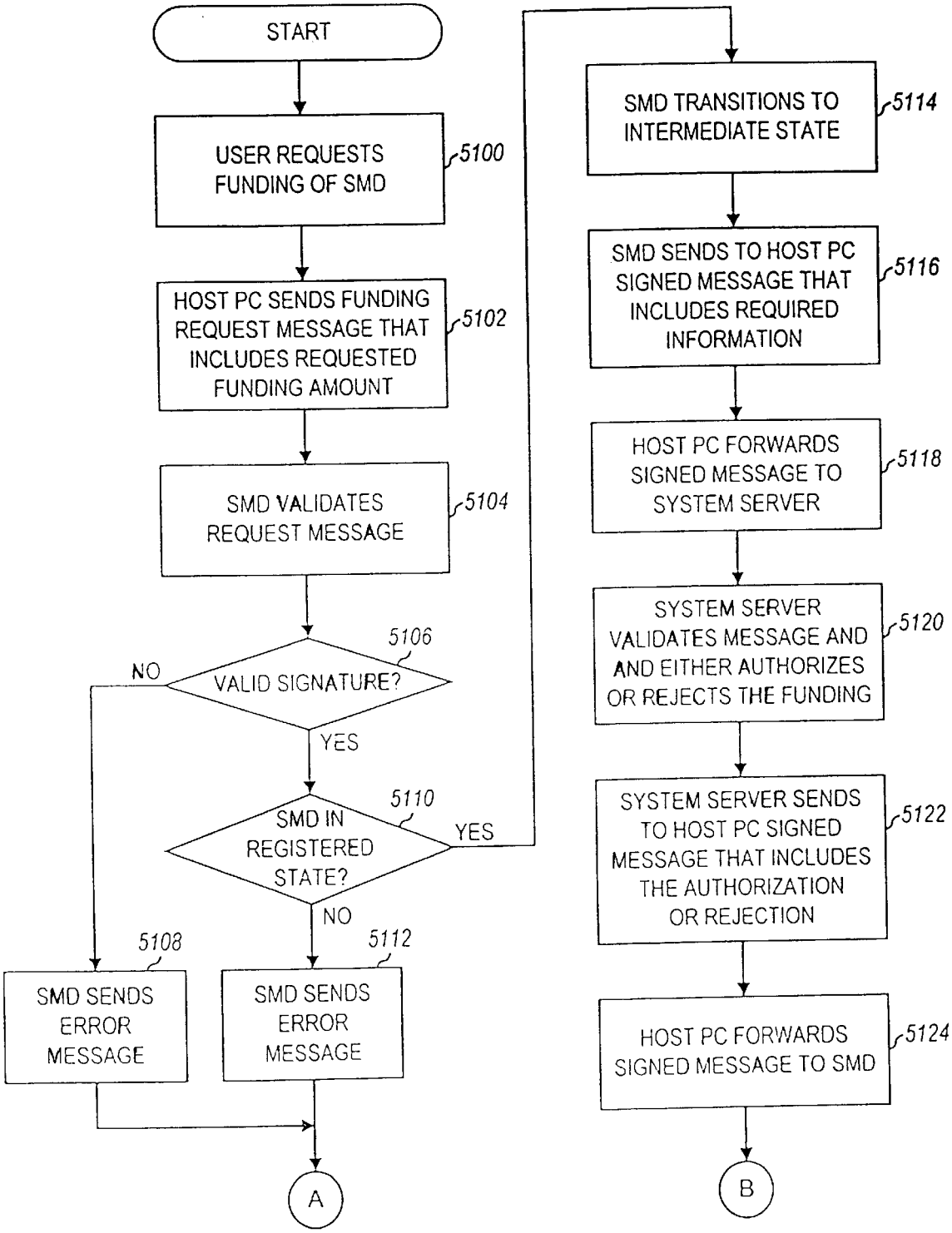
Figures 2, 5D:
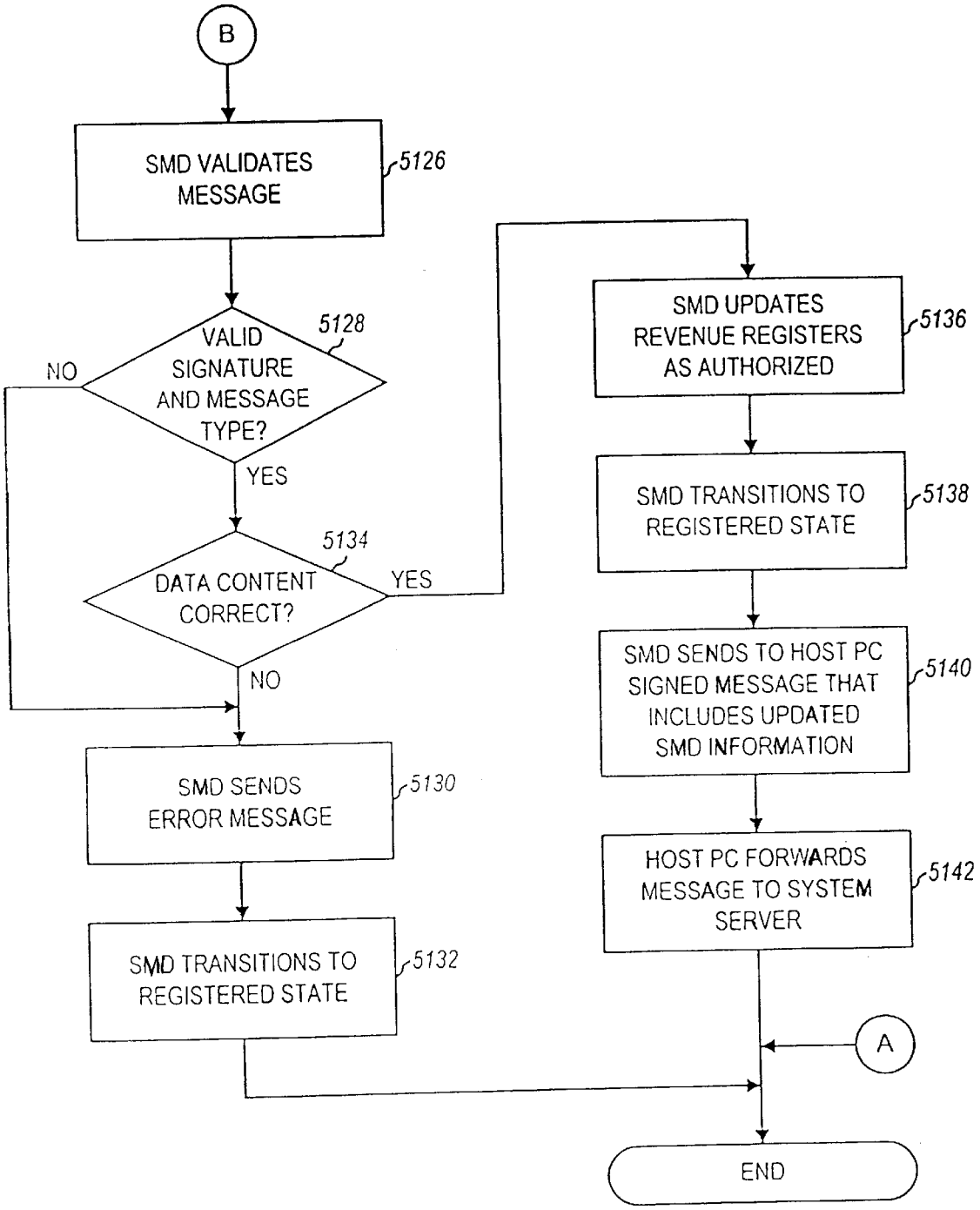

FIGS. 5D and 5D-2 show a flow diagram of an embodiment of the Funding transaction. At a step 5100, the user requests, via the host PC, funding of the SMD. Alternatively, the host PC can also query the user for a Funding transaction if the available funds drop below a predetermined value or if the available funds are insufficient to cover the requested transaction. The host PC can provide the user with information such as the current available funds in the SMD, the upper and lower fund amounts that can be requested, and so on. The user can enter the requested funding amount, the payment option, and other information.

The host PC sends the SMD a funding request message that includes the requested funding amount, at a step 5102. This request message is signed using the provider's private key. The SMD receives and validates the request message, at a step 5104.

The funding can be performed by an entity operating in the provider role, and this role is validated by requiring that the funding request message from the host PC be signed using the provider's private key. Thus, the validation of the request message includes a verification of the signature in the request message using the provider's public key, at a step 5106. If the signature is invalid, the SMD sends an error message, at a step 5108, and the transaction terminates. If the signature is valid, the transaction continues.

The SMD accepts a request to perform a Funding transaction if it is in a Registered state. This determination is performed at a step 5110. If the SMD receives a request to perform a Funding transaction and is not in the Registered state, the SMD sends an error message, at a step 5112, and the transaction terminates.

Otherwise, if the SMD is in the Registered state, it transitions to an intermediate state, at a step 5114. The SMD then sends the host PC a signed message that includes the required information, at a step 5116. The required information may include, for example, the requested funding amount, the current contents of the revenue registers, the customer licensing information (e.g., the identity of the SMD and the user's account), the current date and time, a transaction serial number generated by the SMD, and other information (e.g., the credit or debit card number and its expiration date). The host PC receives and forwards the signed message to the system server, at a step 5118.

The system server receives and validates the message, and either authorizes or rejects the funding request, at a step 5120. As part of the processing, the system server authenticates the signed message using the SMD's public key. If sufficient funds are available in the user's account (or if the credit card is approved for the requested amount), the system server authorizes the charging of the funds. The system server may also track the SMD and log the requested transaction (i.e., regardless of whether the funding is approved or not). The system server then sends the host PC a signed message that includes the authorization or rejection, at a step 5122.

The host PC receives and forwards this signed message to the SMD, at a step 5124. The host PC may also display the results of the funding process (i.e., informing the user that the requested funding has been approved or rejected by the system server). The SMD receives and validates the message, at a step 5126. The validation of the signed message includes a verification of the signature and a determination of whether the message is of the expected type, at a step 5128. If the signature is invalid or the message is not of the expected type, the SMD sends an error message, at a step 5130, and transitions to the Registered state, at a step 5132. The transaction then terminates.

Otherwise, if the signature is valid and the message is of an expected type, the SMD determines if the relevant data content of the message is correct, at a step 5134. This may include, for example, verification that the transaction serial number in the received message is the same as the number forwarded by the SMD earlier. If the data is not valid, the SMD proceeds to step 5130 and sends an error message. Otherwise, if the data is valid, the SMD updates the revenue registers as authorized (i.e., by zero if funding is rejected, or by the authorized funding amount), at a step 5136. The SMD then transitions to the Registered state, at a step 5138. The SMD sends the host PC, at a step 5140, a signed status message that includes, for example, the updated revenue registers and the transaction serial number. This message is forwarded to the system server, at a step 5142. The host PC may update the display to inform the user that the requested funds are available for use. The transaction then terminates.

In a specific embodiment, the available funds within the SMD are limited to a predetermined amount (e.g., $500, or some other values). The finding request is then limited based on the currently available funds, the predetermined fund limit, and the amount of approved credit. For example, if the limit is $500 and the SMD has $20 of funds remaining when the user requests a funding transaction, the amount of request is limited to $480. This implementation reduces the risks of fraud, loss, and theft since the total funds amount cannot be increased to a large amount.

Indicium transaction: An Indicium transaction allows the user to obtain revenue in the form of indicia from the SMD. Printing of the indicium is allowed after the SMD has been registered with the system server, which is achieved by the process described above in FIGS. 5C and 5C-2. The Indicium transaction is initiated when, at the user's request, the host PC sends the SMD a message requesting the SMD to deduct a revenue amount from its revenue registers. If sufficient funds exist, the SMD generates a signed bit pattern representing the revenue (i.e., an indicium) that is sent to the host PC. The host PC then renders the indicium into a predetermined (e.g., 2-D barcode) format and prints it on a document. The printed indicium is verifiable visual evidence that revenue was paid.

In the following description, the SMD is coupled to the host PC and the user interacts with the SMD via the host PC. The SMD is also capable of operating in a stand-alone mode, and this is described below. The following is a specific implementation of the Indicium transaction, and other implementations are available.

Figure 5E:
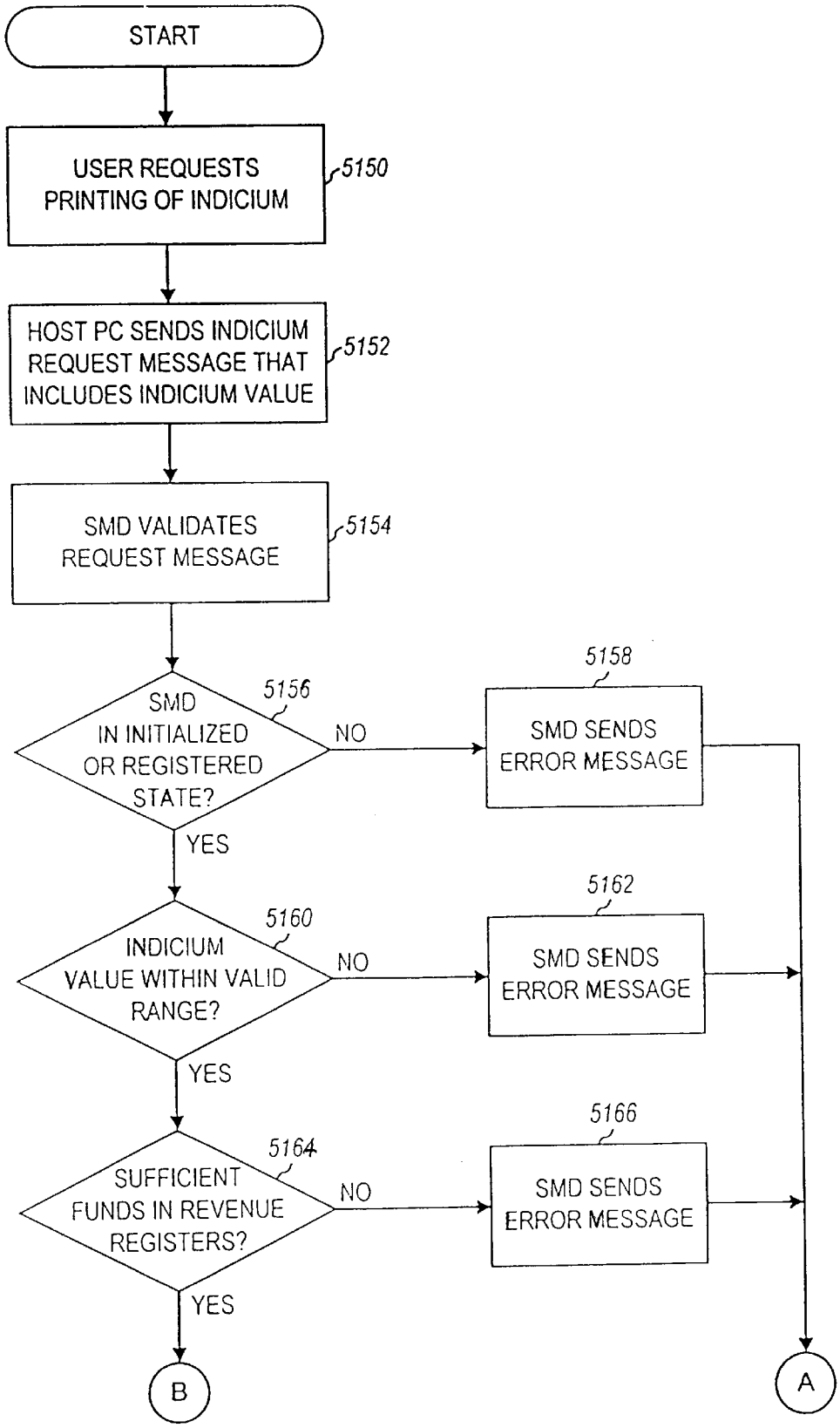
Figures 2, 5E:
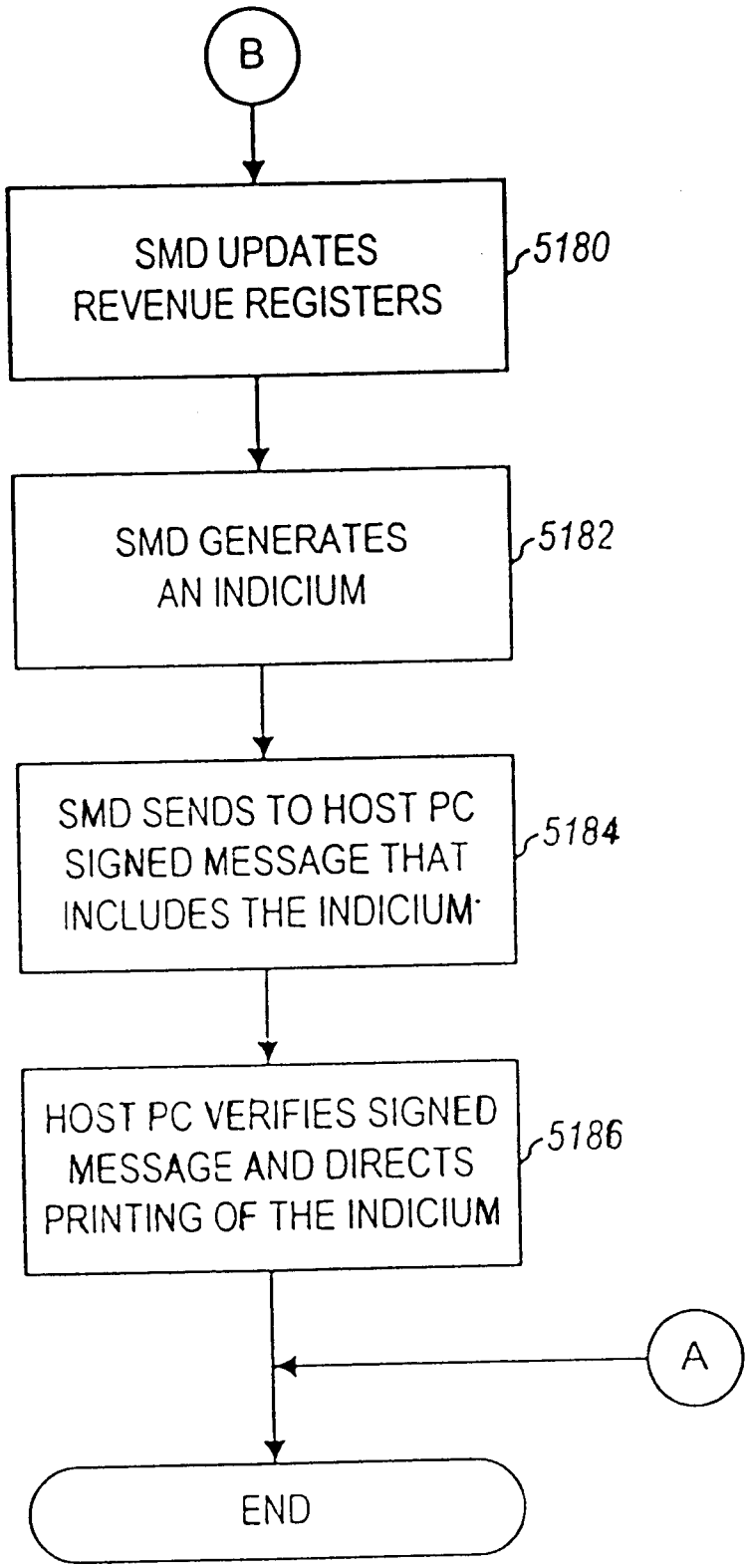

FIGS. 5E and 5E-2 show a flow diagram of an embodiment of the Indicium transaction with the SMD. At a step 5150, the user requests, via the host PC, printing of an indicium. The host PC can provide the user with information such as the funds available in the SMD, the rate tables, the address (e.g., zip code) information, and others. The user can enter mail parameters such as the class of mail, the zip-code information, and so on. Based on the information entered by the user and additional information (e.g., the mail weight information from a scale coupled to the serial port), the host PC determines the amount of postage for the indicium. Alternatively, the user can directly enter the postage amount.

The host PC sends the SMD an indicium request message that includes the requested indicium value, at a step 5152. In a specific implementation, this request message is not signed using the provider's private key, and anyone with access to the host PC can request printing of an indicium. However, safeguards can be included in the host PC software (i.e., through the use of a password) to prevent unauthorized printing of indicia.

The SMD receives and validates the request message, at a step 5154. The SMD accepts a request to perform an Indicium transaction if it is in an Initialized or Registered state. This determination is performed at a step 5156. If the SMD receives a request to perform an Indicium transaction and is not in the Initialized or Registered state, the SMD sends an error message, at a step 5158, and the transaction terminates.

Otherwise, the SMD determines whether the requested indicium value is within predetermined minimum and maximum limits, at a step 5160. If the requested indicium value is outside these limits, the SMD sends an error message, at a step 5162, and the transaction terminates. Otherwise, the SMD examines its revenue registers to determine whether sufficient funds exist to cover the requested indicium value, at a step 5164. If the funds are insufficient, the SMD sends an error message, at a step 5166, and the transaction terminates.

If sufficient funds exists, the SMD updates its revenue registers to account for the requested indicium value, at a step 5180, and generates the indicium, at a step 5182. The SMD then generates a message that includes the indicium, signs the message using the SMD's private key, and sends the signed message to the host PC, at a step 5184.

The host PC verifies the signed message and directs printing of the indicium, at a step 5186. The host PC may also update the display to reflect the current available funds. Also, if an error message is received during the Indicium transaction, the host PC displays the error message to inform the user (i.e., that insufficient funds exist).

Audit transaction: The SMD includes a timer (also referred to as a "Watchdog Timer") that allows it to perform services for a predetermined period of time. An Audit transaction is performed periodically to reset the timer, giving the SMD more time to operate before the timer times out. If the timer times out before an Audit transaction is performed, the SMD transitions to the Timed-Out operating state and no further operation (except for an Audit transaction) is permitted. The provider may also obtain the status of the SMD by initiating the Audit transaction. The following is a specific implementation of the Audit transaction, and other implementations are available.

Figure 5F:
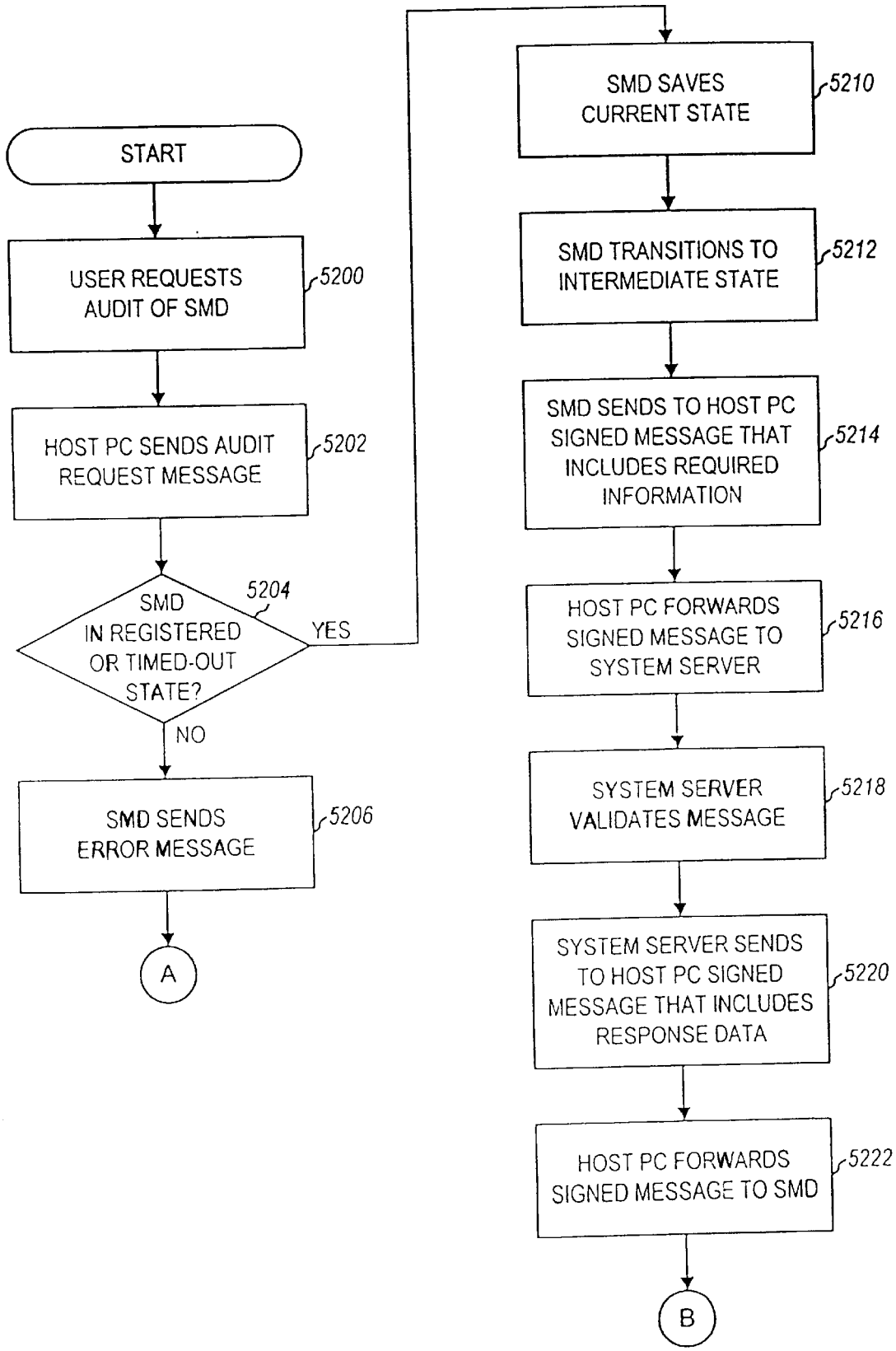
Figures 2, 5F:
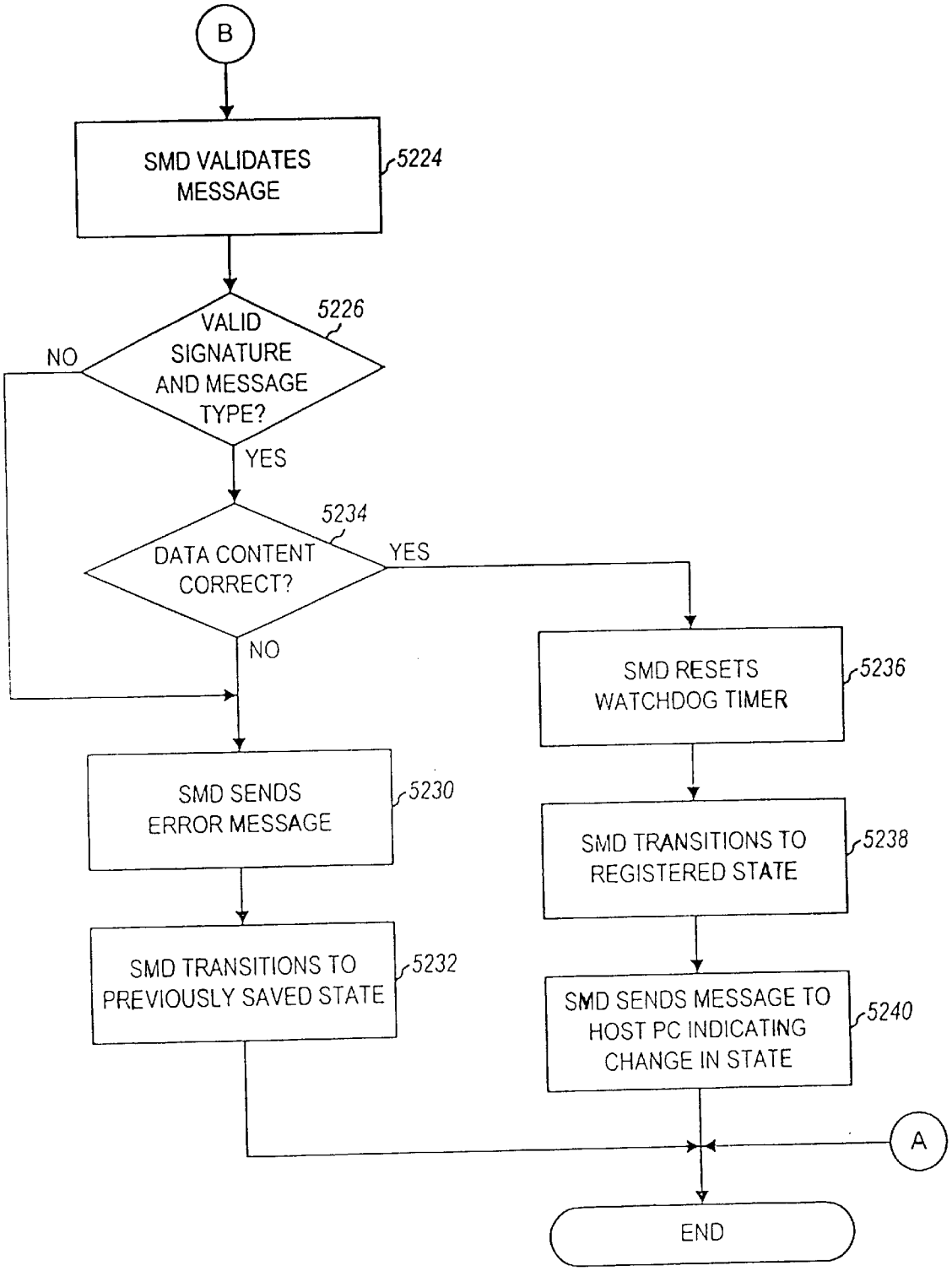

FIGS. 5F and 5F-2 show a flow diagram of an embodiment of the Audit transaction. At a step 5200, the user requests, via the host PC, an audit of the SMD. This may be motivated by the SMD transitioning into the Timed-Out state. In response, the host PC sends the SMD an audit request message, at a step 5202. In a specific implementation, this request message is not signed using the provider's private key, and anyone with access to the host PC can request an audit. However, safeguards can be included in the host PC software (i.e., through the use of a password) to prevent unauthorized audit requests.

The SMD accepts a request to perform an Audit transaction if it is in a Registered or Timed-Out state. This determination is performed at a step 5204. If the SMD receives a request to perform an Audit transaction and is not in the Registered or Timed-Out state, the SMD sends an error message, at a step 5206, and the transaction terminates.

Otherwise, the SMD saves its current operating state, at a step 5210, and transitions to an intermediate state, at a step 5212. The SMD then sends the host PC a signed message that includes the required information, at a step 5214. The required information may include, for example, the current contents of the secure revenue registers, the device ID number, the current date and time, a transaction serial number generated by the SMD, and other information. The host PC receives and forwards the signed message to the system server, at a step 5216.

The system server receives and validates the message, at a step 5218. As part of the processing, the system server authenticates the signed message using the SMD's public key and analyzes the data included in the message. The system server then sends the host PC a signed message that includes the response data, at a step 5220. This response data includes, for example, the same device ID and transaction number from the message received earlier.

The host PC receives and forwards this signed message to the SMD, at a step 5222. The SMD receives and validates the message, at a step 5224. The validation of the signed message includes verification of the signature and determination of whether the message is of the expected type, at a step 5226. If the signature is invalid or the message is not of the expected type, the SMD sends an error message, at a step 5230, and transitions back to the previously saved state, at a step 5232. The transaction then terminates.

Otherwise, if the signature is valid and the message is of an expected type, the SMD determines if the data contents of the message is correct, at a step 5234. This may include, for example, verification that transaction serial number in the received message is the same as the number forwarded by the SMD earlier. If the data is not valid, the SMD proceeds to step 5230 and sends an error message. Otherwise, if the data is valid, the SMD resets the Watchdog Timer, at a step 5236, and transitions to the Registered state, at a step 5238. The SMD then sends the host PC, at a step 5240, a confirmation message that indicates a successful Audit transaction. The host PC may update the display to inform the user of the amount of time remaining before the next audit transaction is required, or to inform the user that the SMD is now available for use (if it was in a Timed-Out state). The transaction then terminates.

Withdrawal transaction: Once the SMD has been authorized to a particular user's account, it functions on behalf of that account only. This means that when the SMD is funded, that customer's account at the provider is debited the amount of the funding (plus any associated service charges). If that SMD is to be reused on a different account, it is withdrawn from its present account and re-authorized for the new account. The following is a specific implementation of the Withdrawal transaction, and other implementations are available.

Figure 5G:
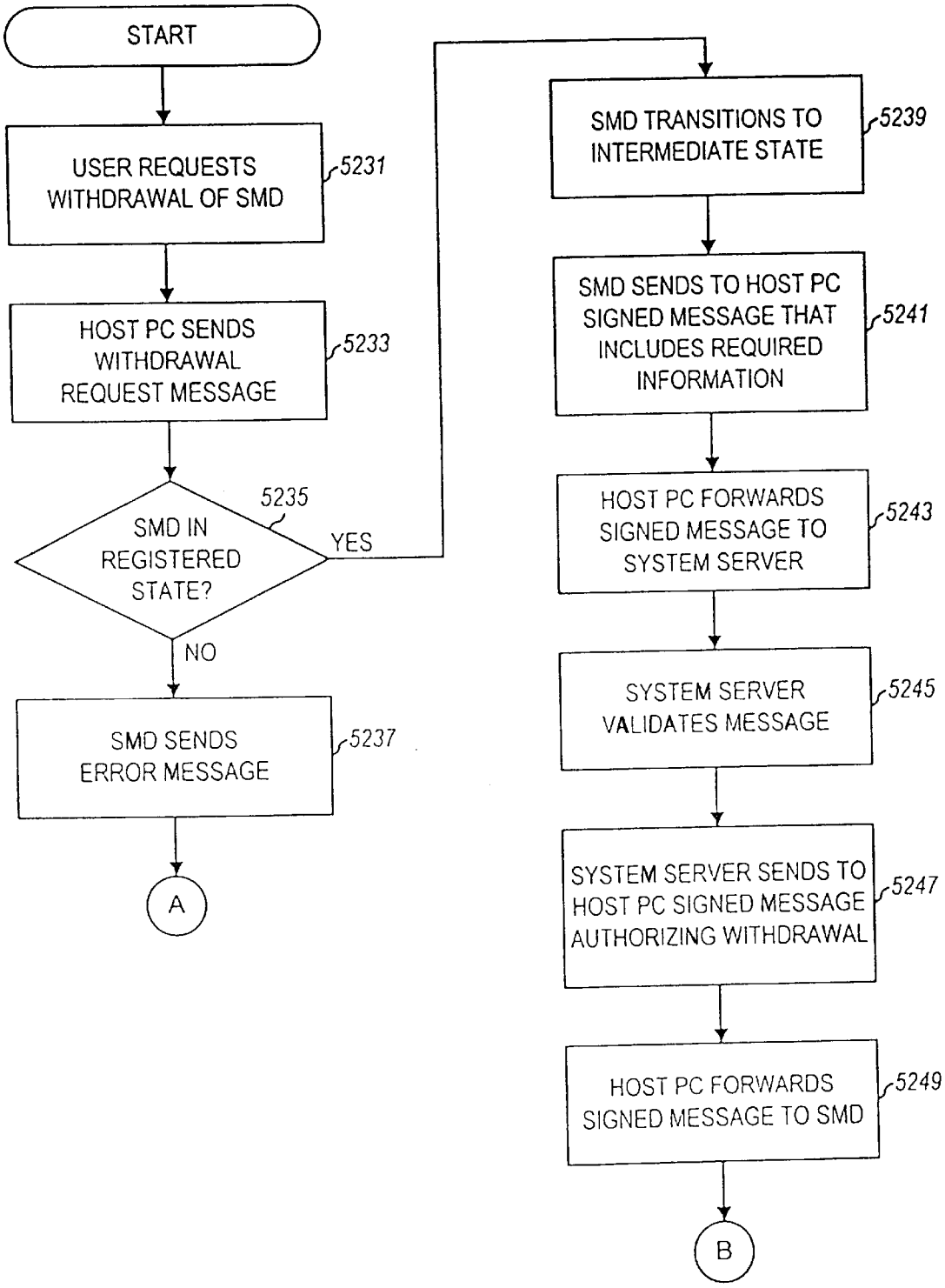
Figures 2, 5G:
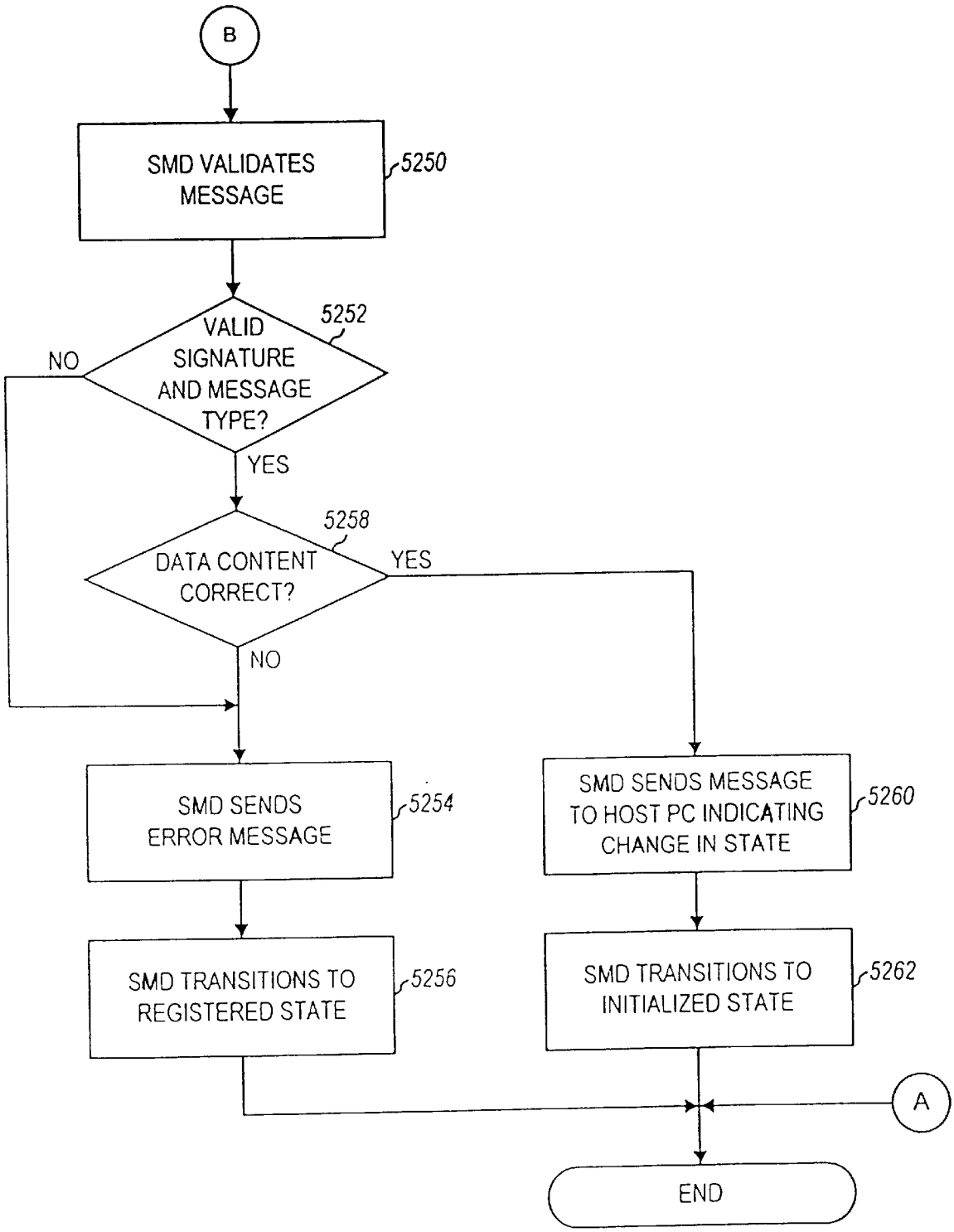

FIGS. 5G and 5G-2 show a flow diagram of an embodiment of the Withdrawal transaction. At a step 5231, the user requests, via the host PC, a withdrawal of the SMD. In response, the host PC sends the SMD a withdrawal request message, at a step 5233. In a specific implementation, this request message is not signed using the provider's private key, and anyone with access to the host PC can request a withdrawal. However, safeguards can be included in the host PC software (i.e., through the use of a password) to prevent unauthorized withdrawal of the SMD.

The SMD accepts a request to perform a Withdrawal transaction if it is in a Registered state. This determination is performed at a step 5235. If the SMD receives a request to perform a Withdrawal transaction and is not in the Registered state (i.e., if the inquiry at step 5235 is No), the SMD sends an error message, at a step 5237, and the transaction terminates.

Otherwise, the SMD transitions to an intermediate state, at a step 5239. The SMD then sends the host PC a signed message that includes the required information, at a step 5241. The required information may include, for example, the current contents of the secure revenue registers, the device ID number, a transaction serial number generated by the SMD, and other information. The host PC receives and forwards the signed message to the system server, at a step 5243.

The system server receives and validates the message, at a step 5245. As part of the processing, the system server authenticates the signed message using the SMD's public key and analyzes the data included in the message. The system server then sends the host PC a signed message that includes the response data, at a step 5247. This response data include, for example, the same device ID and transaction number from the message received earlier. This message authorizes the SMD to withdraw from service.

The host PC receives and forwards this signed message to the SMD, at a step 5249. The SMD receives and validates the message, at a step 5250. The validation of the signed message includes verification of the signature and determination of whether the message is of the expected type, at a step 5252. If the signature is invalid or the message is not of the expected type, the SMD sends an error message, at a step 5254, and transitions back to the previously saved state, at a step 5256. The transaction then terminates.

Otherwise, if the signature is valid and the message is of an expected type, the SMD determines if the data content of the message is correct, at a step 5258. This may include, for example, verification that transaction serial number in the received message is the same as the number forwarded by the SMD earlier. If the data is not valid, the SMD proceeds to step 5254 and sends an error message. Otherwise, if the data is valid, the SMD sends the host PC, at a step 5260, a message that indicates a change in operating state. The SMD then transitions to the Initialized state, at a step 5262. The host PC may update the display to inform the user that the SMD is no longer available for service.

For simplicity, for the transactions described in the above figures, the interactions between the SMD, host PC, and system server are conducted through the passing of a single message for each step. However, in actual implementations, multiple messages may be exchanged between these elements for a particular step.

Other transactions: Additional services can be obtained from the SMD in the user role. These services do not effect SRDIs and do not require role validation. They are obtained when an entity operating in the user role requests the service from the host PC. The host PC and SMD engage in a transaction that provides the requested service.

The Self Test transaction is initiated by the host PC, upon request by the user, by sending a SELF TEST message to the SMD. The SMD responds by performing its self tests and sending the results to the host PC in a SELF TEST RESPONSE message. The details of the self tests are described below. The Self Test transaction can be performed while the SMD is in any operating state. The Self Test transaction does not alter the contents of any of the SRDIs. In a specific implementation, the SELF TEST message allows one or more of the following tests to be selected:

CPU Self Test;

Volatile Memory Self Test;

Cryptographic Algorithm Test;

Firmware Test;

RTC Test;

Random Number Generator Tests; and

SRDI Signatures Test.

The Adjust RTC transaction allows the user to adjust the time of a real-time clock (RTC) to account for errors in the clock rate. The errors may accumulate over time, as well as due to changes to and from Daylight Savings Time, and so on. An Adjust RTC transaction may occur at any time. In a specific implementation, no more than a predetermined number of adjustments may be made during a predetermined time period (e.g., up to two adjustments in any single 30-day period).

The Get X.509 Certificate transaction allows the user to read the contents of any of the three (e.g., CA, provider, and SMD) X.509 certificates stored in the SMD's non-volatile memories.

The Enable, Disable, and Configure Auxiliary Serial Port transactions allow the user to connect the host PC to an external device via the SMD's auxiliary serial port.

SMD Security

The SMD operates in accordance with a predetermined set of security rules designed to discourage, prevent, and detect fraud. The rules are also designed to protect the contents of the SRDIs from fraud and component failure. In a specific implementation, the following rules apply to the SMD.

The SMD retains each of the SRDIs in a location in a non-volatile memory. Generally, the SRDIs defines the current operating state of the SMD, which is also referred to as the "State." Certain transactions as noted herein change the operating state of the SMD.

If the SMD detects an unauthorized change to any of the SRDIs, the SMD enters the Faulted state.

The SMD does not exit the Faulted state until an Inspection transaction is performed. The SMD does not perform any transaction, other than an Inspection transaction, which can alter any of the SRDIs while in the Faulted state.

The SMD initializes a Fraud counter to zero during an Audit transaction.

The SMD increments the Fraud counter each time a signature verification fails during a transaction. If the value in the Fraud counter exceeds a predetermined value (e.g., 50), the SMD enters the Faulted state.

In a specific implementation, the SMD accepts request messages from the host PC and provides response messages to the host PC via the main port only. This implementation provides additional security. The auxiliary port is used to transfer data between the host PC and external device(s) coupled to the auxiliary port. The SMD does not interpret the data streams received from, or sent to the auxiliary port. The SMD also does not output or receive the contents of any of the SRDIs via the auxiliary port.

CPU and Volatile Memory Self Tests: Each time the SMD is powered up, it performs a series of operations designed to test security and determine the current operating state. In a specific implementation, the following tests are performed each time the SMD is powered up: CPU and Volatile Memory Self Tests, Cryptographic Module Self Tests, and Basic Security Check. Greater, fewer, or different tests than those listed above can be performed by the SMD, and this is within the scope of the invention. The following describes a specific implementation for each of the tests, but it can be noted that other implementations can be achieved and are within the scope of the invention.

CPU and Volatile Memory Self Tests: The SMD performs the CPU and Volatile Memory Self Tests to determine if the basic facilities of the CPU and volatile memories are functional. A firmware performs the CPU and memory self tests each time the SMD is powered up. The CPU self test is performed before the memory self test is performed. The CPU and memory self tests are performed before other power-up self tests are performed.

Since the CPU is used to test itself, it may not be practical to determine if the CPU is in fact functional. However, it is possible to determine if the CPU is not functional in certain aspects. In one implementation, the firmware verifies that the CPU properly determines that two internally stored identical strings of length 128 bytes or greater are in fact identical. The firmware also verifies that the CPU properly determines that two internally stored non-identical strings of length 128 bytes or greater are in fact not identical. If either of these tests fails, the SMD enters the Faulted state.

The firmware performs a test of the volatile (e.g., RAM) memory devices accessible by the CPU. The test alternately writes and reads bit patterns to verify the integrity of each memory location. The patterns are designed ensure that all bits are capable of changing state, and that each memory location is capable of storing one and zero. If any of these tests fail, the SMD enters the Faulted state.

Cryptographic Module Self Tests: The SMD performs the Cryptographic Module Self Tests to verify the proper operation of the cryptographic module. In a specific implementation, the following self tests are performed each time the SMD powers up: Cryptographic Algorithm Test, Firmware Test, Critical Functions Test, and Statistical Random Number Generator Tests.

For the Cryptographic Algorithm Test, the SMD performs a "known-answer" test in which the cryptographic module generates a signature on an internally stored data field and compares the generated signature with a reference signature stored in memory. If the two signatures match, the test passes. If the signatures do not match, the test fails and the SMD enters the Faulted state.

For the Firmware Test, the SMD verifies the signature of the contents of the program memory. (EPROM, ROM, etc.). If the signature is invalid, the SMD enters the Faulted state.

For the Critical Functions Test, the SMD verifies the proper operation of the Real Time Clock (RTC) by comparing its rate against a predetermined independent standard. Such a test employs a firmware loop having an execution time that is known a priori and is based on, for example, the CPU's crystal frequency. The loop may be executed a predetermined number of times, and the RTC may be checked before and after executing the loop to determine if the RTC has advanced the expected amount. If the RTC is not accurate within a predetermined range (e.g., ±0.05%, or approximately 4.5 hours/year), the SMD enters the Faulted state.

The Statistical Random Number Generator Tests may be made available as part of the support firmware provided with the cryptographic module. In this case, SMD executes these tests upon power up, and if any such tests fail, the SMD enters the Faulted state.

Basic Security Check: Upon power up and after performing the CPU, memory, and cryptographic self tests, the SMD perform the Basic Security Check to determine if the contents of the non-volatile memories are valid. The Basic Security Check includes a series of tests. First, the SMD checks the signature on the SRDIs stored in non-volatile memory that is external to the cryptographic module. If any signatures do not verify, the SMD enters the Faulted state. The SMD also checks the CRC or checksum on the SRDIs stored in non-volatile memory that is located inside the cryptographic module. If the CRC or checksum does not verify, the SMD enters the Faulted state.

Digital Signature: In a specific implementation, the SMD employs the digital signature algorithm (DSA) to sign all messages that include SRDIs to be reported to external devices. Such messages are signed using the SMD's private key. The SMD also employs DSA to verify signature on all messages that include SRDIs to be written to the SMD's non-volatile memories.

The SMD's private key is generated during factory initialization, stored inside the cryptographic module, and is not accessible by any means without leaving evidence of tampering. During factory initialization, when the SMD generates a public/private key pair, the SMD tests the key pair using a pair-wise consistency test. This test is defined in section 4.11.2 of a document entitled "Security Requirements for Cryptographic Modules, Federal Information Processing Standards Publication 140-1" (also referred to as FIPS 140-1). If the keys fail the test, a new set of keys is generated and tested. If after a predetermined number of (e.g., three) successive sets of keys are generated and failed the test, the SMD aborts the key generation function and informs the FIT of the error. The SMD's private key is not made available via any communications port or by any other means.

In a specific implementation, the SMD does not sign (using the SMD's private key) externally generated data received via either the main or auxiliary port, unless that data was received in a valid transaction under signature from the provider's and only after the SMD has verified the signature using its internally stored version of the provider public key. This implementation of inhibiting the SMD from signing externally generated data prevents an entity from sending a "phony" indicium to the SMD, getting the SMD to sign and return it, and printing that indicium, thereby defrauding the provider in a manner that may be difficult to detect or prove.

In an embodiment, each time the cryptographic module uses the random number generator to generate a digital signature, the cryptographic module performs the continuous random number generator test as specified in the above-referenced FIPS 140-1, section 4.11.2.

Security Relevant Data Items: In accordance with an aspect of the invention, security relevant data items (SRDIs) are maintained within the SMD's tamper-evident enclosure. The SRDIs include revenue registers and other registers. The revenue registers refer to data items (stored in the SMD's memories) that are required to determine the amount of revenue remaining in the SMD. These items include, for example, the Ascending and Descending registers, the Fault Code, the Fraud counter, and the SMD operating state.

In a specific implementation, at least two copies of the revenue registers are stored inside the SMD's tamper-evident enclosure. The storage redundancy allows for recovery of at least one set of revenue registers should the other set be damaged by component failure, power failure, fraud, or tampering.

In an embodiment, each copy of the revenue registers is stored in a different physical memory device from the other copy, and uses a different power source if power is used to maintain such memory. One such copy may be stored inside the cryptographic module, if such module includes sufficient non-volatile memories. The values saved in this module can be retrieved by requesting a Status transaction. The Status transaction data is signed using the SMD's private key, and the signature is included with the data delivered in the transaction. The Status transaction is available in all operating states, including the Faulted state.

In a specific implementation, the cryptographic module comprises a single chip CPU/Cryptographic Processor that includes an on-chip battery backed-up RAM memory (BBRAM) that stores one copy of the revenue registers. The device that stores the second copy of the revenue registers can be a Flash memory device located inside or outside the cryptographic module. This memory can be coupled to the cryptographic module via a microcomputer bus. In such a configuration, the factory is able to read the revenue registers and signature by using a specially designed test device that clips onto the leads of the Flash component and reads it directly.

If a copy of the revenue registers is stored inside the cryptographic module, several effective means are available for the SMD to verify the integrity of the registers before they are used. One such means is the use of a digital signature. An alternative means is the use of a (e.g., 16-bit) CRC or checksum, which is a faster mechanism and may be adequate since the copy of the revenue data is stored in the cryptographic module itself and risks of tampering are reduced. The SMD periodically checks the checksum or CRC of the revenue registers stored inside the cryptographic module. This check is performed on power-up, before accepting a request to perform an Indicium or Funding transaction, and periodically within a predetermined time period (e.g., at least once per hour) while power is applied and no transactions have been requested. If the checksum or CRC is found to be invalid, the SMD enters the Faulted state, unless the FIT flag is installed in which case the SMD enters the Uninitialized state.

The copies of the revenue registers can also be stored in devices located outside the cryptographic module. In a specific implementation, each copy of the revenue registers stored in a device outside the cryptographic module is stored "in the clear" and signed using the SMD's private key. The signature is also stored in the same device that stores the revenue registers. Each memory device outside the cryptographic module that stores revenue registers is readable by an external means at the factory, after removing the tamper-evident enclosure. The SMD periodically checks the signature on the revenue registers stored external to the cryptographic module. This check is performed on power-up, after each Indicium or Funding transaction, and periodically within a predetermined time period (e.g., at least once per hour) while power is applied and no transactions have been requested. If the signature is found to be invalid, the SMD enters the Faulted state.

The SMD maintains an SRDI called a real time clock (RTC), from which it obtains the current date and time for inclusion in messages and for other functions. The RTC is initialized while the SMD is in the Initialized state with the FIT flag installed. Under these circumstances, any value may be written to the RTC. The RTC may be changed by a command from the user to correct for accumulated clock error, daylight savings time, and so on. The RTC may be changed up to a predetermined amount (e.g., no more than ±5 hours) and up to a predetermined number of time (e.g., no more than three times) per audit period.

The SMD maintains a date, stored in non-volatile memory, called the Watchdog Timer. The use of the Watchdog Timer forces the user to request periodic audits of the SMD. The audits allow the provider to monitor the status of the SMD's revenue registers and determine if any attempt to defraud the SMD has occurred. The time between audits is set during the Registration transaction, and is stored in the SMD's non-volatile memory.

The Watchdog Timer is an SRDI that is initialized during the Registration transaction. The SMD checks the RTC each time it powers up, and one or more times per day during normal operation, to determine if the RTC has counted past the Watchdog Timer. If the RTC contains a date that is greater than that of the Watchdog Timer, the SMD transitions to a Timed-Out state and does not perform any transaction (except for an Audit transaction) that can change any of the SRDIs. The SMD also includes, in non-volatile memory, an SRDI called a Watchdog Increment that contains the number of days to be added to the Watchdog Timer after a successful Audit transaction.

The SMD remains in the Timed-Out state until receipt of a Device Audit field as specified in the document entitled "Information Based Indicia Program, Postal Security Device Specification," USPS Engineering Center. The SMD verifies the signature on the Device Audit field using the provider's public key included in the Provider X.509 certificate that is loaded during factory initialization. Upon verification of the signature, the SMD adds a constant to the Watchdog Timer and transitions out of the Timed-Out state. The SMD is then able to perform transactions that affect the revenue registers. The value that is added to the timer is obtained from the Watchdog Increment stored in the SMD memory during the Registration transaction.

Exhibit E lists the various SRDIs and their description, definition, and structure. This reflects a specific implementation of the SRDIs for the SMD. Exhibit E also tabulates the transactions used to access the various SRDIs.

Messages and Transactions

As used herein, a message is a basic unit of Application Level data exchanged between the SMD, host PC, and system server. Messages are communicated using a reliable transport mechanism that transmits and receives messages on (e.g., asynchronous serial) communications channels. One such transport mechanism is an asynchronous data-link protocol disclosed in the aforementioned U.S. Patent provisional Application Serial No. 60/075,934. In an embodiment, a message includes a field for identifying a Message Type code followed by a field of zero or more bytes of Message Data (i.e., 0 to N bytes of 8-bit data). In a specific implementation, when the Message Data field includes a data item having more than one byte, the data item is sent with the most significant byte first, followed by successively less significant bytes.

In an embodiment, messages are typically exchanged in a group that makes up a transaction. A transaction may cause the SMD to print indicia, increase the amount of the stored revenue, report status, withdraw from service, and so on. The host PC typically initiates a transaction, and does so by sending a request message to the SMD. The SMD replies with a response message.

While the host typically initiates transactions, the SMD may send unsolicited status and error messages to the host PC. For example, the SMD may send a STATECHG or ERROR message, or both, based on conditions detected by the SMD. This may occur, for example, when a security threat is detected by the SMD and the SMD transitions to the Faulted state, or when the SMD's internal Watchdog Timer times out and the SMD transitions to the Timed-Out state.

As can be seen from FIG. 6A, various transactions are performed to transition between, and within the operating states. Some of these transactions are described below using state diagrams. Each state diagram shows a particular transaction between the operating states shown in FIG. 6A, and may be substituted into FIG. 6A in place of a corresponding transaction arrow.

In the following state diagrams, a transition between operating states occurs upon receipt of a message from the host PC. The solid lines represent these transitions. For many such transitions, a response message is sent by the SMD to the host PC. The response message is shown by a dotted line leaving a circle attached to the solid transition line, with an arrow terminating the dotted line in space.

The following state diagrams describe which transition to take when a message is processed "properly" or processed "erroneously." In an embodiment, a message is processed properly if the message was received in an appropriate state, and all signatures, transaction ID numbers, or other checks were performed without error and as expected. A message is deemed to have been processed erroneously if the message was received in an inappropriate state, or the signatures, transaction ID numbers, or other checks were in error or not as expected. Where ambiguities arise, the description for the message (see Exhibit A) specifies which result constitutes proper processing and which result constitutes erroneous processing.

In a specific implementation, transactions are performed in accordance with following set of rules:

1) The SMD only process messages that are appropriate for its current operating state. Exhibit C lists messages that are appropriate for each operating state.
2) If the host PC sends the SMD a message that is inappropriate for the SMD's current operating state, the SMD ignores (not process) the message and responds by sending to the host PC an ERROR message that includes an error code of BAD_STATE. For example, the SMD does not process a message to print an indicium when it is in the Uninitialized state.
3) If the SMD is in the Faulted state, it does not process any messages that would alter any of the SRDIs, or would cause a state change to a state that may process messages that could alter any of the SRDIs.
4) If power is removed from the SMD after a transaction begins but before it is complete, the transaction is canceled. When power is reapplied, the SMD returns to the operating state it previously occupied before the transaction began.

The following FIGS. 6B–6G describes specific implementations of the Initialization transaction, the Registration transaction, the Funding transaction, the Indicium transaction, the Audit transaction, and the Withdrawal transaction, respectively. In these figures, only the communication between the SMD and the host PC is described, for clarity. The interactions between the SMD, host PC, and system server for these transactions are described above in reference to FIGS. 5B, 5C, 5C-2, 5D, 5D-2, 5E, 5E-2, 5F, 5F-2, 5G, and 5G-2. Moreover, the descriptions of the messages passed between the SMD and host PC (given in Exhibits A and B) also provide additional details of these transactions.

Figure 6B:
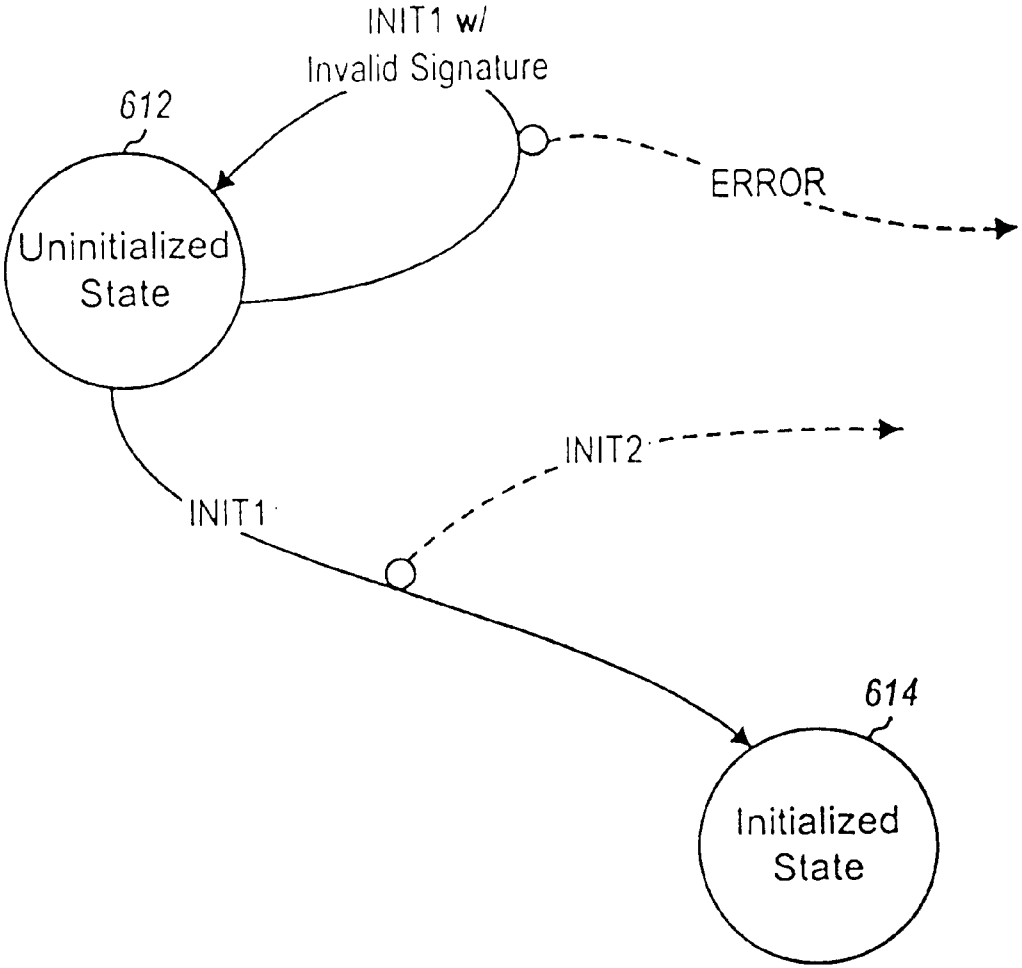
FIGS. 6B through 6G show state diagrams of a specific implementation of the Initialization, Registration, Funding, Indicium, Audit, and Withdrawal transactions, respectively.

FIG. 6B shows a state diagram of a specific implementation of the Initialization transaction. An SMD in the Uninitialized state performs the Initialization transaction to initialize the SMD. In an embodiment, the Initialization transaction causes the SMD to generate a pair of public and private keys. The SMD retains the private key in secrecy, and exports the public key to the host PC.

The Initialization transaction begins when the host PC sends an INIT1 message to the SMD. The SMD only accepts the INIT1 message while in the Uninitialized state. Otherwise, the SMD remains in the Uninitialized state and replies to the INIT1 message with an ERROR message that includes an error code or BAD_STATE. The SMD processes the INIT1 message according to the directions included in the message's description. This processing includes verification of the signature of the INIT1 message. Upon successful completion of that processing, the SMD generates an INIT2 message that includes the public key and sends the message to the host PC. The SMD then transitions to the Initialized state.

Figure 6C:
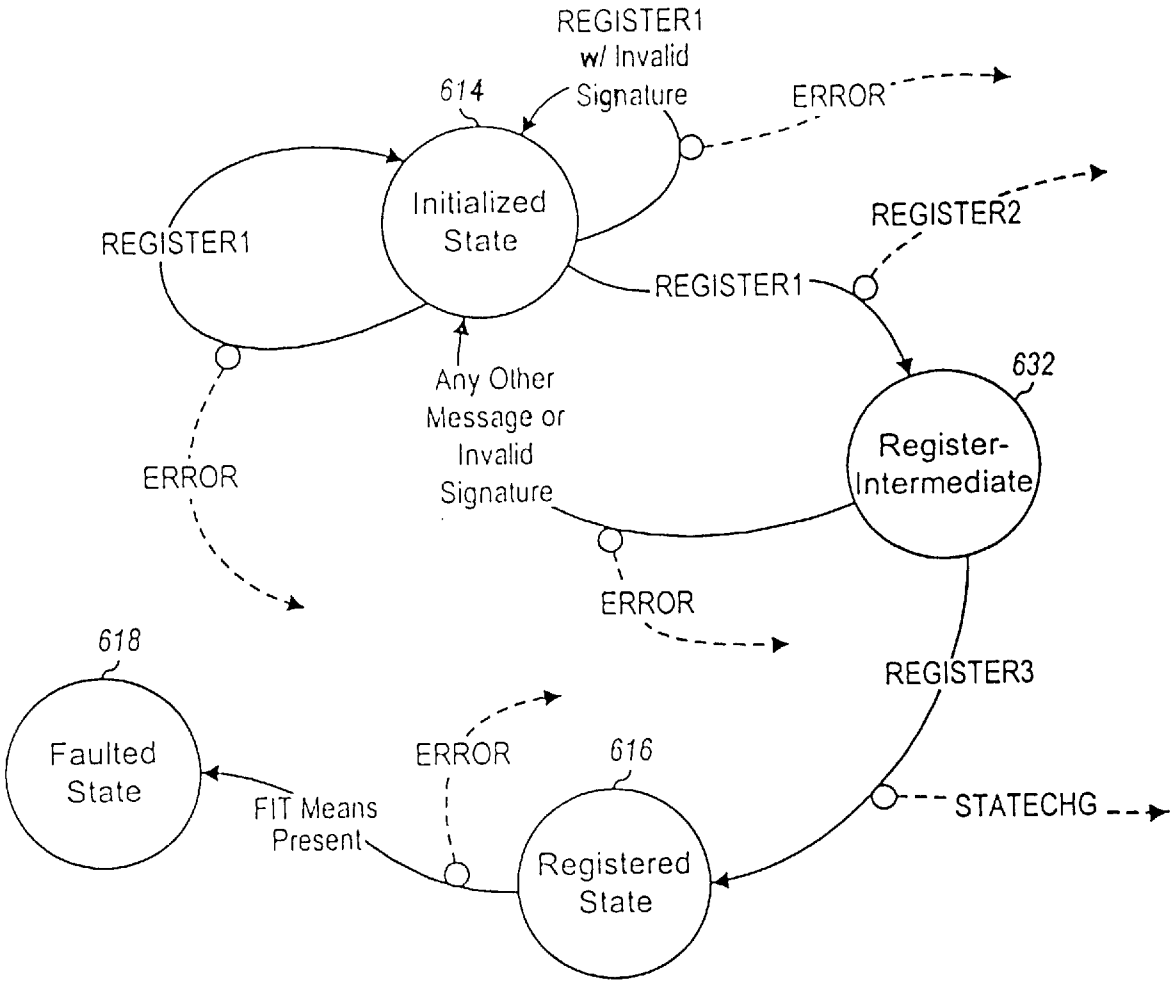

FIG. 6C shows a state diagram of a specific embodiment of the Registration transaction. In an embodiment, an Initialized SMD is not licensed to any user and cannot generate indicia. Registration is the process of licensing the SMD to a particular user and installing the SMD at the user's site. In an embodiment, only an Initialized SMD may be registered.

The Registration transaction begins when the host PC sends a REGISTER1 message to the SMD. The SMD only accepts the REGISTER1 message while in the Initialized or Registered state. Otherwise, the SMD does not change state and replies to the REGISTER1 message with an ERROR message that includes an error code of BAD_STATE; and the Registration transaction terminates.

If the SMD receives the REGISTER1 message while in the Initialized or Registered state, it processes the REGISTER1 message according to the directions included in the message's description. This processing includes verification of the signature of the REGISTER1 message. If the REGISTER1 message is processed without error, the SMD generates a REGISTER2 message, sends it to the host PC, and transitions to an Register-Intermediate state 632. Otherwise, if an error occurs during the processing of the REGISTER1 message, the SMD does not change state and sends the host PC an error reply according to the directions included in the message's description. The error reply includes an error number that the host PC converts to an error message to be displayed.

If the SMD is in the Registered-Intermediate state and a REGISTER3 message is received, the SMD processes the message according to the directions included in the message's description. If the message is processed without error, the SMD generates a STATECHG message, sends this message to the host PC, and transitions to the Registered state. Otherwise, if an error occurred during processing of the REGISTER3 message, the SMD transitions to the state it occupied before the start of the Registration transaction and sends the host PC an error reply according to the directions included in the message's description. If the SMD is in the Registered-Intermediate state and any message other than a REGISTER3 message is received, the SMD transitions to the state it occupied before the start of the Registration transaction and sends the host PC an ERROR message that includes an error code of MSG_INVALID.

The Registration transaction terminates when the SMD transitions to the Registered state (upon sending the STATECHG message). The Registration transaction also terminates when the SMD sends the host PC an error reply in response to an error during processing of the REGISTER1 or REGISTER3 message.

Figure 6D:
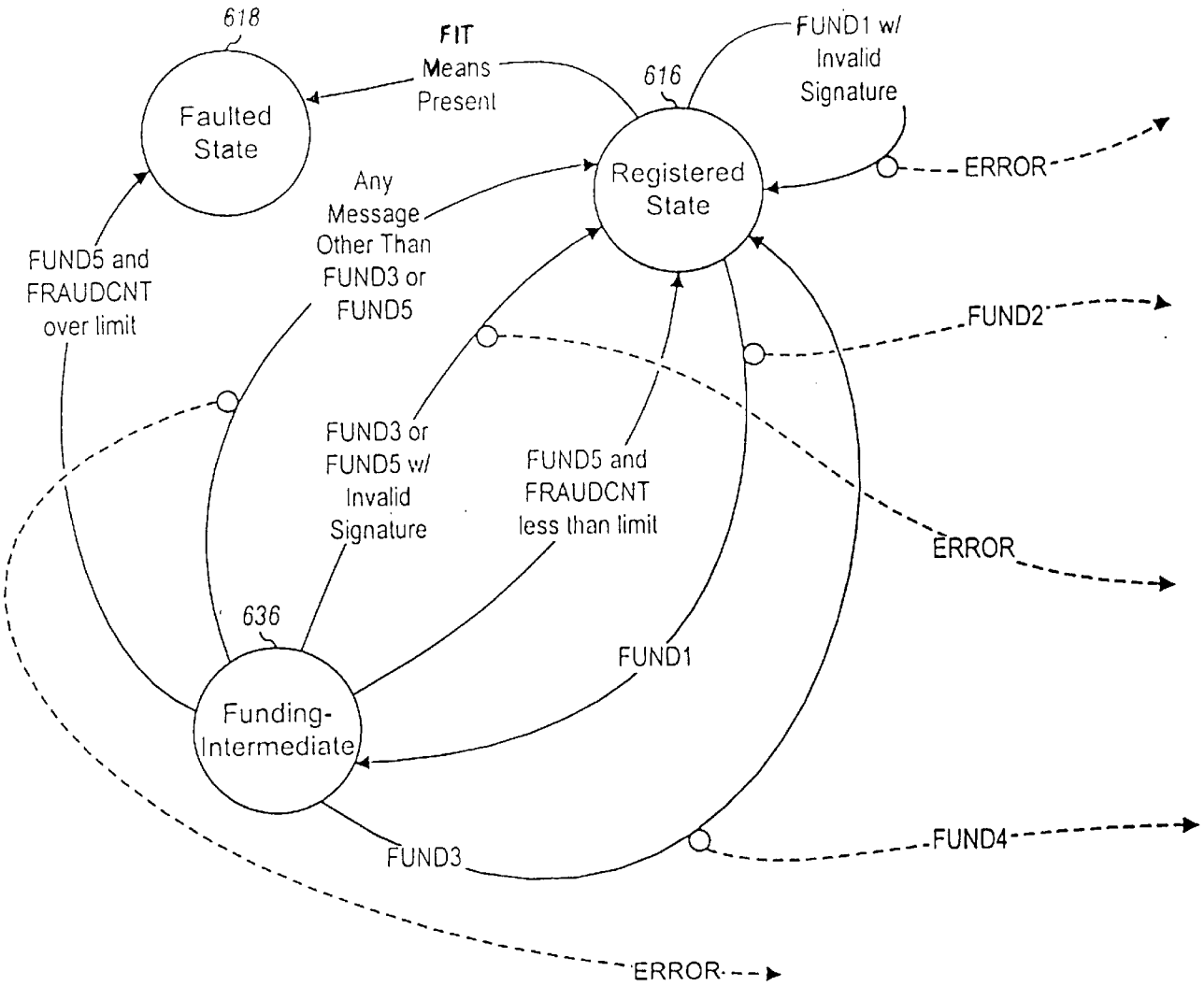

FIG. 6D shows a state diagram of a specific embodiment of the Funding transaction. A Registered SMD is not able to dispense indicia unless the revenue registers contain adequate revenue. The Funding transaction is performed to fund the SMD, and may be initiated when the user decides to add additional funds. The host PC may also query the user to initiate the Funding transaction, for example, when it is determined that the SMD revenue has fallen below a predetermined threshold.

The Funding transaction begins when the host PC sends a FUND1 message to the SMD. In an embodiment, the SMD only accepts a FUND1 message while in the Registered state. Otherwise, the SMD does not change state and replies to the FUND1 message with an ERROR message that includes the BAD_STATE error code; and the Funding transaction terminates.

If the SMD receives a FUND1 message while in the Registered state, it processes the FUND1 message according to the directions included in the message's description. This processing includes verification of the signature of the FUND1 message. If the FUND 1 message is processed without error, the SMD generates a FUND2 message, sends it to the host PC, and transitions to a Funding-Intermediate state 636. Otherwise, if an error occurs during processing of the FUND1 message, the SMD does not change state and sends the host PC an error reply according to the directions included in the message's description.

If the SMD is in the Funding-Intermediate state and a FUND3 message is received, the SMD processes the message according to the directions included in the message's description. This processing includes verification of the signature of the FUND3 message. If the message is processed without error, the SMD generates a FUND4 message, sends this message to the host PC, and transitions to the Registered state. Otherwise, if an error occurred during processing of the FUND3 message, the SMD transitions to the state it occupied before the start of the Funding transaction and sends the host PC an error reply according to the directions included in the message's description.

If the SMD is in the Funding-Intermediate state and a FUND5 message is received, the SMD processes the message according to the directions included in the message's description. If the message is processed without error, the SMD generates a STATECHG message, sends this message to the host PC, and transitions to the Registered state. Otherwise, if an error occurred during processing of the FUND5 message, the SMD transitions to the Registered state and sends the host PC an error reply according to the directions included in the message's description.

If the SMD is in the Funding-Intermediate state, one of several possible events can occur. If any message other than a FUND3 or FUND5 message is received, the SMD transitions to the Registered state and sends the host PC n ERROR message that includes an error code of MSG_INVALID. Also, if a FUND3 or FUND5 message is received with an invalid signature, the SMD transitions to the Registered state and sends the host an ERROR message that includes an error code of SIG_INVALID. If a FUND5 message is received and the Fraud counter in the SMD exceeds a predetermined limit, the SMD transitions to the Faulted state.

The Funding transaction terminates when the SMD sends the FUND4 or STATECHG message in response to a successful Funding transaction. The Funding transaction also terminates when the SMD sends the host PC an ERROR message in response to (1) an error occurred during processing of the FUND1, FUND3, or FUND5 message, or (2) receiving messages other than the FUND3 or FUND5 message while in the Funding-Intermediate state.

Figure 6E:
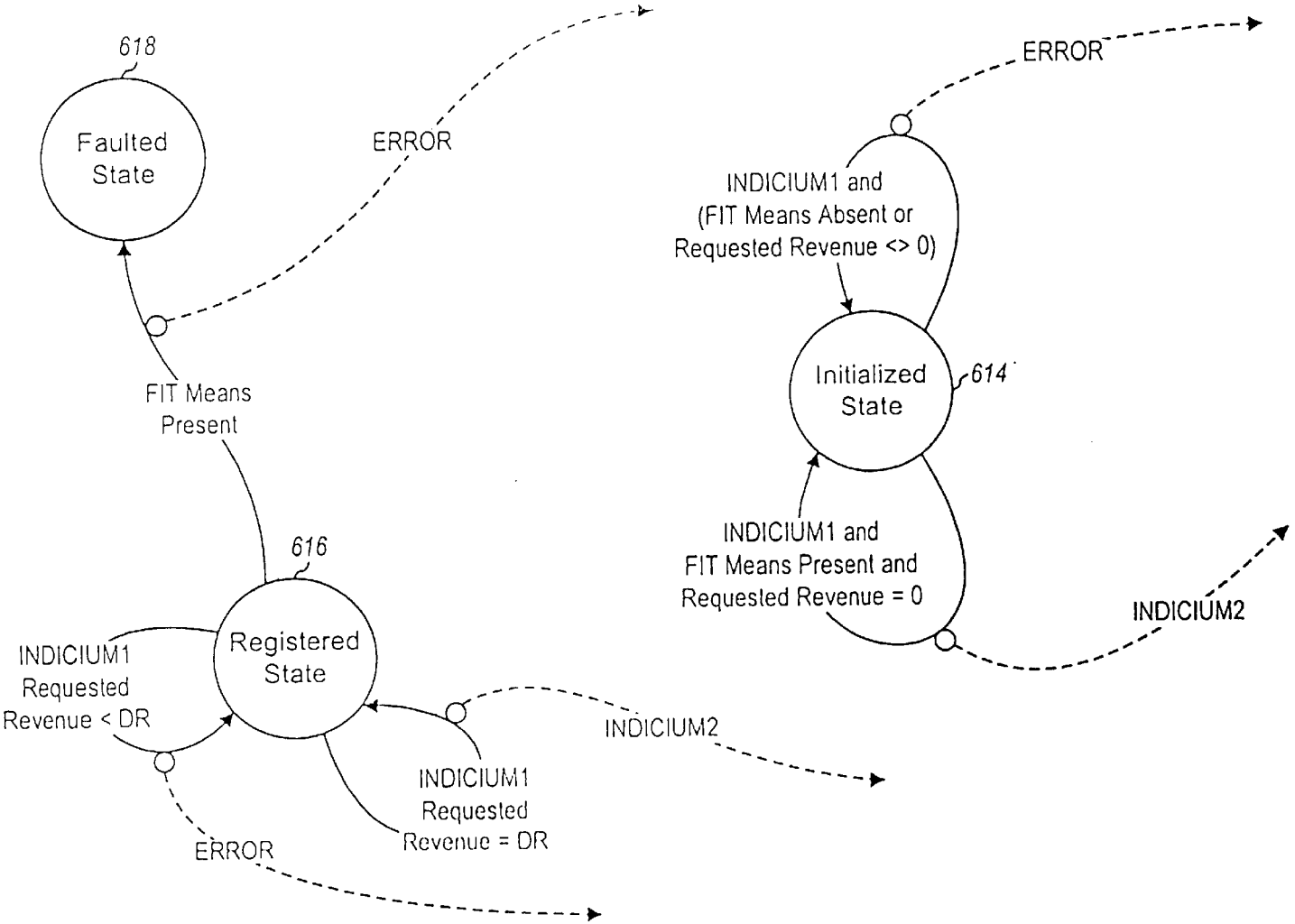

FIG. 6E shows a state diagram of a specific embodiment of the Indicium transaction. The SMD dispenses an indicium to the host PC for the Indicium transaction. The Indicium transaction begins when the host PC sends an INDICIUM1 message to the SMD. The SMD only accepts the INDICIUM1 message while in the Initialized or Registered state. Otherwise, the SMD does not change state and replies to the INDICIUM1 message with an ERROR message that includes an error code of BAD_STATE; and the Indicium transaction terminates.

If the SMD receives the INDICIUM1 message while in the Registered or Initialized state, it processes the INDICIUM1 message according to the directions included in the message's description. If the INDICIUM1 message is processed without error, the SMD generates an INDICIUM2 message and sends it to the host PC. Otherwise, if an error occurs during processing of the INDICIUM1 message, the SMD sends the host PC an error message according to the directions included in the message's description. In either case, the SMD does not change state and the Indicium transaction terminates.

In an embodiment, the Audit transaction is performed periodically, either manually by the user or automatically with each Funding transaction, or both. If the user does not initiate a Funding transaction or an Audit transaction is not performed within the time-out period, the SMD times out and initiates a lock sequence that prevents further indicium printing. In a specific implementation, the time-out period is 90 days, although other time periods can be used and are within the scope of the invention.

Figure 6F:
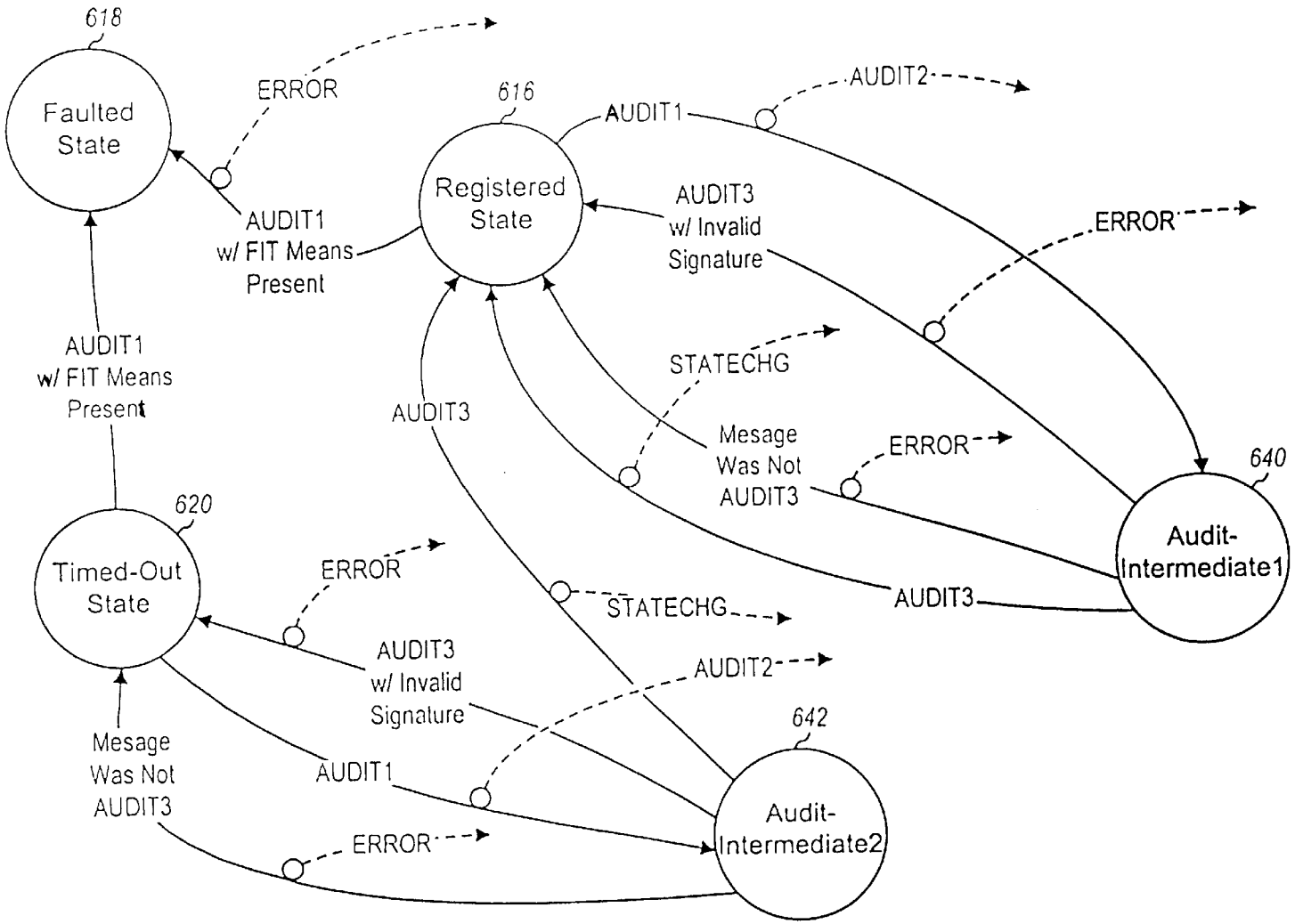

FIG. 6F shows a state diagram of a specific embodiment of the Audit transaction. The Audit transaction is used to inform the system server the current operating state of the SMD. The Audit transaction begins when the host PC sends an AUDIT1 message to the SMD. The SMD only accepts the AUDIT1 message while in the Registered or Timed-Out state. Otherwise, the SMD does not change state and replies to the AUDIT1 message with an ERROR message that includes an error code of BAD_STATE; and the Audit transaction terminates.

If the SMD receives the AUDIT1 message while in the Registered or Timed-Out state, it processes the AUDIT1 message according to the directions included in the message's description. If the AUDIT1 message is processed without error, the SMD generates an AUDIT2 message and sends it to the host PC. The SMD then transitions to an Audit-Intermediate1 state 640 if the AUDIT1 message was received while in the Registered state, or to an Audit-Intermediate2 state 642 if the AUDIT1 message was received while in the Time-Out state. Otherwise, if an error occurs during processing of the AUDIT1 message, the SMD does not change state and sends the host PC an error message according to the directions included in the message's description.

If the SMD is in either Audit-Intermediate state and any message other than an AUDIT3 message is received, the SMD transitions to the state it occupied before the start of the Audit transaction and sends the host PC an ERROR message that includes n error code of MSG_INVALID. If the SMD receives an AUDIT3 message while in either Audit-Intermediate state, the SMD processes the message according to the directions included in the message's description. If the message is processed without error, the SMD generates a STATECHG message, sends this message to the host PC, and transitions to the Registered state. Otherwise, if an error occurred during processing of the AUDIT3 message, the SMD transitions to the state it occupied before the start of the Audit transaction and sends the host PC an error reply according to the directions included in the message's description.

The Audit transaction terminates when the SMD sends the STATECHG message in response to a successful Audit transaction. The Audit transaction also terminates when the SMD sends the host PC an ERROR message in response to an error during processing of the AUDIT1 or AUDIT3 message.

Figure 6G:
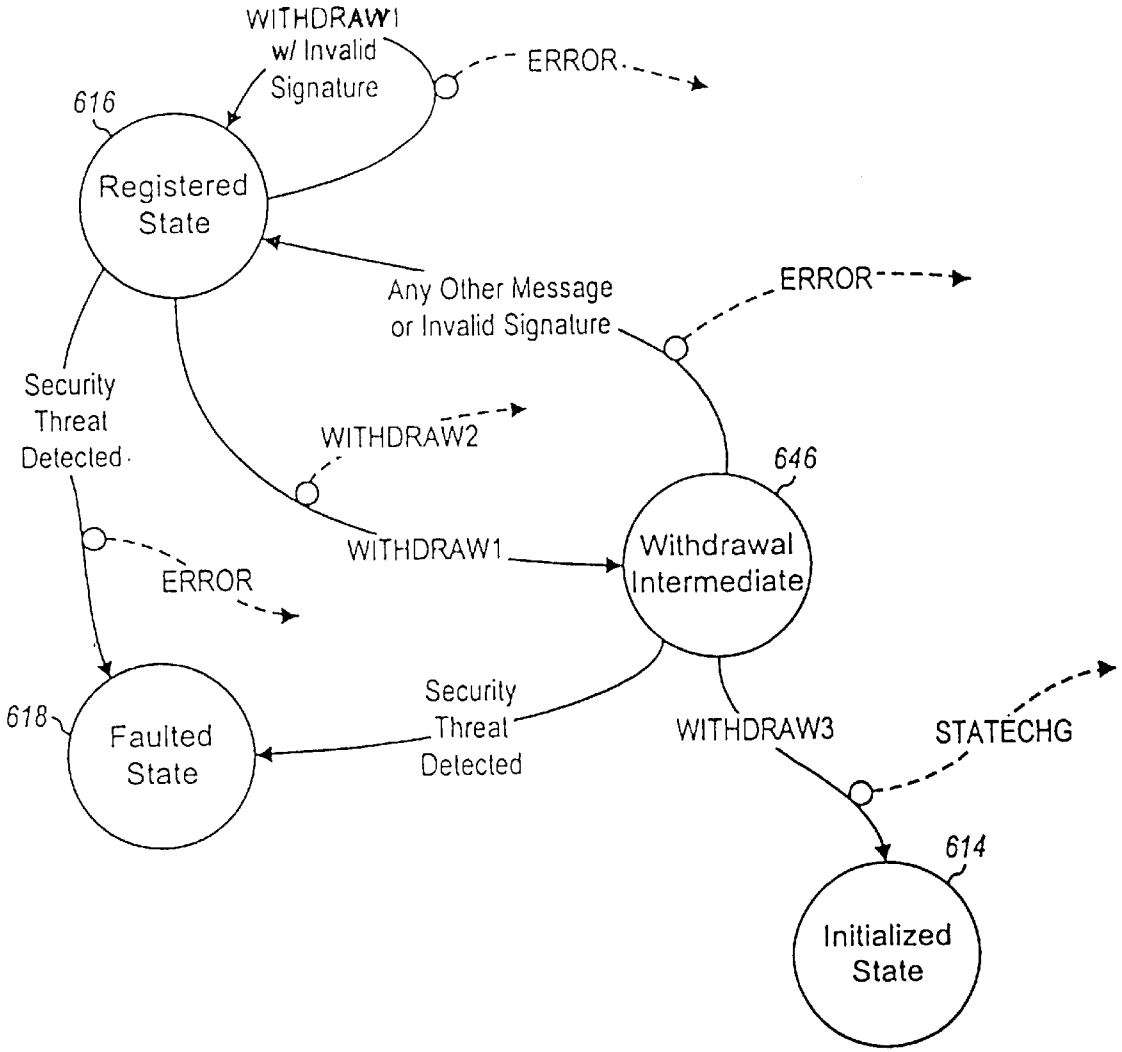

FIG. 6G shows a state diagram of a specific embodiment of the Withdrawal transaction. The Withdrawal transaction is used to remove a Registered SMD from service. The Withdrawal transaction begins when the host PC sends a WITHDRAW1 message to the SMD. Upon receipt of this message, the SMD checks its internal state counter to verify that it is in the Registered state. If it is not in the Registered state, the SMD does not change state and sends the host PC an ERROR message that includes an error code of BAD_STATE; and the Withdrawal transaction terminates.

If the SMD receives the WITHDRAW1 message while in the Registered, it processes the WITHDRAW1 message according to the directions included in the message's description. If the WITHDRAW1 message is processed without error, the SMD generates a WITHDRAW2 message and sends it to the host PC. The SMD then transitions to a Withdrawal-Intermediate state 646. Otherwise, if an error occurs during processing of the WITHDRAW1 message, the SMD does not change state and sends the host PC an error message according to the directions included in the message's description.

If the SMD receives a WITHDRAW3 message while in the Withdrawal-Intermediate state, the SMD processes the message according to the directions included in the message's description. If the message is processed without error, the SMD generates a STATECHG message, sends this message to the host PC, and transitions to the Initialized state. Otherwise, if an error occurred during processing of the WITHDRAW3 message, the SMD transitions to the Registered state and sends the host PC an ERROR message.

The Withdrawal transaction terminates when the SMD sends the STATECHG message in response to a successful Withdrawal transaction. The Withdrawal transaction also terminates when the SMD sends the host PC an ERROR message in response to an error during processing of the WITHDRAW1 or WITHDRAW3 message.

Message Definition and Structure

In an embodiment, each application level message includes an 8-bit Message Type code followed by a message body. The Message Type code identifies each message to the recipient. The message body includes data as required by the SMD or host PC to process the message. The length of the message body depends on the particular message. The overall message length stated in the message descriptions includes the length of the message type code and the message body. It is the total length of the "variable length Application Level packet" that is sent by the transmission level protocol.

The following describes a specific implementation. All byte addresses within a message are relative to the beginning address of the message. For example, the first byte of the message is address 0×0000, the next byte is 0×0001 and so on. Unless otherwise indicated, all message fields are transmitted with the more significant digits in the lower relative byte addresses. Successively lower significant digits are transmitted in increasing relative byte addresses. BCD (binary coded decimal) encoded data contains the high order digit in the high order nibble of a byte, and the next lower order digit in the low order nibble of the byte. Leading zeros are used to pad a BCD field to the size indicated. For example, the BCD encoded number 12345 is transmitted in 3 bytes as follows: 0×01, 0×23, 0×45. Also, unless otherwise specified, fields containing alphanumeric data are transmitted with the left most character in the string appearing in the lowest relative byte address, and with successive characters to the right in successively increasing relative addresses.

The ability of the SMD to process a particular message depends on the current state of the SMD. The allowable states for each message are given in Exhibit C. If a message is received while the SMD is in an operating state that is inappropriate for processing the message, the SMD responds by sending the host PC an ERROR message that includes an error code of BAD_STATE.

Exhibit A lists the messages and their description, definition, and structure. Exhibit C summarizes the definition and structure of the messages. Exhibit C lists the messages that can be processed by the SMD for each of the operating states. And Exhibit D lists and defines the parameters for the messages.

Data Link Protocol

In an embodiment, a Data Link protocol provides reliable transfer of Application Level messages between the SMD and host PC. The protocol functions to convey messages in an error-free manner with no duplication of messages and with each message received in the order as transmitted. The protocol does not interpret the meaning of the transmitted message.

In an embodiment, data and messages are transferred between the SMD and host PC in the form of "packets" by the Data Link protocol. A packet is a unit of communication reliably transmitted or received by the Data Link protocol. Packets may include messages that are interpreted by the SMD Application Level protocol. The Data Link protocol does not interpret the meaning of the of the message included within the packets. The interpretation of the message is handled by the software described in aforementioned U.S. provisional patent application Serial Nos. 60/075,934 and 60/074,947. In an embodiment, proper reception of packets is ensured by checking the CRC appended to each packet, and packets that are improperly received are retransmitted.

In an embodiment, a packet has the general structure shown in Table 2.

TABLE 2

Packet Format

| Packet Field | Length |
|---|---|
| SOH | 1 Byte |
| Packet ID | 1 Byte |
| Reserved | 1 Byte |
| Message Length MSB | 1 Byte |
| Message Length LSB | 1 Byte |
| Variable Length Application Level Message | 0 to 65535 Bytes |
| CRC MSB | 1 Byte |
| CRC LSB | 1 Byte |

The SOH field forms the first byte of a packet and comprises the ASCII SOH character having a value of 0×0.

The Packet ID field is used by the host PC and SMD to keep track of packets that are sent and received. In an embodiment, this field is partitioned into two 4-bit nibbles, a most significant nibble (MSN) and a least significant nibble (LSN). The LSN includes the serial number of the packet being sent, and the MSN includes the serial number of the packet being received. Before sending a packet, the sender loads the serial number of the packet to be sent into the LSN of the Packet ID field, and loads the serial number of the last packet received from the packet's recipient into the MSN of the Packet ID field. The Packet ID field is further described below.

The Reserved field is a reserved byte for future use. The SMD and host PC transmit a value of 0×00 in this field unless otherwise specified in future versions of the protocol.

The Message Length fields are used to identify the length of the Application Level messages. These fields include a count of all bytes from the start of the message, up to and including the last byte of the message. The count does not include the lengths of the SOH, Packet ID, Message Length, or CRC fields (as these fields are of fixed lengths and are part of each message). The message may be of zero length. The Message Length MSB includes the high order 8 bits of the message length and the Message Length LSB includes the low order 8 bits of the message length.

The Variable Length Application Level Message field is a variable length string of bytes. This field may be absent, depending on the type of packet. The format and definition of the message are interpreted by the Application Level protocol described in the aforementioned U.S. provisional patent application Serial Nos. 60/075,934 and 60/074,947. Messages can vary in length from 0 to 65535 bytes. In actual implementation, the maximum length is typically less. The maximum length that is supported by the SMD is also specified in the aforementioned U.S. provisional patent application Serial Nos. 60/075,934 and 60/074,947.

The CRC fields includes two bytes that provide an integrity check of the packet. In a specific embodiment, the CRC fields include a 16-bit cyclic redundancy check (CRC) using, for example, the CCITT standard polynomial: $X^{16}+X^{12}+X^{5}+1$. The CRC can be calculated by various standard methods that are known in the art. This CRC identifies all single and double bit errors, all errors with an odd number of bits, all burst errors of length 16 or less, 99.997 percent of 17-bit error bursts, and 99.998% of 18-bit and longer error bursts. In an embodiment, the CRC applies on all fields of the packet, including the Packet ID, Message Length, and (all bytes of the) Message fields, but excluding the SOH and CRC fields.

The Packet ID field is used by the Data Link protocol to determine whether or not a packet has been properly transmitted or received. It includes two nibbles, each of which includes a serial number referring to a packet. The sender or recipient can examine the byte to determine if the other side had received the last transmission properly, or to determine if a newly received packet includes a new Application Level message or is a retransmission of an old message.

In an embodiment, each device (e.g., SMD and host PC) maintains local storage of a 4-bit nibble called the Transmitted Serial Number (TXSN). Each device also maintains local storage of a 4-bit nibble called the Received Serial Number (RXSN). A device increments its TXSN before sending a packet that includes a new Application Level message. After incrementing the TXSN, the transmitting device loads this TXSN value into the LSN of the Packet ID field of the outgoing packet. TXSN is not incremented before retransmitting a packet that includes a previously transmitted Application Level message. If a device is about to transmit a packet that includes a zero length message, the LSN of the Packet ID field is loaded with the TXSN of the most recently transmitted message, and the TXSN is not incremented. When a device transmits a packet, it loads the most recent contents of the RXSN into the MSN of the Packet ID field of the outgoing packet. The TXSN is a wrap-around counter, and wraps around from 15 to zero. That is, if the TXSN was 15 before the increment, it becomes zero after the increment.

Each time a device receives a packet, it compares the LSN of the Packet ID field (e.g., the transmitted TXSN) of the received packet to its local copy of the RXSN. If the LSN is equal to the RXSN, the receiving device concludes that the newly received packet does not include a new Application Level message. Further, if the packet does not have a zero length message, then the receiving device concludes that the received message is a retransmission of a previously received message that has not been acknowledged. The receiving device receives the message and acknowledges the retransmission.

If the LSN of the received packet is equal to the RXSN+1, the received packet includes a new message. The receiving device copies the number included in the LSN into the RXSN, and transfers the new message to the Application Level software. The receiving device then acknowledges receipt of the new message. Otherwise, if the LSN of the ID byte is not equal to the RXSN or the RXSN+1, the received packet is in error and ignored. The reviewing device discards the packet and sends a negative acknowledgment (NACK) to the remote device.

Moreover, each time a device receives a packet, it compares the MSN of the Packet ID field to its local copy of the TXSN. If the MSN is equal to the TXSN, the receiving device concludes that the most recently transmitted Application Level message was properly received by the remote device. This is considered an ACK to the last transmission. Otherwise, if the MSN is not equal to the TXSN, the receiving device concludes that the most recently transmitted message was not properly received by the remote device. This is considered to be a NAK to the last transmission. The device then retransmits another packet that includes the previously sent message. If more than two such retransmissions are required to communicate the message to the remote device, the sending device registers a communications error and reinitializes its portion of the Data Link protocol. After transmitting a packet that includes a new message, the sending device does not transmit another new message until the remote device acknowledges receipt of the new message.

The Data Link protocol does not define unique ACK and NAK packets. However, ACKs and NAKs occur (naturally) within the protocol using the Packet ID field as described above. If a device properly receives a packet that includes a new Application Level message or if it receives an erroneous packet, it ACK or NAK that receipt. It does so by sending the remote device a packet in which the MSN of the Packet ID field is equal to the RXID of the last properly received packet. This procedure is used for sending ACKs or NAKs. The return packet may or may not include a new message.

Before the SMD and host PC can begin exchanging packets, they identify themselves to each other. This process is referred to as Protocol Initialization. In a specific implementation, the host PC initialization is different from the SMD initialization, which prevents a host PC from connecting to another host PC, or an SMD from connecting to another SMD.

Figure 7A:
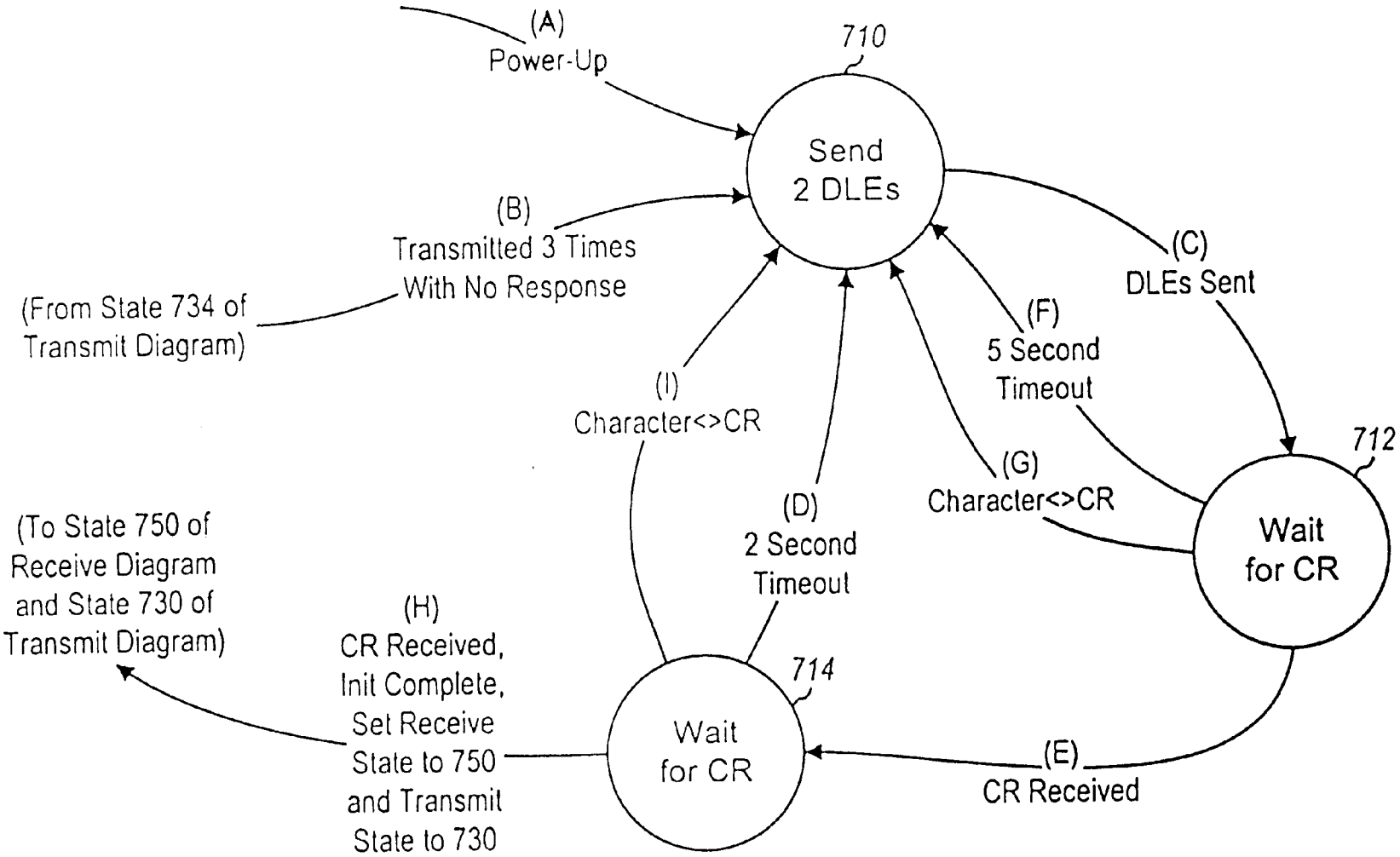
FIGS. 7A and 7B show state diagrams of a specific embodiment of the Host and the SMD Protocol Initialization processes, respectively.

FIG. 7A shows a state diagram of a specific embodiment of a Host Protocol Initialization process. The host PC detects the presence of the SMD in the following manner. Upon power up (A), the host PC enters an operating state 710 and sends two ASCII "DLE" characters (0×10) to the remote device (e.g., the SMD). In an embodiment, the second DLE is sent within a first predetermined time-out period (e.g., less than two seconds) of the transmission of the first DLE, or else the remote device times out. After sending the two DLEs (C), the host PC enters an operating state 712. In state 712, the host PC's receiver listens for an ASCII "CR" character (0×0D) from the remote device. If the CR does not arrive from the remote device within a second predetermined time-out period (e.g., five seconds) (F), the host returns to state 710 and retransmits the two DLEs. If any character other than CR arrives (G), the host PC also returns to state 710 and retransmits the DLEs.

If the CR character arrives within the second predetermined time-out period (E), the host enters an operating state 714 and listens for a second CR. If the second CR does not arrive within a third predetermined time-out period (e.g., two seconds) of the transmission of the first CR, the host PC times out (D) and returns to state 710 and retransmits the DLEs. Likewise, if a character other than CR is received (I) before the third predetermined time-out period, the host returns to state 710 and retransmits the DLEs. If the second CR is received before the third predetermined time-out period (H), the host PC's portion of the Data Link protocol is initialized. The host PC then enters an operating state 730 in the transmit state diagram in FIG. 7C and an operating state 750 in the receive state diagram in FIG. 7D, which are described below.

In an embodiment, the host PC attempts three transmissions (B) of a packet to the SMD. If all three attempts fail, the host PC re-executes the Host Protocol Initialization starting from state 710. In the specific implementation, if the SMD is not coupled to the host PC, the host PC loops between states 710 and 712 by continually transmitting the DLEs (C) and timing out when the CR is not received (F). This loop continues indefinitely until power is removed from the host PC or an SMD is detected.

Figure 7B:
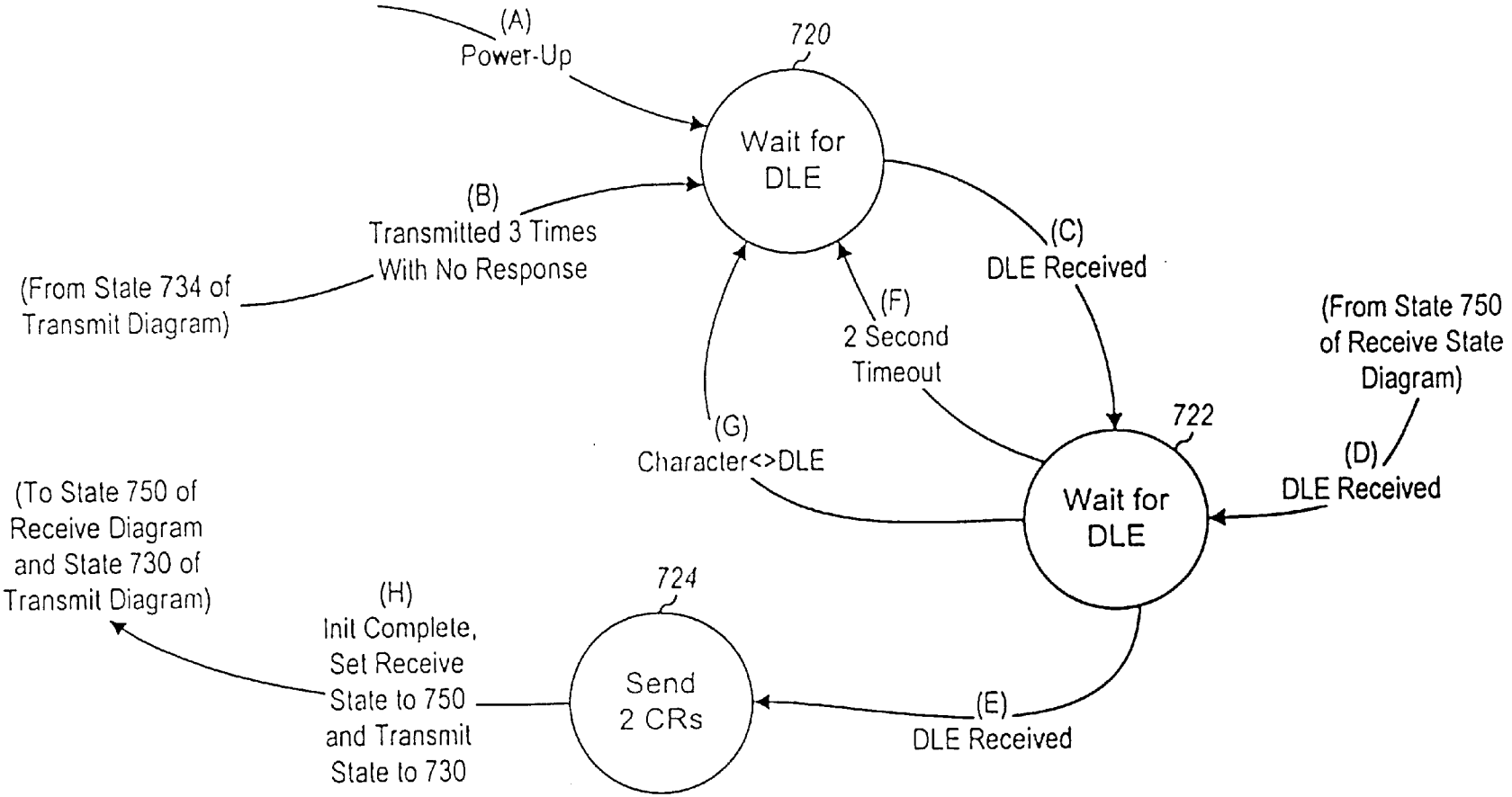

FIG. 7B shows a state diagram of a specific embodiment of a SMD Protocol Initialization process. Initialization of the Data Link protocol on the SMD side is complementary to the Host Protocol Initialization process. The SMD detects the presence of the host PC in the following manner.

Upon power up (A), the SMD enters an operating state 720 and waits for a DLE character. When a DLE is received (C), the SMD transitions to an operating state 722 and waits for a second DLE. If the second DLE does not arrive within a fourth predetermined time-out period (e.g., two seconds) of the receipt of the first DLE (F), or if any character other than DLE arrives (G), the SMD returns to state 720 and waits for another DLE. If the second DLE arrives in within the fourth predetermined time-out period (E), the SMD transitions to an operating state 724. Once in state 724, the SMD sends two ASCII "CR" characters and then transitions to operating state 730 in the transmit state diagram in FIG. 7C and operating state 750 in the receive state diagram in FIG. 7D.

Figure 7C:
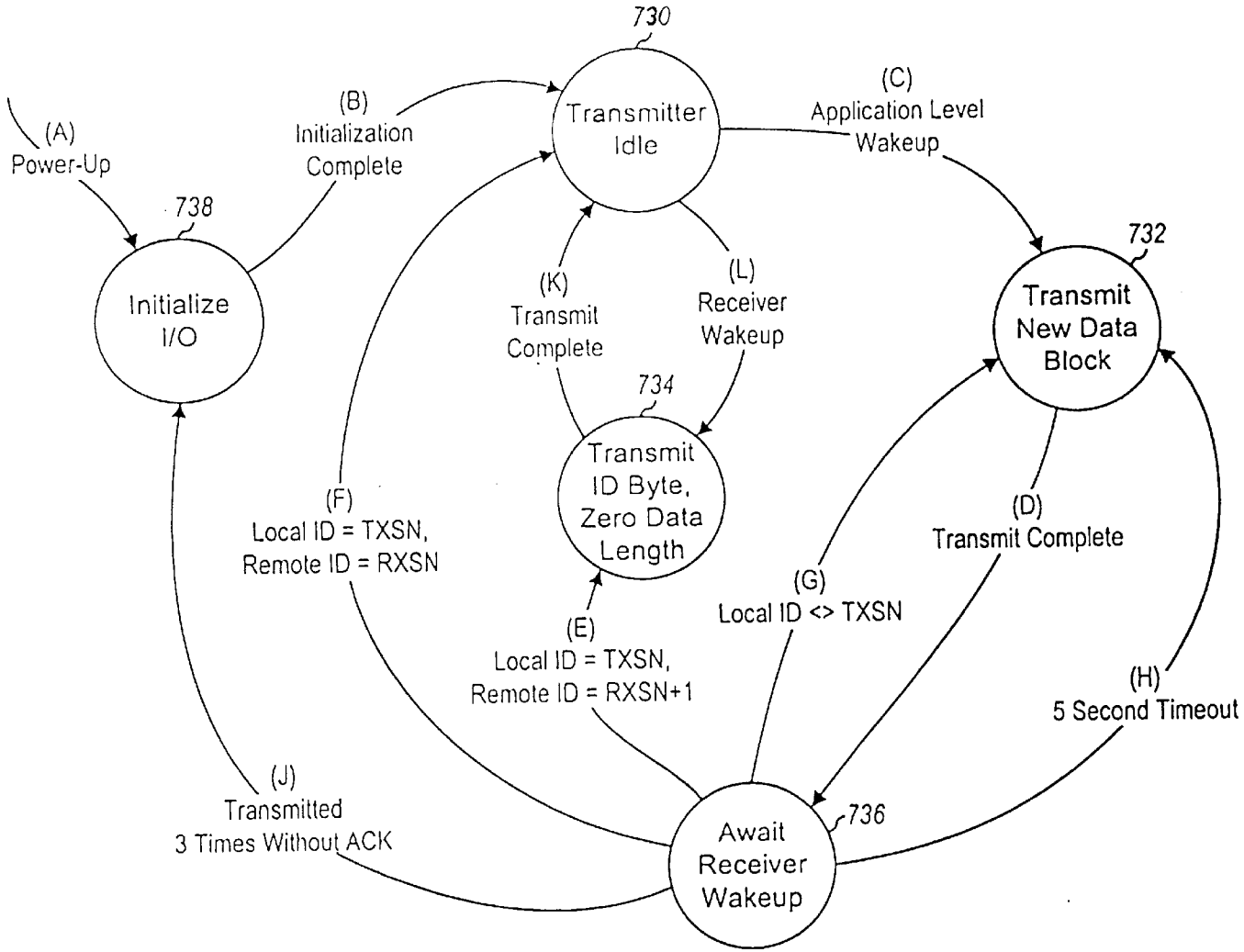
FIGS. 7C and 7D show state diagrams of a specific embodiment of the Packet Transmission and Reception processes, respectively, for both the host PC and SMD.

FIG. 7C shows a state diagram of a specific embodiment of a Packet Transmission process for both the host PC and SMD. Since the functionality of the software is the similar for both the host PC and SMD, the protocol is described in terms of "local" and "remote" devices. The transmission protocol is described from the standpoint of the local device being the transmitter of an Application Level message, and the remote device being the receiver of this message.

After power-up initialization, the transmit software (implementing the protocol) enters operating state 730, where the protocol idles because there is no data to transmit yet. The software can move to an operating state 732 or 734 depending upon the type of event (referred to as a "wakeup") that occurs next.

If the Application Level software assembles a message to be transmitted to the remote device, an Application Level Wakeup (C) occurs. In the process of transitioning from state 730 to state 732, the TXSN is incremented and is combined with the RXSN in the Packet ID field. The Packet ID field, Message Length field, and Application Level message are assembled together and a CRC is calculated. The SOH is appended to the start of the packet and the CRC is appended to the end of the packet. The software then enters state 732.

In state 732, the software starts by loading the SOH into the transmitter. It then continually checks the transmitter and waits for it to become empty, which signifies that the SOH has been sent. The next byte of the packet is then loaded into the transmitter. This process continues until the entire packet, including the two CRC bytes, have been transmitted. After the transmission is completed (D), the software enters an operating state 736 and awaits an event from the receiver. A timer is set to cause a wakeup if no packets are received within a fifth predetermined time-out period (e.g., five seconds) from the completion of the transmission at (D).

In state 736, if a packet is received from the remote device before the timer times out, the local device records the contents of the Packet ID field included in that packet and wakes up the transmit software. The transmit software then compares the MSN nibble of the received Packet ID field with the TXSN.

If the two are equal and if the LSN of the Packet ID byte is equal to the RXSN+1 (indicating that a new message has been received from the remote device), the software transitions along line (E) to state 734. The number contained in the RXSN is replaced by the contents of the MSN of the Packet ID field to reflect the receipt of a new message. Transition (E) registers the fact that the last message transmitted by the local device has been acknowledged, as well as the fact that a new message has been received from the remote device and is to be acknowledged. Accordingly, a zero length packet that includes the current TXSN and RXSN is sent to the remote device. During the transition to state 734, the software clears the buffer that contains the last transmitted message (i.e., because that message has been acknowledged and is no longer needed). The protocol then builds a new packet with a zero length message field to acknowledge the newly received message.

In state 734, the software sends a packet with a zero length message for the purpose of ACKing or NAKing the last received packet. The protocol proceeds in similar manner as for state 732, with the exception that no message field is transmitted. After the transmission is completed (K), the software returns to state 730 and awaits a new wakeup from the receiver.

Back in state 736, if the MSN of the Packet ID field equals the TXSN and the LSN equals the RXSN (indicating that a new message has not been received from the remote device) no ACK is sent and the protocol transition (F) to state 730. In this transition, the software clears the buffer that contains the last transmitted message (i.e., because that message has been acknowledged and is no longer needed). In state 730, the protocol again awaits a wakeup from either the Application Level or the receiver.

In state 736, if the MSN of the Packet ID field is not equal to the TXSN (G), or if the transmit software times out waiting for an ACK (H), the current message is retransmitted. A counter is maintained in state 736 such that if three transmission attempts are made without a proper acknowledgment from the remote device, a communication error is declared and the protocol transitions (J) to an operating state 738 to reinitialize the protocol.

If the protocol transitions (G) to state 732 before the message is retransmitted, the MSN of the Packet ID field in the transmit packet is updated with the latest RXID value received from the remote device, and the CRC is also be recomputed. Recomputation of the CRC is necessary if the packet received in state 736, that causes transition (G) to state 732, contains a new message (LSN equal to the RXSN+1). The new message is then acknowledged, and this is achieved by sending the new RXSN (equal to the old RXSN+1) to the remote device in the next packet, which in this case is a retransmission of old message performed in state 732.

State 730 can transition to state 734 when a wakeup is received from the receiver (L). This corresponds to a packet that has just been received from the remote device. The receiver software wakes up the transmitter to cause the transmitter to send an ACK for the newly received packet. Since there is currently no message to be transmitted (if there was, transition (C) would have occurred instead), a packet with a zero length message is assembled. The LSN of the Packet ID field is loaded with the TXSN and the MSN of the Packet ID field is loaded with the RXSN (which has just been updated based on the newly received packet). The CRC is calculated and the packet is transmitted in state 734 in a similar manner as in state 732, with the exception that upon a completed transmission the protocol transitions (K) back to state 730. State 738 is the same as in the power-up Protocol Initialization (e.g., state 710 for the host PC and state 720 for the SMD), as described above.

Figure 7D:
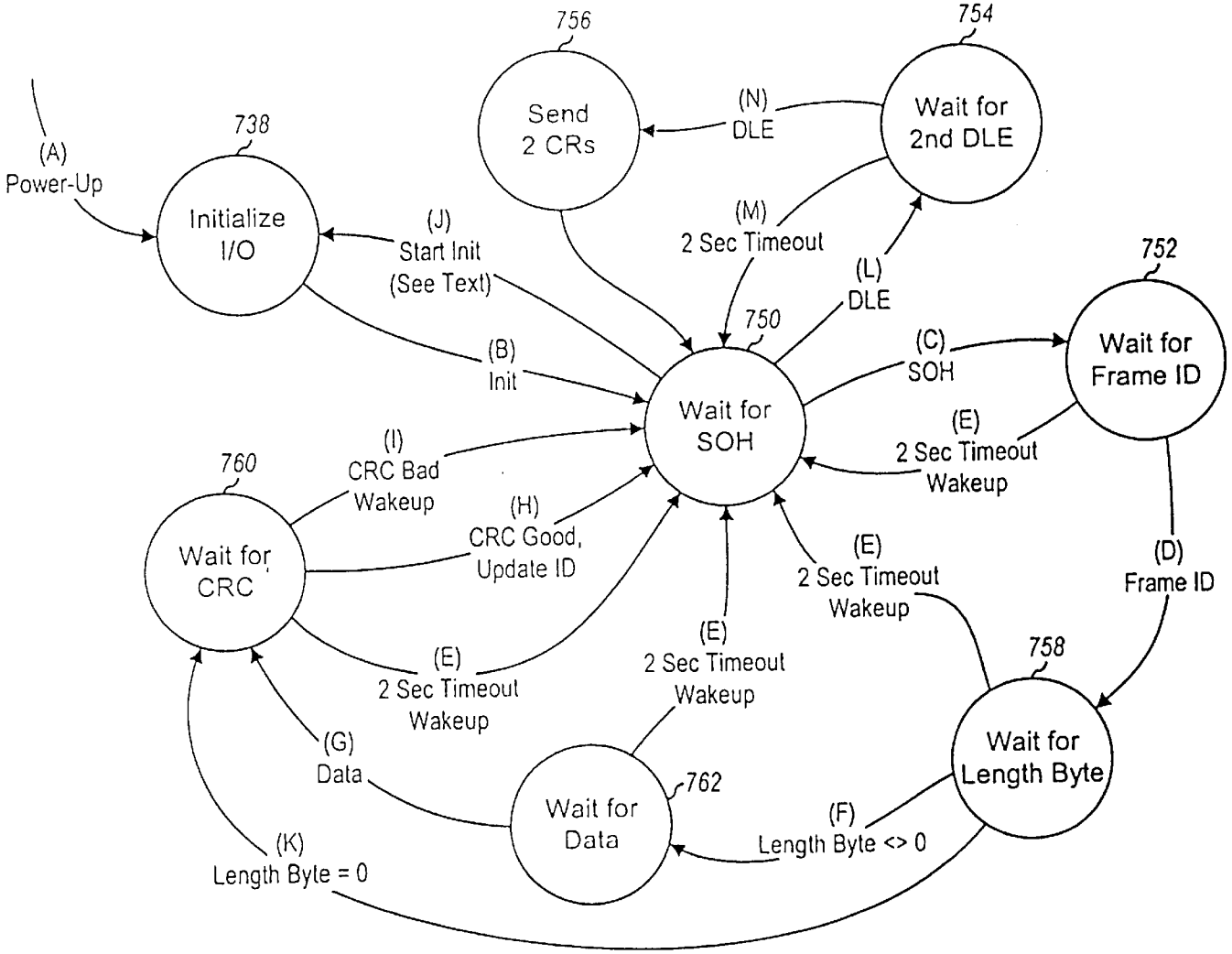

FIG. 7D shows a state diagram of a specific embodiment of a Packet Reception process for both the host PC and SMD. Since the functionality is similar for both the host PC and SMD, and the protocol is again described in terms of local and remote devices, similar to FIG. 7C.

After power-up initialization is completed, the receiver software enters operating state 750 in which the receiver examines each character received and compares that character to an ASCII SOH and ASCII DLE. The device transitions to an operating state 752 if an SOH is received (C), and to an operating state 754 if a DLE is received (L). In either case, a timer is set to a sixth predetermined time-out period (e.g., two seconds). The timer is used to assure that the receive software does not lock up waiting for data from the remote device. This can occur if the expected packet length is greater than the actual packet length, in which case the receiver can wait for data that is never sent.

If a DLE is received and device transitions to state 754, the software then waits for a second DLE. If the second DLE is received before the timer times out, the protocol transitions to an operating state 756. The protocol then transmits two ASCII CR characters to the remote device, and the receiver software cancels the timer and returns to state 750. Otherwise, if the timer times out before the second DLE is received, the software does not send the CR characters and returns to state 750 and waits for an SOH or another DLE.

If an SOH is received, the software starts the timer and transitions to operating state 752. At state 752, the protocol waits for the next byte and assumes that it contains the Packet ID. This byte and all following bytes are buffered for the calculation of the CRC. If the byte is received before the timer times out, the protocol transitions (D) is to an operating state 758. Otherwise, if the timer times out before the byte is received, the protocol transitions (E) back to state 750 where the protocol waits for a new SOH.

In state 758, the software waits for the next byte and assumes that it contains the length count (i.e., the message length field) of the Application Level message. If the timer times out before the message length field is received, the Packet ID is discarded and the protocol transitions (E) back to state 750 where the protocol waits for a new SOH. Otherwise, if the field is received before the timer times out, it is buffered. If the value of the message length field is equal to zero, no message is to be received and the protocol transitions (K) to an operating state 760 and the CRC is received. Otherwise, if the message length field is non-zero, a message is received and the protocol transitions (F) to an operating state 762.

In state 762, the software waits for bytes corresponding to the Application Level message. Each time a byte is received, a copy of the message length field is decremented. When all message bytes have been received, the protocol transitions (G) to state 760 to receive the CRC. If the timer times out during reception of the message, the buffered data is discarded and the protocol transitions (E) back to state 750 where the protocol waits for a new SOH.

In state 760, the software waits for the CRC field (e.g., the two CRC bytes). If both CRC bytes are received before the timer times out, the timer is stopped and the CRC of the packet is computed. The computed CRC is then compared against the received CRC. If the computed and received CRCs are equal, the LSN of the Packet ID field is compared to the RXSN. If these are also equal (H), the message field (if any) included in the packet has already been received and may be discarded. If the LSN of the Packet ID field equals the RXSN+1 (also H), the RXSN is updated and the message included in the packet is provided to the Application Level software.

If the computed and received CRCs are not equal or if the LSN of the Packet ID field does not equal either the RXID or the RXD+1, a reception error has occurred and the protocol transitions (I) back to state 750. If the timer times out while in state 760, the protocol also transitions (E) back to state 750. In any case, once the protocol leaves state 760 for state 750, the transmit software receives a wakeup call from the receive software to send an ACK packet (if necessary) to the remote device and/or check to see if the ACK it is waiting for has in fact arrived.

Finally, in state 750, if a CR is received instead of the expected SOH, the receive software assumes that the remote device had a communication error and returned to the Protocol Initialization operating state 738. If this occurs, the local device also transitions to protocol initialization state 738 and re-achieve synchronization with the remote device.

SMD Stand-Alone Operation

The metering device of the invention is also capable of operation in a stand-alone mode, without being coupled to the host PC. Initially, the SMD is loaded with a particular amount of funds. This preloading of funds can be achieved at the factory (i.e., before the SMD is leased to the user). The preloading of funds can also be performed when the SMD is coupled to the host PC.

In the stand-alone mode, the SMD is decoupled from the host PC and the metering device can be moved to locations convenient to the user for printing postage indicia. The small size and built-in printer (e.g., for metering device 110*a* in FIG. 1A) facilitates operation in this mode. In this mode, the metering device acts as a highly portable postage meter capable of being easily moved, for example, to locations of large parcels and the like, thereby obviating the need to move such large packages.

In the stand-alone mode, the metering device is capable of printing as many indicia (i.e., of a predetermined value) as allowed by the funds stored in the SMD. Once the SMD has expended the funds stored in its revenue registers, it can be loaded with additional funds by performing another Funding transaction. The metering device can then be re-coupled to the host PC for this Funding transaction, and disconnected again after the Funding transaction.

In a specific embodiment, the metering device operating in the stand-alone mode dispenses indicium of a predetermined (or default) value when requested. The predetermined indicium value can be programmed by the user via an earlier transaction with the host PC or can be preset at the factory. The user can request printing of an indicium by entering the request via an input mechanism that couples to the SMD.

Referring back to FIG. 2A, SMD 150 can further include an input interface circuit 236 that couples via signal line 237 to an input element 238. Input element 238 can be a switch, a push button, a key, or the like. When input element 238 is activated (i.e., by pushing on a print control key), SMD 150 of metering device 110*a* performs the Indicium transaction. SMD 150 generates an indicium having a predetermined value and directs printer 152 to dispense the indicium. SMD 150 updates its revenue registers when the indicium is generated. SMD 150 generates the indicium when requested and as long as the funds in the revenue registers are sufficient to cover the indicium value. Otherwise, the metering device can indicate a failed Indicium transaction via, for example, a blinking light emitting diode (LED).

In another specific embodiment, to provide additional flexibility, the metering device includes a keyboard, a touchpad, or other data entry mechanism that allows data to be entered into the metering device. The metering device can further include a display mechanism to provide results, messages, and other information to the user. The display mechanism can be LED(s), a crystal display, other displays, or a combination of the above. With the inclusion of the display and input mechanism in the metering device, the user can be allowed to change the predetermined indicium value, or to select the amount of postage for each requested indicium.

Host Application Software

The user interfaces with the SMD through the host PC. An application software executed on the host PC allows the user to communicate with the SMD to perform various transactions. The host application software displays information (e.g., data, results, messages, and so on), prompts the user, collects user inputs, and coordinates transaction with the SMD and (for some transactions) the system server.

Figure 8A:
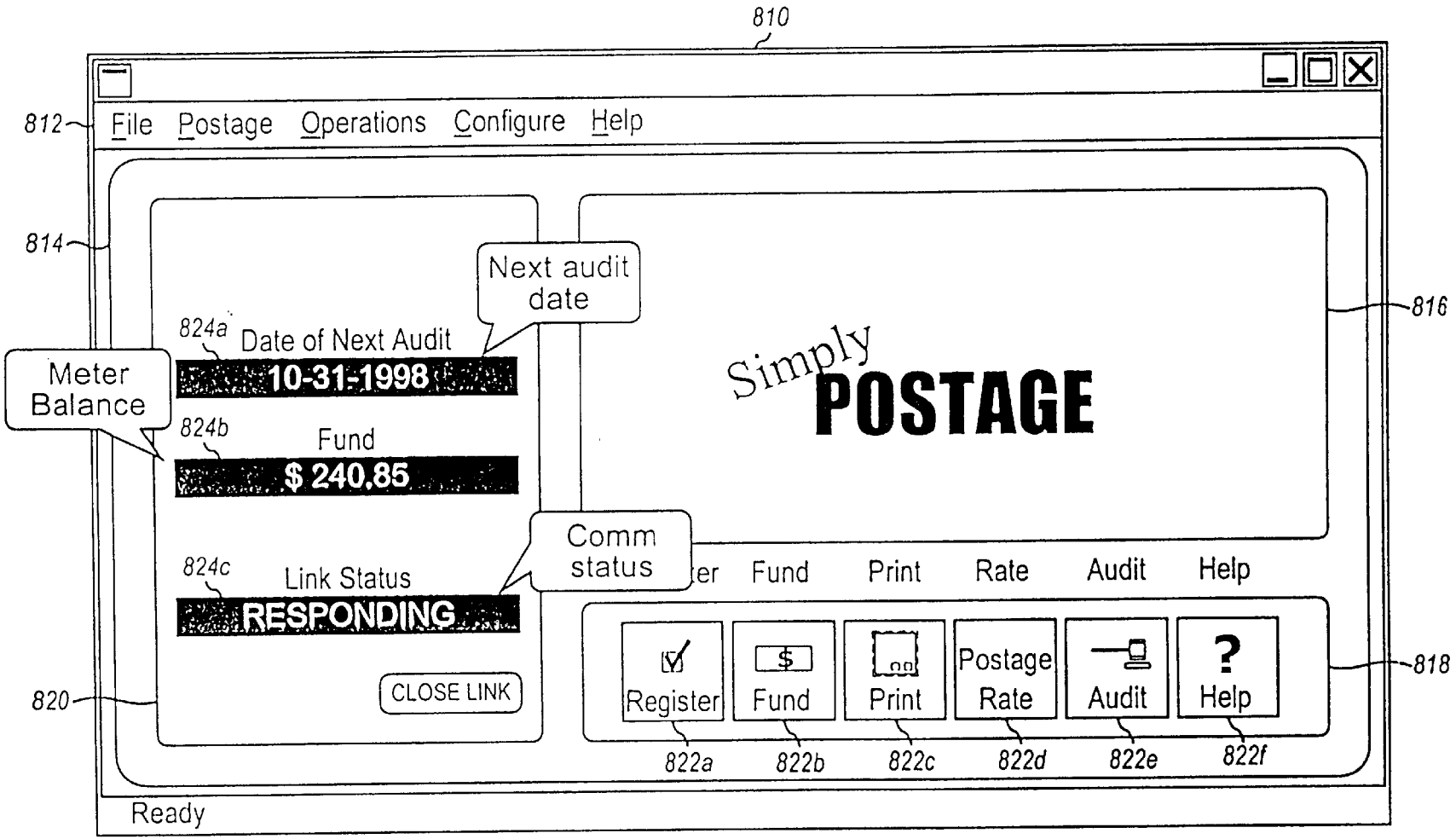

FIG. 8A shows a diagram of an embodiment of a main menu screen 810 displayed by the host application software. Menu screen 810 includes a user interface control area 812 and a display area 814. As shown in FIG. 8A, control area 812 includes five pull down menus labeled as: File, Postage, Operations, Configure, and Help. Alternatively of additionally, buttons, icons, control functions, and the like can also be provided within control area 812.

Display area 814 includes a logo area 816, an array 818 of selectable functional buttons, and an informational display area 820. In the embodiment shown in FIG. 8A, array 818 includes a Register button 822*a*, a Fund button 822*b*, a Print button 822*c*, a Postage Rate button 822*d*, an Audit button 822*e*, and a Help button 822*f*. The user can initiate a transaction by simply selecting (i.e., double clicking) on one of buttons 822, or by selecting one of the full down menu choices in control area 812.

As shown in FIG. 8A, informational display area 820 includes three fields: a field 824*a* that shows the date of the next audit, a field 824*b* that shows the available funds, and a field 824*c* that shows the status of the communications link between the host PC and the system server. Additional information that may be useful to the user can also be displayed and is within the scope of the invention.

Figure 8B:
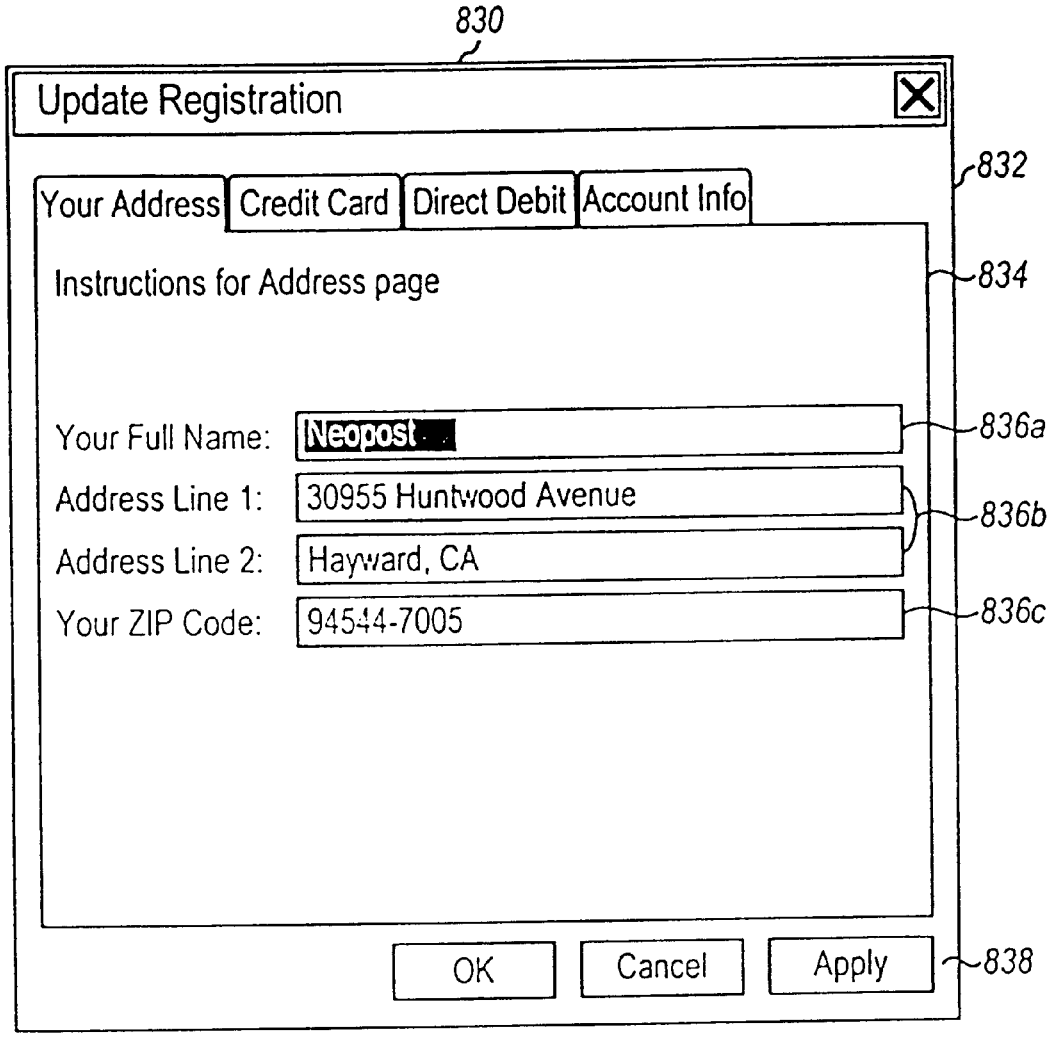

FIG. 8B shows a diagram of an embodiment of a registration screen 830. The user reaches this screen by selecting Register button 822*a* in menu screen 810. Screen 830 includes a user interface control area 832 and a display area 834. In an embodiment, control area 832 includes four pages of display labeled as: Your Address, Credit Card, Direct Debit, and Account Information. Each page of display includes fields that contain information related to that page. For example, the Your Address page includes fields 836*a* through 836*c* for the user's name, address, and zip code, respectively. The user can enter the data into the fields and elect to save or discard the data by selecting one button from a set of control buttons 838. If the user selects the OK button, the data is saved until the user reenters the data or the meter is reset. Selecting any one of buttons 838 also exits the registration screen and returns the user to the main menu screen.

Figure 8C:
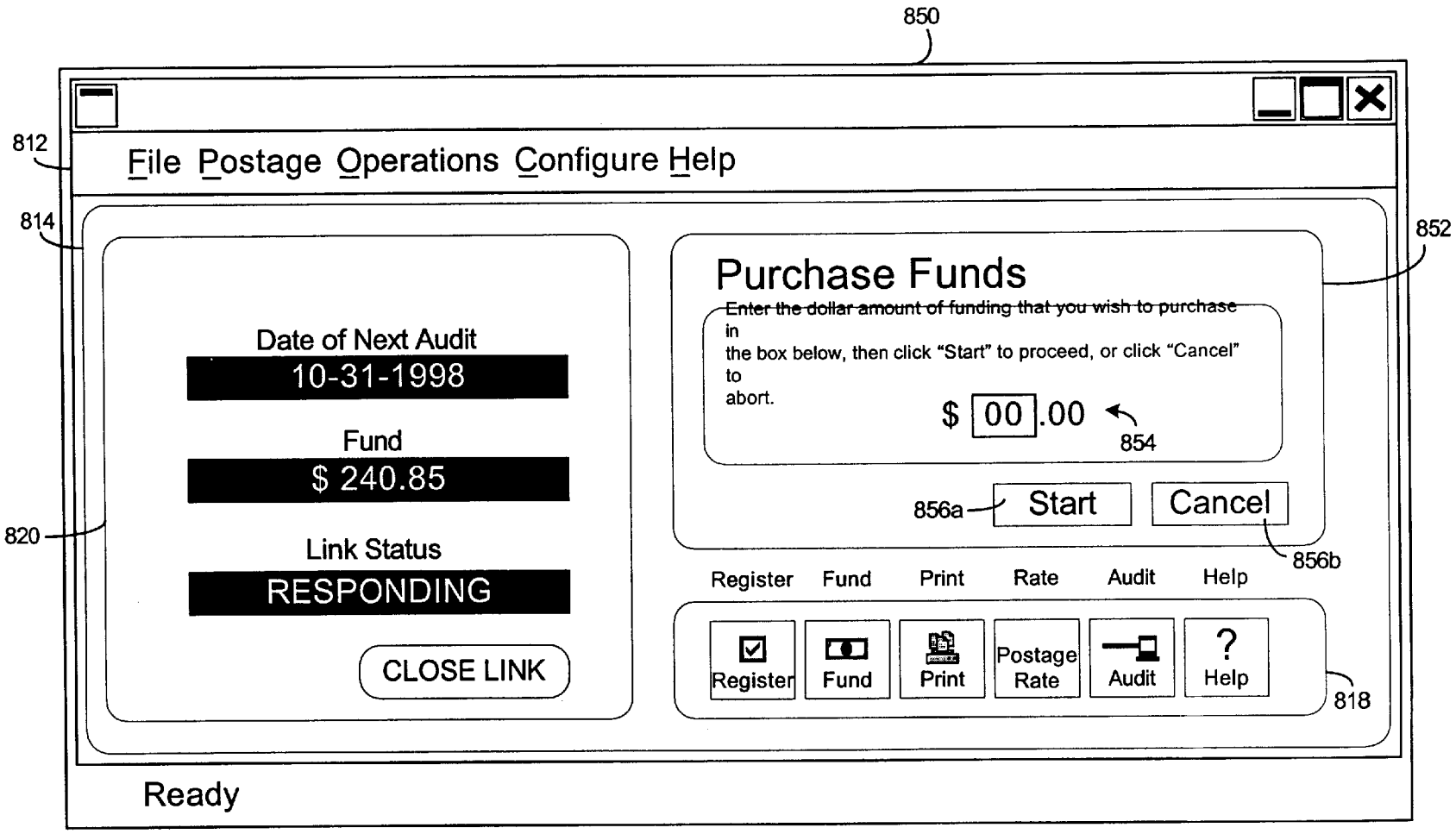

FIG. 8C shows a diagram of an embodiment of a funding screen 850. Screen 850 includes user interface control area 812 and display area 814 that includes array 818 of selectable functional buttons and informational display area 820, similar to screen 810 in FIG. 8A. However, logo area 816 is replaced with a query box 852 that queries the user for the amount of fund to download onto the SMD. The user is able to enter the requested fund amount in an input field 854 and then click a Start button 856*a* to initiated the Funding transaction. Additional screens may be displayed or query box 852 may be updated to show the status of the transaction. Alternatively, the user can click on a Cancel button 856*b* to cancel the transaction and return to the main menu.

In an embodiment, the user is allowed to request fund amount between an upper limit and a lower limit. These limits can be set by the provider (i.e., during the Initialization or Registration transaction), and can be based on, for example, the amount on deposit with, and available from the provider. If the user purchases funds with a credit or debit card, the upper limit may be determined by the amount that is approved for the card. In a specific implementation, the user opens an account with the provider, downloads funds into the SMD as required or desired (up to an approved amount), and is periodically sent a bill for the downloaded amounts.

Figure 8D:
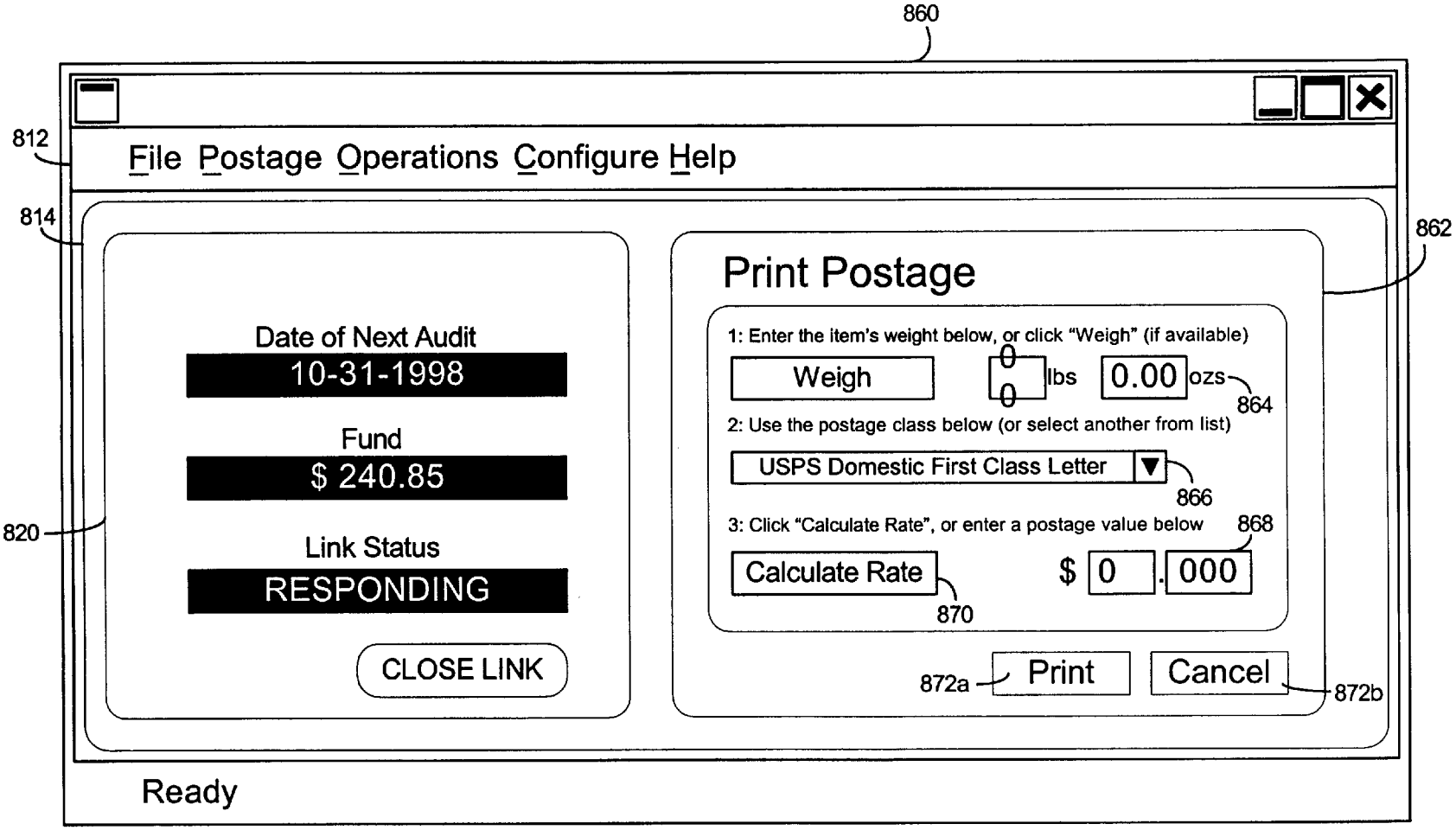

FIG. 8D shows a diagram of an embodiment of an indicium printing screen 860. Screen 860 includes user interface control area 812 and display area 814 that includes informational display area 820 similar to screen 810 in FIG. 8A. However, logo area 816 and array 818 of selectable functional buttons are replaced with a query window 862 that queries the user for information used to generate an indicium.

In an embodiment, the indicium printing process allows the user to manually input the postage amount or compute the postage amount based on entered information. This information may include, for example, the weight of the item to be ship and the postage class for the item. The user can enter the weight of the item in an input field 864, the postage class using a pull-down menu 866, and the postage value for the indicium in an input field 868. The weight information can also be received from a scaled coupled to the host PC (i.e., via the metering device as shown in FIG. 1A).

By hitting a Calculate Rate button 870, the user can requested the host PC to calculate the postage value based on the weight and class information provided in fields 864 and 866, respectively. The rate calculation can be performed using a rate table that is downloaded (i.e., from the provider or e U.S. Postal Service) and stored within the host PC. The user then clicks a Print button 872*a* to initiate the Indicium Printing transaction. Additional screens may be displayed or query window 862 may be updated to show the status of the transaction. Alternatively the user can click on a Cancel button 872*b* to cancel the transaction and return to the main menu.

Figure 8E:
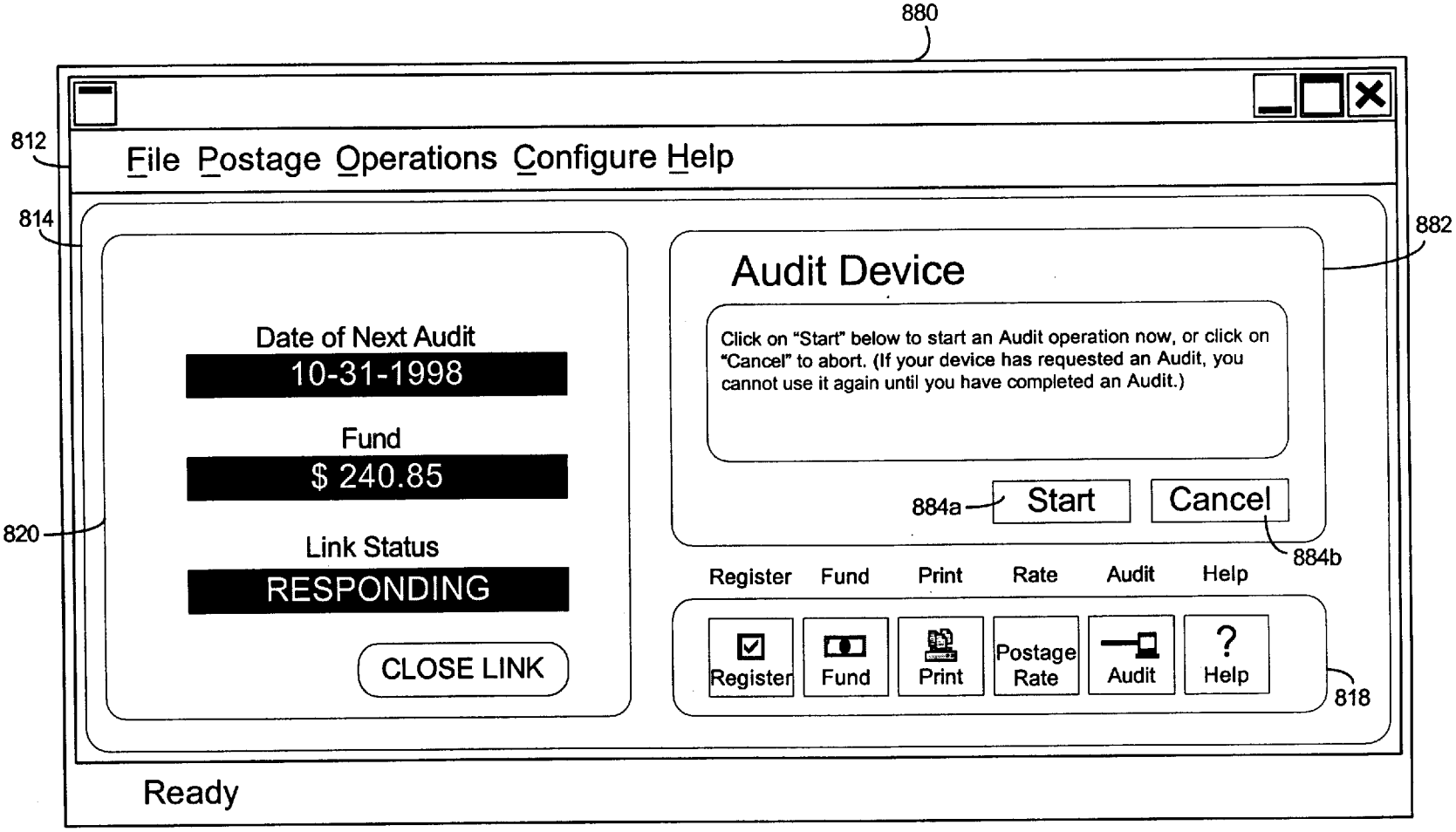

FIG. 8E shows a diagram of an embodiment of an audit screen 880. Screen 880 includes user interface control area 812 and display area 814 that includes array 818 of selectable functional buttons and informational display area 820, similar to screen 810 in FIG. 8A. However, logo area 816 is replaced with a window 882 that informs and queries the user for an Audit transaction. The user clicks a Start button 884*a* to initiate the Audit transaction or a Cancel button 884*b* to cancel the transaction and return to the main menu. During the Audit transaction, additional screens may be displayed or window 882 may be updated to show the status of the transaction.

FIG. 8F shows a diagram of an embodiment of a device status screen 890. This screen may be displayed by selecting the Configure menu choice in user interface control area 812. Status screen 890 displays information about the SMD and the user, which may be helpful, for example, for tracking and trouble shooting by the provider or U.S. Postal Service. The user exits status screen 890, by clicking on an OK button 892.

Indicium

The SMD directs printing of indicia that may be affixed to letters, parcels, and other mail items. The indicia generally comply with the Information Based Indicia Program (IBIP) specifications published by the U.S. Postal Service and incorporated herein by reference. The indicium contents include human-readable and machine-readable (e.g., PDF 417) data elements. The indicia can also include optional identifiers, marks (e.g., watermarks), and other features to assist in the prevention and detection of fraud. One such identifier is a pre-printed fluorescent identifier that is pre-printed on the indicium label, as described below.

Figure 9:
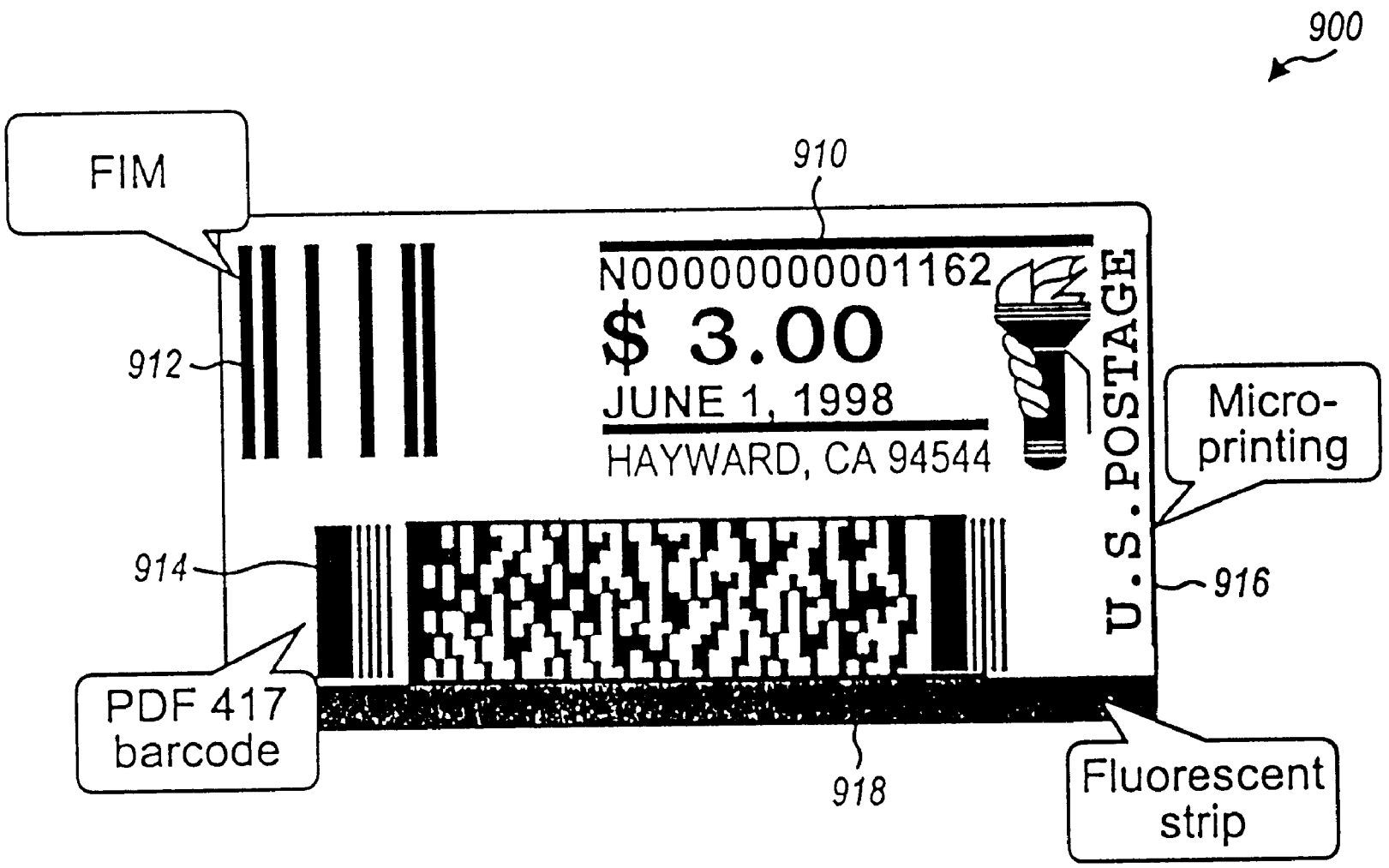
FIG. 9 shows an illustration of a specific embodiment of an indicium.

FIG. 9 shows an illustration of a specific embodiment of an indicium 900. In an embodiment, indicium 900 is printed on a pre-formatted label. Indicium 900 includes a human readable portion 910, a FIM marking 912, and a barcode 914. As shown in FIG. 9, human readable portion 910 includes the device ID number, the postage amount, the date the indicium was printed, the origination address (e.g., the city, state, and zip code), and the rate category. The destination address (e.g., the destination zip code) can also be printed in the human readable portion of indicium 900, although this is not shown in FIG. 9. The FIM marking and the (e.g., PDF 417) barcode conforms to IBIP specifications and are used to assist the postal authority in the detection of fraud.

In the specific embodiment shown in FIG. 9, indicium 900 further includes a micro printing portion 916 and a fluorescent identifier (e.g., a stripe) 918 that discourage and assist in the detection of counterfeits. Micro printing portion 916 includes, for example, texts printed in small size fonts that are difficult to reproduce (i.e., using conventional printers). This micro printing portion can be pre-printed on the indicium label at a factory using a suitable printing process, such as the micro printing process used in the banking industry.

Similarly, the fluorescent identifier can be pre-printed anywhere on the indicium label at the factory. The identifier can include one or more elements for the purpose of verifying the indicium created, with each element having one or more colors, designs, and the like. Moreover, more than one identifier can be pre-printed on the label to further improve security of the indicia generation.

The ink used for the identifier can be visible to the human eyes. Alternatively, the ink can be invisible to the human eyes, and is apparent only under light of specified wavelength(s). For example, ink can be used that renders the identifier invisible under normal light, but would fluoresce blue under certain non-visible forms of light.

To further enhance security, "taggants" can be added to the ink. Taggants are microscopic identifiers manufactured specially for a particular provider, and are used to uniquely identify that provider. Taggants are mixed in with the ink, but are not easily detected. Thus, even if the ink and its fluorescent identifier are duplicated, the presence of taggants allows for analysis of an indicium to determine whether it originates from an authorized metering device. Taggants can be used to discourage counterfeits, and are especially effective because of the unsuspecting nature.

The identifier can comprise a single strip of fluorescent ink, such as a visible pink/red strip of fluorescent ink used by conventional postal equipment to automatically validate mail. Alternatively, other types of identifier can be used that differ in shape, placement, color, or other characteristics from the conventional visible pink/red strip used by the U.S. Postal Service. For example, rather than a strip, a proprietary logo can be designed that can be recognized by a character recognition mechanism in the scanning equipment used by the U.S. Postal Service. By printing the logo using a specialty invisible ink as described above, security can be improved because the shape of the logo, and even its use, would not be readily apparent to those who may attempt to counterfeit indicia. In addition, the invisible logo can be combined with the conventional pink/red strip to provide compatibility with current recognition and validation techniques, and enhanced security provided by the use of multiple identifiers.

The indicia printed by the printer can be altered to meet various objectives and specifications since the indicia is computer generated and the printer is capable of forming images substantially anywhere on the label. The indicia can be defined in many different manners by the system, such as by its constituent parts, by a template that indicates what areas certain types of indicia elements are to appear, by a predetermined (or minimum) set of indicia elements, and so on. Optional elements (e.g., company logos, and the like) can also be included in the indicia, especially if the indicia include a small set of constituent elements.

For example, for indicia defined by a template, one or more indicia elements can be substituted to achieve the desired effect. As an example, if a particular area of the indicia is defined as including a barcode (or some other elements), that area may be designed to include a one-dimensional barcode, a two-dimensional barcode, cryptographic text, or some other elements.

The ability to design and customize the indicia provides many advantages. With this flexibility, a "standard" metering device can be designed and adopted for used in international market. In a specific implementation, a list of possible elements is generated that includes all target markets for the device. This list can include information such as the postage amount, graphics, time and date of the indicium creation, creation location, and other pertinent information. A template for each country can be created and stored (i.e., in the SMD or the host PC). When an indicium is to be generated, the proper template is retrieved based on the country information entered by the user or the provider. The retrieved template is then "filled" with the relevant information from the element list and from the inputs by the user. A standard metering device can thus be sold and used in various countries without any special modifications.

The flexibility in the indicia design also allows the metering device to generate different indicia for different classes of mail. Adjustments can be made to the indicia based on, for example, the characteristics of the mail piece, its country of origin, and the like. The flexibility further allows for easy configuration of the indicia to meet current and future indicia element requirements.

The indicium can include various data elements. Table 3 describes the data elements and their format for a specific embodiment of the indicium. Table 3 includes the field number information, which allows for the reordering of the indicium data. For example, to reconstruct the indicium, the data elements are placed in their proper sequence using the specified field number. Greater, fewer, or different data elements from those listed in Table 3 can be included in the indicium and are within the scope of the invention.

TABLE 3

| | Indicium Data Elements | | | | |
|---|---|---|---|---|---|
| Data Elements | Bar Code Data | Human-Readable Data | Length (Bytes) | Field Number | Data Type |
| Indicium Version Number | Yes | No | 1 | 1 | Hex |
| Algorithm ID | Yes | No | 1 | 2 | Hex |
| Certificate Serial Number | Yes | No | 4 | 3 | PBCD |
| Device ID | Yes | Yes | 8 | 4 | PBCD |
| Ascending Register | Yes | No | 6 | 5 | PBCD |
| Postage | Yes | Yes | 3 | 6 | PBCD |
| Date of Mailing | Yes | Yes | 4 | 7 | PBCD |
| Originating Address (City, State, Zip Code) | Yes | Yes | — | — | N/A |
| Licensing Zip Code | Yes | No | 6 | 8 | PBCD |
| Software ID | Yes | No | 6 | 9 | PBCD |
| Descending Register | Yes | No | 5 | 10 | PBCD |
| Rate Category | Yes | Yes | 4 | 11 | ASCII |
| Digital Signature | Yes | No | DSA: 40 | 12 | Hex |
| Reserve Field Length | Yes | No | 1 | 13 | Hex |
| Reserve Field Data | Yes | No | Variable 0-255 | 14 | Hex |

A secure means of authenticating postage indicia is of great importance to the Unites States Post Office, which loses millions (and potentially billions) of dollars a year to the use of fraudulent postage indicia. In the preceding embodiments, the printer imprints postage indicium and other information on the mail piece. As shown in FIG. 9, the postage indicium may include human-readable postage information and encoded postage information. These can be used to determine the authenticity of the affixed mark.

In a specific embodiment, the postage information is generated in the following manner. Information from the SMD (and, optionally, from the host PC) may be signed by the SMD using a cryptographic or signature algorithm (e.g., DSA, RSA, or a comparable algorithm). The information is then converted into a printable binary code of some sort. Examples of a printable binary code include bar codes, data matrix, FIM, PDF-417, or other comparable method. The data matrix method is efficient because it allows the printing of a relatively large amount of data in a small space. Since the indicium is typically restrained to a predetermined size, efficient use of the available printing area is advantageous.

System Variations

Referring to FIGS. 1A and 1B, the metering device communicates with the host PC using a conventional communications link (e.g., serial bus) and the host PC communicates with the system server via a telephone link. However, the metering device of the invention can be modified to communicate using other techniques, such as via a wireless link, the Internet, and the like.

Advantages of the Postage Metering System

The postage metering system and the metering device of the invention include many features and provide many advantages. Conventional postage meters can normally hold very large sums of finds (e.g., $99,999.99) and must be carefully controlled by the user to prevent loss due to misappropriation of postage, malicious misuse, or errors by inexperienced operators. If the meter is misused, or is stolen and not recovered, the amount of fund held in the meter can be irrecoverably lost to the user.

First, in accordance with an aspect of the invention, the SMD can be quickly and easily funded in small increments. For many applications, values less than $25.00, for example, are still very useful. Loading small amounts into a conventional meter is theoretically possible, but usually impractical because of the time and expense involved to perform a loading of fund. Moreover, frequent funding transactions are typically discouraged by the postal authorities and meter manufacturers, since their operating costs are the same, regardless of the load amount, and the overhead costs for small funding amounts can become prohibitive. With the convenient and cost effective funding mechanism of the invention, small amounts of fund can be easily downloaded into the SMD at any time and with minimal cost.

The effective funding mechanism of the invention also limits the SMD lessor's liability. Unlike a conventional meter, the SMD can be funded as often as necessary (i.e., several times a day, or more). The funding transaction is also performed at the user's premise and via the user's host PC. This feature reduces the need for the user to control the meter (i.e., for fear of loss or abuse of the funds) and increases the flexibility of use. As some examples, the mailrooms of a business can check out the metering devices to department secretaries, schools can allow student monitors to operate the metering devices, organizations can turn the metering devices over to unskilled volunteers, and so on.

Second, postal revenue is protected by encryption of data transferred into or out of the SMD. Use of well-known encryption techniques and physical security devices, for example FIPS security methods, ensure that the software or hardware cannot be tampered or modified to allow printing unpaid postage. In addition, the SMD can be programmed to "go to sleep" after a period of non-use, forcing the user to reconnect it to the host PC before resuming operation, and thus increasing the difficulty of using a stolen metering device.

Third, as noted above, the metering device's portability allows substantial flexibility in use. For example, in a warehouse it may be advantageous to move the metering device around and place postage on parcels instead of moving the parcels past a metering station. In a business, the metering device can be taken to locations where mail is prepared, reducing processing activity in the mailroom.

Fourth, the software and hardware required to implement the invention are (relatively) inexpensive in comparison to conventional postage metering systems. This allows the postage metering system to be dedicated to individual user or a small group of users.

Fifth, in comparison to conventional postage meters, the use of the metering device is simplified. The individual user or site need not maintain logbooks, lease equipment, comply with special regulations, physically transport a postage metering device to a post office for inspection, nor perform other custodial tasks normally related to the use of conventional postage meters.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. For example, although the invention is described using digital signatures, encryption (e.g., DES, RSA, and others) or other coding techniques can be used. Thus, the present invention is not intended to be limited to the embodiments shown herein but is to be accorded the widest scope consistent with the principles and novel features disclosed herein.

EXHIBIT A

A SPYRUS LYNKS Metering Device (LMD) is a device that incorporated the features in this specification into its design in order to process the SMD Application Layer messages. With the addition of one pair of LMD specific messages, the LMD uses the SMD serial messaging interface in place of a PC Card interface to transport Fortezza commands. This interface allows signed firmware updates to be performed to securely update the firmware in the LMD. This pair of LMD specific commands is also described in this specification.

NOTE: Field Length values are given in decimal number of bytes.

ACCESS REQUEST message

Message Type Code (Hex): 0×FA

Sender: host PC

Message Length (Bytes, Decimal): 11 (+Data Length for a write command)

This message is used to transfer data to memory in the LMD for command processing as a Fortezza Cryptographic Card. This message provides a command interface to read and write the common and attribute memory on the card via the LMD serial interface. Common memory accesses are directly transferred to and from the card's common memory. Attribute memory reads are processed to return the appropriate tuple information or configuration register status. Attribute memory writes are processed to execute a command in common memory as if the ready/busy register was written, and to perform software reset in the card. The data field is omitted for read commands.

This command mechanism is used primarily for signed firmware updating of the LMD for use as an SMD.

This message is processed and is valid in any state. The ACCESS REQUEST message is formatted as follows:

| Byte Address | Message Field Name | Field Length | Contents |
|---|---|---|---|
| 0x0000 | Message Type Code | 1 | ACCESS REQUEST message type code. |
| 0x0001 | Read/Write Flag | 1 | Indicates direction of access from the perspective of the host PC.<br>1 = read data from LMD to host PC.<br>2 = write data to LMD from host PC. |

-continued

| Byte Address | Message Field Name | Field Length | Contents |
|---|---|---|---|
| 0x0002 | Memory Type Flag | 1 | Indicates the type of memory to access on the LMD.<br>1 = Common memory<br>2 = Attribute memory |
| 0x0003 | Data Length | 4 | The number of bytes to transfer in big endian, i.e. MS byte first. |
| 0x0007 | Address | 4 | Start address to read from or write to. |
| 0x0008 | Data | 0 or Data Length | The data for a write command. None if this is a read command. |

ACCESS RESPONSE message

Message Type Code (Hex): 0×FB

Sender: LMD

Message Length (Bytes, Decimal): 11 (+Data Length for a read command)

This message is sent by the LMD to the host PC to acknowledge data transfer from the ACCESS REQUEST message. The data field is omitted in a response to a write command.

The ACCESS RESPONSE message is formatted as follows:

| Byte Address | Message Field Name | Field Length | Contents |
|---|---|---|---|
| 0x0000 | Message Type Code | 1 | ACCESS RESPONSE message type code. |
| 0x0001 | Read/Write Flag | 1 | Indicates direction of access from the perspective of the host PC.<br>1 = read data from LMD to host PC.<br>2 = write data to LMD from host PC. |
| 0x0002 | Memory Type Flag | 1 | Indicates the type of memory to access on the LMD.<br>1 = Common memory<br>2 = Attribute memory |
| 0x0003 | Data Length | 4 | The number of bytes transferred in big endian, i.e. MS byte first. |
| 0x0007 | Address | 4 | Start address to read from or write to. |
| 0x0008 | Data | 0 or Data Length | The data returned for a read command. None if this is response to a write command. |

AUDIT1 message

Message Type Code (Hex): 0×30

Sender: host PC

Message Length (Bytes, Decimal): 1

The AUDIT1 message is sent by the host PC to begin an Audit transaction. This message is processed in the states indicated in Appendix C. If this message is received while in any other state, the SMD responds with an ERROR message that includes an error code of BAD_STATE.

The SMD processes the AUDIT1 message by saving the current state in an internal location, transiting to the Audit-Intermediate state, and generating and sending an AUDIT2 message to the host PC. The current state is saved because if an incorrect message is received or a power failure occurs while in the Audit-Intermediate state, the SMD transitions back to the current state.

AUDIT2 message

Message Type Code (Hex): 0×31

Sender: SMD

Message Length (Bytes, Decimal): 271

Upon receipt of an AUDIT1 message, the SMD creates a Device Audit field as shown below, signs it, and sends it to the host PC in the AUDIT2 message. The host PC sends this field to the system server as part of an Audit transaction. If the system server is able to verify the Device Audit field, the host PC sends an AUDIT3 message to the SMD.

The AUDIT2 message is formatted as follows:

| Byte Displacement | Message Field Name | Field Length | Contents |
|---|---|---|---|
| 0x0000 | Message Type Code | 1 | AUDIT2 message type code. |
| | Device Audit Field | 39 | DEVICE AUDIT message as specified below and in the USPS IBIP Open System Indicium Specification. |

-continued

| Byte Displacement | Message Field Name | Field Length | Contents |
|---|---|---|---|
| | Digital Signature | 40 | Signature of the Device Audit field, using the SMD's private key. |
| | SMD X.509 Certificate | 191 | The X.509 certificate that includes the SMD's public key, used to verify the digital signature. |

The SMD increments its internally stored copy of Transaction ID and generates the Device Audit field as shown in the following table. The new Transaction ID and the current and previous values of the revenue registers are used to generate the Device Audit field. Any padding necessary under FIPS-180 for digital signature generation is added to the end of the field, and the field is signed using the SMD's private key. After signature, the field is inserted into the AUDIT2 message, followed by the digital signature and the SMD's X.509 certificate. The message is then transmitted to the host PC.

| Device Audit Field Item Name | Item Length | Contents |
|---|---|---|
| Device ID | 8 | SMD device number received in INIT1 message. |
| Transaction ID | 3 | Serial number identifying this particular secure transaction. |
| Ascending Register | 6 | Ascending revenue register value. |
| Descending Register | 5 | Current descending revenue register value. |
| Transaction Date/Time | 6 | Date and time this message was created. Format is: YYyyMMDDHHmm |
| Previous Funding Revenue | 5 | Amount of postage added to the descending register during the most recent funding transaction. |
| Previous Funding Date/Time | 6 | The date and time of the most recent funding transaction. Format is: YYyyMMDDHHmm |

AUDIT3 message
Message Type Code (Hex): 0×32
Sender: host PC
Message Length (Bytes, Decimal): 53

This message is processed during an Audit transaction. This message is processed in the states indicated in Appendix C. If this message is received while in any other state, the SMD responds with an ERROR message that includes an error code of BAD_STATE.

The AUDIT3 message instructs the SMD to reset the Watchdog Timer and transition to the Registered state. The host PC sends this message to the SMD if the Device Audit field from the AUDIT2 message was verified by the system server.

The AUDIT3 message is formatted as follows:

| Byte Address | Message Field Name | Field Length | Contents |
|---|---|---|---|
| 0x0000 | Message Type Code | 1 | AUDIT3 message type code. |
| 0x0001 | Device Audit Response Field | 12 | DEVICE AUDIT RESPONSE message as specified in the USPS IBIP Open System Indicium Specification. |
| | Digital Signature | 40 | Digital signature of the Device Audit Response field, using the provider's private key. |

The Device Audit Response (DAR) field is formatted as shown in the following table. Multiple-byte data items are stored with more significant bytes in the lower order displacement positions of the field.

| Device Audit Response Field Item Name | Item Length | Contents |
|---|---|---|
| Device ID | 8 | SMD device number received in INIT1 message. |
| Transaction ID | 3 | Serial number identifying this particular secure transaction. |
| Audit Status Code | 1 | Values are TBD. Post Office will specify. |

The SMD pads the Device Audit Response field as necessary under FIPS-180, and verifies the digital signature using the provider's (e.g., Neopost) public key included in the Provider X.509 Certificate previously stored in the SMD. If the signature is not valid, the SMD responds by sending the host PC an ERROR message with an error code of SIG_INVALID and changing back to the state that was in effect when the AUDIT1 message was received.

If the signature is valid, the SMD checks the Transaction ID included in the DAR field against the Transaction ID stored in the SMD. If the IDs are not equal, the SMD responds by sending the host PC an ERROR message with an error code of TRANS_ID and changing back to the state that was in effect when the AUDIT1 message was received.

If the Transaction IDs are equal, the SMD adds the number of days stored in the SMD's watchdog increment variable (originally loaded into the SMD by the REGISTER3 message), to the date stored in the SMD's watchdog timer variable. The SMD then transitions to the Registered state and sends the host PC a STATECHG message.

AUX DATA message

Message Type Code (Hex): 0×50

Sender: SMD

Message Length (Bytes, Decimal): Variable: 3 to 131 bytes.

This message is sent by the SMD to the host PC if either the auxiliary port data buffer is full or in response to a GET AUX DATA message. It is formatted as follows:

| Byte Address | Message Field Name | Field Length | Contents |
|---|---|---|---|
| 0x0000 | Message Type Code | 1 | AUX DATA message type code. |
| | Aux Data Length | 2 | The length of data captured from the auxiliary port. |
| | Aux Port Received Data | 0 to 128 | Data captured from the auxiliary port. |

After sending this message, the SMD clears the auxiliary port buffer and begins filling it again as data arrives on the auxiliary port. See the specification for a description of how the auxiliary port is used.

Note that it is possible for this message to have a zero length data field. This is because the host PC may request the transfer of data when the buffer is empty. If this occurs, the host PC will be sent an AUX DATA message with a zero length and no data.

CHANGE PIN message

Message Type Code (Hex): 0×FD

Sender: host PC

Message Length (Bytes, Decimal): 4+m+2+n

This message is used by the SSO (Site Security Officer or Crypto-Office) to change the SSO or user Personal Identification Number (PIN) phrase. The new PIN is used in the CHECK PIN message to authenticate the role of the host PC as either the SSO or user. Before changing to the new PIN, the old PIN is first validated by the LMD.

This message is processed and is valid in any state after the SSO has been authenticated by the LMD with a CHECK PIN message. The CHANGE PIN message is formatted as follows:

| Byte Address | Message Field Name | Field Length | Contents |
|---|---|---|---|
| 0x0000 | Message Type Code | 1 | CHANGE PIN message type code. |
| 0x0001 | SSO/User Flag | 1 | Indicates the type of PIN phrase to change.<br>1 = SSO.<br>2 = User. |
| 0x0002 | Old PIN Data Length | 2 | The number of bytes to transfer in big endian, i.e. MS byte first.<br>The length is expected to be between 0 and 12 bytes, inclusive. This value may be zero the first time that the user PIN is set. |
| 0x0004 | Old PIN Phrase | 0 to Old PIN Data Length | The old PIN phrase used for authenticating the user. ASCII values are typically used for ease of data entry, although it is not reguired. |
| 0x0004 + Old length | New PIN Data Length | 2 | The number of bytes to transfer in big endian, i.e. MS byte first.<br>The length is expected to be between 0 and 12 bytes, inclusive. |
| 0x0004 + Old length + 2 | New PIN Phrase | 0 to Old PIN Data Length | The new PIN phrase to use for authenticating the user. ASCII values are typically used for ease of data entry, though it is not required. |

The LMD processes the CHANGE PIN message by confirming that the SSO. has logged on, verifying the old PIN phrase, setting the new PIN phrase, and generating and sending a PROCESS RESPONSE message to the host PC.

After issuing this command for a User PIN, the host PC logs back in again because the LMD logs out the SSO after executing this command regardless of whether it was successful.

After issuing this command for a SSO PIN, the host PC logs back in again if the command was not processed successfully. The LMD logs out the SSO after executing this command unsuccessfully. If this command is successfully processed for a SSO PIN, then the LMD remains logged in as the SSO.

CHANGE RTC message

Message Type Code (Hex): 0×43

Sender: host PC

Message Length (Bytes, Decimal): 3

The host PC sends this message to correct (small) errors in the SMD's real-time clock. This message is processed in the states indicated in Appendix C. If this message is received while in any other state, the SMD responds with an ERROR message that includes an error code of BAD_STATE.

| Byte Address | Message Field Name | Field Length | Contents |
|---|---|---|---|
| 0x0000 | Message Type Code | 1 | CHANGE RTC message type code. |
| | RTC Time Increment | 2 | Binary integer, ± 5, indicating number of hours to add to the RTC. |

Upon receipt of this message, the SMD checks the RTC Time Increment value and ensures that it is neither greater than +5 nor less than −5 hours. If the value is outside these limits, the SMD clips the value to these limits. The SMD then adds the RTC Time Increment to the SMD's real time clock. Finally, the SMD sends a RTC TIME message to the host PC to inform it that the time was changed. The SMD does not change state as a result of processing this message.

The SMD does not allow more than two RTC changes in any particular 30-day period.

CHECK PIN message

Message Type Code (Hex): 0×FC

Sender: host PC

Message Length (Bytes, Decimal): 4+n

This message is used to perform host user authentication to the LMD by means of a PIN phrase. The LMD supports two roles, a SSO role and a user role. A type field identifies the login to a particular role. The type field may also be set to a value that indicates that this command is being used only to get the current log-in state. If that type value is set as indicated in the table below, then the LMD only sends a PROCESS RESPONSE message to the host PC without any of processing the input PIN data.

The LMD processes all commands from the host PC after successful SSO PIN authentication. The INITIALIZE1, SET RTC, and CHANGE PIN message are restricted to the SSO. All other commands can be processed after successful user authentication. The GET STATUS and READ RTC messages are the SMD commands that are processed by the LMD without requiring any authentication.

This message is processed and is valid in any state. The CHECK PIN message is formatted as follows:

| Byte Address | Message Field Name | Field Length | Contents |
|---|---|---|---|
| 0x0000 | Message Type Code | 1 | CHECKPIN message type code. |
| 0x0001 | SSO/User Flag | 1 | Inidicates the type of log-in authentication.<br>1 = SSO.<br>2 = User.<br>3 = None. Gets log-in access control state by returning the PROCESS RESPONSE message to the host PC without any PIN authentication processing. |
| 0x0002 | PIN Data Length | 2 | The number of bytes to transfer in big endian, i.e., MS byte first.<br>The length is expected to be between 0 and 12 bytes, inclusive. |
| 0x0004 | Data | 0 to Data Length | The PIN phrase to use for authenticating the user. ASCII values are typically used for ease of data entry, although it is not required. |

The LMD processes the CHECK PIN message by verifying the PIN phrase based on the specified type, and generating and sending a PROCESS RESPONSE message to the host PC.

CONFIG AUX PORT message

Message Type Code (Hex): 0×53

Sender: host PC

Message Length (Bytes, Decimal): 6

The host PC sends this message in order to configure the auxiliary port. This message is processed in the states indicated in Appendix C. If this message is received while in any other state, the SMD responds with an ERROR message that includes an error code of BAD_STATE.

The CONFIG AUX PORT message is formatted as follows:

| Byte Address | Message Field Name | Field Length | Contents |
|---|---|---|---|
| 0x0000 | Message Type Code | 1 | CONFIG AUX PORT message type code. |
| | Baud Rate | 2 | ASCII: 12 => 1200 baud (default)<br>24 => 2400 baud<br>48 => 4800 baud<br>96 => 9600 baud<br>192 => 19200 baud |
| | Parity | 1 | ASCII: 0 => none<br>1 => odd<br>2 => even |
| | Stop Bits | 1 | ASCII: 1 or 2. |
| | Data bits | | ASCII: 7 or 8. |
| | Automatic Report Flag | 1 | 0xFF: Automatic Reporting Enabled<br>0x00: Automatic Reporting Disabled |
| | Buffer Limit | 2 | Values from 1 to 1024: Number of bytes in buffer to trigger an automatic report. |
| | Buffer Timeout | 2 | Minimum amount of time, in units of 10 msec periods, between automatic reports. |

The SMD processes this message by configuring the auxiliary communication port as specified in the message data. The SMD then sends an AUX STATUS message to the host PC.

If Automatic Reporting is enabled, the SMD clears the auxiliary port buffer and initializes a timer with the Buffer Timeout parameter. As data is received from the device coupled to the auxiliary port, it is stored in the buffer. If either the number of bytes in the buffer exceeds the Buffer Limit or a timeout occurs, an AUX DATA message is generated and sent to the host PC, the timeout is restarted, and the auxiliary buffer is cleared.

If Automatic Reporting is disabled, the SMD clears the auxiliary port buffer and begins receiving data. As data is received from the device coupled to the auxiliary port, it is stored in the buffer until the buffer overruns or until the host PC issues a GET AUX DATA message. When the host PC issues a GET AUX DATA message, the current contents of the buffer are sent to the host PC in an AUX DATA message and the buffer is cleared. It will then begin to accumulate data again. If the buffer fills before the host PC issues a GET AUX DATA message, the oldest data in the buffer is discarded and the most recent data is retained in the buffer (FIFO).

ENABLE AUX PORT message

Message Type Code (Hex): 0×54

Sender: host PC

Message Length (Bytes, Decimal): 13

The host PC sends this message to enable or disable the SMD's auxiliary serial port. This message is processed in the states indicated in Appendix C. If this message is received while in any other state, the SMD responds with an ERROR message that includes an error code of BAD_STATE.

The ENABLE AUX PORT message is formatted as follows.

| Byte Address | Message Field Name | Field Length | Contents |
|---|---|---|---|
| 0x0000 | Message Type Code | 1 | ENABLE AUX PORT message type code. |
| | Enable Flag | 1 | 0x00 to disable the auxiliary port, or 0xFF to enable the auxiliary port. |

The SMD processes this message by either enabling or disabling the auxiliary serial port. If the auxiliary port is enabled, the host PC may transmit data to the auxiliary device by issuing a SEND AUX DATA message and may read data from the auxiliary device by issuing a GET AUX DATA message.

The behavior of the SMD with respect to the auxiliary port depends on the state of the Automatic Reporting flag. See the CONFIG AUX PORT message for a more detailed description.

If the port is disabled, data is read from or written to the auxiliary port by the SMD.

ERROR message

Message Type Code (Hex): 0×00

Sender: SMD

Message Length (Bytes, Decimal): 4

This message is sent by the SMD to the host PC to inform the host PC that an error occurred during the last transaction. A code is sent to indicate the nature of the error, and the SMD's current state is also returned.

| Byte Address | Message Field Name | Field Length | Contents |
|---|---|---|---|
| 0x0000 | Message Type Code | 1 | ERROR message type code. |
| 0x0001 | SMD Error Code | 2 | Code number identifying the nature of the error. See table below. |
| 0x0003 | Current SMD State | 1 | A code number identifying the new state of the SMD as a result of the error. See STATECHG message for a list of state codes. |

The error codes are defined in the following table:

| Error Code Name | Error Code Number (Hex) | Description of Error |
|---|---|---|
| BAD_STATE | 0x0001 | The SMD received a message that is not appropriate for the current operating state. |
| SIG_INVALID | 0x0004 | The SMD is unable to verify the signature in the last message. |
| MSG_INVALID | 0x0005 | An invalid message has been sent to the SMD. A message is invalid if the SMD does not recognize its message type code. |
| CANNOT_FUND | 0x0006 | SMD is unable to accept a funding transaction based on current funding level or date of last funding; |
| TRANS_ID | 0x0007 | The transaction ID of the reply message did not match the transaction ID of the reguest message in a secure transaction. |
| REVENUE_ INVALID | 0x0008 | The requested revenue value is inconsistent with the SMD's allowed limits. |
| ISF | 0x0009 | Insufficient funds to generate reguested indicium. |
| FRACTIONAL | 0x000A | Cannot fund with fractional cents. |
| CONTROL | 0x000B | Control total does not compare during Funding Transaction. |
| WITHDRAW_ ERROR | 0x000C | An error occurred during the Withdrawal transaction. The Descending register is less than the Minimum Revenue to allow withdrawal. |
| RFG_ OVERFLOW | 0x0064 | The SMD is unable to process the request because it would cause a revenue register to overflow. For example, the INDICIUM1 message could cause this error if the ascending register would exceed $1 billion. |
| BAD_INDI_ DATA | 0x0070 | The SMD is unable to process the request due to a data value that would cause a binary field value in the indicium to overflow. |
| LOGIN_ INVALID | 0x0078 | The SMD is unable to process the command because the user has not been properly authenticated. |
| TAMPERED | 0x007F | The SMD is unable to process the command because it has detected a tamper condition. |

FUND1 message

Message Type Code (Hex): 0×10

Sender: host PC

Message Length (Bytes, Decimal): 6

This message instructs the SMD to begin a Funding transaction. This message is processed in the states indicated in Appendix C. If this message is received while in any other state, the SMD responds with an ERROR message that includes an error code of BAD_STATE.

If the Funding Revenue includes a non-zero value in the fractional cent position, the SMD responds by sending the host PC an ERROR message that includes an error code of FRACTIONAL.

The SMD responds to the FUND1 message by transitioning to the Funding-Intermediate state and sending the host PC a FUND2 message that includes a Postage Value Download Request (PVDR) field containing the Funding Revenue amount sent in the FUND1 message.

| Byte Address | Message Field Name | Field Length | Contents |
|---|---|---|---|
| 0x0000 | Message Type Code | 1 | FUND1 message type code. |
| | Funding Revenue | 5 | Nine BCD digits. Low order digit (fractional cents) is zero. |

FUND2 message

Message Type Code (Hex): 0×11

Sender: SMD

Message Length (Bytes, Decimal): 281

This message transmits a Postage Value Download Request (PVDR) field from the SMD to the host PC, as part of a Funding transaction. The host PC then transmits the PVDR field to the system server.

The FUND2 message is formatted as follows:

| Byte Address | Message Field Name | Field Length | Contents |
|---|---|---|---|
| 0x0000 | Message Type Code | 1 | FUND2 message type code. |
| | PVDR Field | 49 | Postage Value Download Request field, to be transmitted to the system server. |
| | Digital Signature | 40 | Signature of PVDR Field, signed using SMD's private key. |
| | SMD X.509 Certificate | 191 | The X.509 certificate that includes the SMD's public key, used to verify the digital signature. |

The SMD generates the PVDR field as shown in the following table. The Funding Revenue field is copied from the FUND 1 message previously received. Multiple-byte data items are stored with the more significant bytes in the lower displacement positions of the field. Any padding necessary under FIPS-180 for digital signature generation is added to the end of the field, and the field is signed using the SMD's private key. After signature, the field is inserted into the FUND2 message, followed by the digital signature and the SMD's X.509 certificate. The FUND2 message is then transmitted to the host PC.

The PVDR field is constructed as shown in the following table:

| Postage Value Download Request Field Item Name | Item Length | Contents |
|---|---|---|
| Device ID | 8 | SMD device number received in INIT1 message. |
| License ID | 5 | User's P.O. License number loaded in REGISTER3 message. |
| Transaction ID | 3 | ID number identifying this particular secure transaction. |
| Funding Revenue | 5 | Nine BCD digits. Last digit (fractional cents) is zero. |
| Ascending Register | 6 | Ascending revenue register value. |
| Descending Register | 5 | Descending revenue register value. |
| Transaction Date/Time | 6 | Date and time this message was created. Format is: YYyyMMDDHHmm |
| Previous Funding Revenue | 5 | Amount of revenue being requested by this funding transaction. |
| Previous Funding Date/Time | 6 | The date and time of the most recent funding transaction Format is: YYyyMMDDHHmm |

FUND3 message

Message Type Code (Hex): 0×12

Sender: host PC

Message Length (Bytes, Decimal): 62

This message is processed during a Funding transaction. It instructs the SMD to increase the value in the descending register, thereby increasing the SMD's revenue store. This message is processed in the states indicated in Exhibit C. If this message is received while in any other state, the SMD responds with an ERROR message that includes an error code of BAD_STATE.

The message includes a message type code that identifies the FUND3 message, followed by a PVD field that was sent to the host PC by the system server.

| Byte Address | Message Field Name | Field Length | Contents |
|---|---|---|---|
| 0x0000 | Message Type Code | 1 | FUND3 message type code. |
| | PVD Field | 21 | Postage Value Download field, as received from the system server. |
| | Digital Signature | 40 | Signature of this message except Message Type Code, signed using the provider's private key. |

The Postage Value Download field is formatted as follows:

| Postage Value Download Field Item Name | Item Length | Contents |
|---|---|---|
| Device ID | 8 | SMD device number received in INIT1 message. |
| Transaction ID | 3 | Serial number identifying this particular secure transaction. |
| Control Total | 6 | Ascending register plus descending register. |
| Funding Revenue | 5 | Value by which to increase the descending register. |

Upon receipt of a FUND3 message, the SMD pads the PVD field as necessary under FIPS-180, and verifies the digital signature using the provider's public key included in the Provider X.509 Certificate loaded into the SMD during the Initialization transaction. If the signature is not valid, the SMD responds by sending the host PC an ERROR message that includes an error code of SIG_INVALID and returning to the operating state it occupied at the start of the Funding transaction.

If the signature is valid, the SMD checks the Transaction ID included in the PVD field against the Transaction ID sent in the FUND2 message. If the IDs are not equal, the SMD responds by sending the host PC an ERROR message that includes an error code of TRANS_ID and returning to the operating state it occupied at the start of the Funding transaction.

If the Transaction IDs are equal, the SMD compares the value included in the Control Total with the sum of the SMD's current Ascending and Descending registers plus the value included in the Funding Revenue field of the message. If the Control Total included in the message is not equal to the sum, the SMD has already processed this finding transaction or is in some other way unsynchronized with the system server, and does not update the Descending register. The SMD sends the host PC an ERROR message that includes a CONTROL error number and then transitions to the Registered state.

If the Control Total is equal to the sum, the SMD increases the value of the internally stored Descending register, and prepares and sends a FUND4 message to the host PC. The SMD also records the Funding Revenue amount and the date and time of this Funding transaction, so it can report it as the previous values in the next Funding transaction.

FUND4 message

Message Type Code (Rex): 0×13

Sender: SMD

Message Length (Bytes, Decimal): 250

This message is sent by the SMD before transitioning to the Registered state at the end of a Funding transaction. This message transmits a Postage Value Download Status (PVDS) message to the host PC.

The FUND4 message is formatted as follows:

| Byte Address | Message Field Name | Field Length | Contents |
|---|---|---|---|
| 0x0000 | Message Type Code | 1 | FUND4 message type code. |
| | PVDS Field | 18 | Postage Value Download Status field, to be transmitted to the system server. |
| | Digital Signature | 40 | Signature of the PVDS using the SMD's private key. |
| | SMD X.509 Certificate | 191 | The X.509 certificate that includes the SMD's public key used to verify the digial signature. |

The SMD generates the PVDS field as shown in the following table. The Transaction ID from the FUND3 message is used to generate the PVDS field. Any padding necessary under FIPS-180 for digital signature generation is added to the end of the field, and the field is signed using the SMD's private key. After signature, the field is inserted into the FUND4 message, followed by the digital signature and the SMD's X.509 certificate. The FUND4 message is then transmitted to the host PC, and the SMD transitions to the Registered state.

The Postage Value Download Status field is formatted as follows:

| Postage Value Download Status Field Item Name | Item Length | Contents |
|---|---|---|
| Device ID | 8 | SMD device number received in INIT1 message. |
| Transaction ID | 3 | Serial number identifying this particular secure transaction. |
| Funding Status | 1 | Values are TBD. Post Office will specify. |
| Transaction Date/Time | 6 | Date and time the SMD completed processing the FUND3 message. Format is: YYyyMMDDHHmm |

FUND5 message

Message Type Code (Hex): 0×14

Sender: host PC

Message Length (Bytes, Decimal): 53

This message is sent to the SMD during a Funding transaction if the system server is unable to fund the SMD. This message is processed in the states indicated in Exhibit C. If this message is received while in any other state, the SMD responds with an ERROR message that includes an error code of BAD_STATE.

The message includes the Postage Value Download Error (PVDE) field as specified in the USPS publication "Information Based Indicium Program, Open System Indicium Specification" (also referred to as the USPS IBIP Open System Indicium Specification), which is incorporated herein by reference. The FUND5 message is formatted as follows:

| Byte Address | Message Field Name | Field Length | Contents |
|---|---|---|---|
| 0x0000 | Message Type Code | 1 | FUND5 message type code. |
| 0x0001 | PVDE Field | 12 | Postage Value Download Error field, as received from the system server. |
| | Digital Signature | 40 | Signature of PVDE field, signed using the provider's private key. |

The Postage Value Download Error field is formatted as follows:

| Postage Value Download Error Field Item Name | Item Length | Contents |
|---|---|---|
| Device ID | 8 | SMD device number received in INIT1 message. |
| Transaction ID | 3 | ID number from FUND1 message. |
| Funding Error Code | 1 | Values are TBD. USPS will specify. |

The Funding Error Code may include the following values.

| Code | Meaning |
|---|---|
| 0 | Insufficient funds. |

If the Funding Error Code field includes 0, the user has insufficient funds on deposit with the provider and the funding has been refused. The SMD transitions to the Registered state.

GET AUX DATA message

Message Type Code (Hex): 0×51

Sender: host PC

Message Length (Bytes, Decimal): 1

This message is sent by the host PC to obtain the current contents of the auxiliary buffer. There is no message body, only the Message Type code.

This message is processed in the states indicated in Appendix C. If this message is received while in any other state, the SMD responds with an ERROR message that includes an error code of BAD_STATE.

The SMD processes this message by sending the host PC an AUX DATA message that includes the current contents of the Auxiliary Port Receive Buffer.

GET SIGNED STATUS message

Message Type Code (Hex): 0×07

Sender: host PC

Message Length (Bytes, Decimal): 1

This message is sent by the host PC to obtain a SIGNED STATUS message from the SMD. There is only one byte in the message, namely the Message Type code.

This message is processed in the states indicated in Appendix C. If this message is received while in any other state, the SMD responds with an ERROR message that includes an error code of BAD_STATE.

The SMD processes the GET SIGNED STATUS message by generating and sending a SIGNED STATUS message to the host PC.

GET STATUS message

Message Type Code (Hex): 0×04

Sender: host PC

Message Length (Bytes, Decimal): 1

This message is sent by the host PC to obtain a STATUS message from the SMD. There is only one byte in the message, namely the Message Type code.

This message is processed in the states indicated in Appendix C. If this message is received while in any other state, the SMD responds with an ERROR message that includes an error code of BAD_STATE.

The SMD processes the GET STATUS message by generating and sending a STATUS message to the host PC.

GET VALID ID1 message

Message Type Code (Hex): 0×48

Sender: host PC

Message Length (Bytes, Decimal): 1

GET VALID ID1 message instructs the SMD to provide data that uniquely indentifies that particular SMD This message is processed in the states indicated in Appendix C. If this message is received while in any other state, the SMD responds with an ERROR message that includes an error code of BAD_STATE. The SMD processes the message by sending a GET VALID ID2 message to the host PC.

GET VALID ID2 message

Message Type Code (Hex): 0×49

Sender: SMD

Message Length (Bytes, Decimal): 249

The SMD sends this message to the host PC in response to receipt of a GET VALID ID1 message.

| Byte Address | Message Field Name | Field Length | Contents |
|---|---|---|---|
| 0x0000 | Message Type Code | 1 | GET VALID ID2 message type code. |
| | Signed ID Data Field | 17 | Signed data, described in the table below. |
| | Signature | 40 | Signature of Signed ID Data field using the SMD's private key |
| | SMD X.509 Certificate | 191 | The X.509 certificate that includes the SMD's public key used to verify the digital signature. |

The Signed ID Data Field is defined below:

| Signed ID Data Field Item Name | Item Length | Contents |
|---|---|---|
| Reserved | 1 | Set to 00 |
| Device ID | 8 | SMD device number received in INIT1 message. |
| License ID | 5 | User's P.O License number loaded in REGISTER3 message. |
| Algorithm Flag | 1 | DSA = 1 |
| Reserved | 1 | Set to 00 |
| Request Purpose ID | 1 | Set to same value as GET VALID ID1 message code (0x48) |

GET X.509 CERTIFICATE message

Message Type Code (Hex): 0×0B

Sender: host PC

Message Length (Bytes, Decimal): 2

This message is sent by the host PC to request a CERTIFICATE message from the SMD. This message is processed in the states indicated in Appendix C. If this message is received while in any other state, the SMD responds with an ERROR message that includes an error code of BAD_STATE.

| Byte Address | Message Field Name | Field Length | Contents |
|---|---|---|---|
| 0x0000 | Message Type Code | 1 | GET X.509 CERTIFICATE message type code. |
| | Certificate ID | 1 | Certificate identification number. |
| | Signature | 40 | Signature of the Certificate ID using the SMD's private key. |
| | SMD X.509 Certificate | 191 | The X.509 certificate that includes the SMD's public key used to verify the digital signature. |

The Certificate ID numbers are defined below:

| Certificate Name | Code Number (Hex) | Description of Certificate |
|---|---|---|
| SMD | 0x01 | SMD X.509 Certificate |
| Provider | 0x02 | Provider X.509 Certificate |
| USPS | 0x03 | USPS X.509 Certificate |
| CA | 0x04 | CA X.509 Certificate |

The SMD processes this message by sending the requested certificate to the host PC in an X.509 CERTIFICATE message.

INDICIUM1 message

Message Type Code (Hex): 0×36

Sender: host PC

Message Length (Bytes, Decimal): 20

This message instructs the SMD to generate an indicium and send it to the host PC. This message is processed in the states indicated in Appendix C. If this message is received while in any other state, the SMD responds with an ERROR message that includes an error code of BAD_STATE.

The SMD processes the INDICIUM1 message by checking the Indicium Revenue in the message against its internally stored registers as follows:

1. The Indicium Revenue field is greater than or equal to the Minimum Postage value loaded into the SMD during the last Registration transaction. If this criterion is not met, the SMD responds to the INDICIUM1 message with an ERROR message that includes an error code of REVENUE_INVALID.
2. The Indicium Revenue field is less than or equal to the Maximum Postage value loaded into the SMD during the last Registration transaction. If this criterion is not met, the SMD responds to the INDICIUM1 message with an ERROR message that includes an error code of REVENUE_INVALID.
3. The Descending register is greater than or equal to the Indicium Revenue field in the INDICIUM1 message. If this criterion is not met, the SMD responds to the INDICIUM1 message with an ERROR message that includes an error code of ISF.

If all of the above conditions are met, the SMD deducts the Indicium Revenue amount from the Descending register and adds the Indicium Revenue amount to the Ascending register. After performing these operations, the SMD generates and sends an INDICIUM2 message to the host PC.

INDICIUM2 message

Message Type Code (Hex): 0×37

Sender: SMD

Message Length (Bytes, Decimal): 288

The SMD sends this message to the host PC in reply to an INDICIUM1 message. This message includes the indicium, generated and signed by the SMD, which includes the amount of revenue requested in the INDICIUM1 message.

The SMD sends an INDICIUM2 message if an INDICIUM1 message was received and properly processed.

| Byte Address | Message Field Name | Field Length | Contents |
|---|---|---|---|
| 0x0000 | Message Type Code | 1 | INDICIUM1 message type code. |
| | Indicium Revenue | 3 | BCD encoded revenue amount to include in indicium. Low order digit is fraction cents. |
| | Destination ZIP Code | 6 | Data to include in the indicium (destination zip code). |
| | Rate Category | 4 | Selected Postage class, as ASCII code |
| | Software ID | 6 | SMD software identification number, BCD encoded. |

| Byte Address | Message Field Name | Field Length | Contents |
|---|---|---|---|
| 0x0000 | Message Type Code | 1 | INDICIUM2 message type code. |
| | Signed Indicium Field | 56 | Signed Indicium data as defined below. |
| | Digital Signature | 40 | Signature of the indicium field, signed using the SMD's private key. |
| | SMD X.509 Certificate | 191 | The X.509 certificate the includes the SMD's public key used to verify the digital signature. |

The SMD generates the Signed Indicium field using the fields from the INDICIUM1 message previously received. The Ascending register and Descending register values are obtained from the SMD memory after accounting for the Indicium Revenue. Any padding necessary under FIPS-180 for digital signature generation is added to the end of the field, and the field is signed using the SMD's private key. After signature, the field is inserted into the INDICIUM2 message, followed by the digital signature and the SMD X.509 certificate. The INDICIUM2 message is then transmitted to the host PC.

The Signed Indicium field is formatted as follows:

| Indicium Field Item Name | Item Length | Contents |
|---|---|---|
| Indicium Version Number | 1 | TBD |
| Signature / Algorithm Flag | 1 | 0x00, indicating DSA signature |
| Certificate Serial Number | 4 | TBD |
| Device ID | 8 | SMD device number received in INIT1 message. |
| Ascending Register | 6 | Contents of SMD's Ascending register |
| Indicium Revenue | 3 | Amount copied from INDICIUM1 message |
| Transaction Date/Time | 6 | Date that indicium was signed. Format is: YYyyMMDDHHmm |
| Licensing ZIP Code | 6 | 1 digit purpose code and 11 digit ZIP code, BCD encoded. Value from the REGISTER3 message. |
| Destination ZIP Code | 6 | From the INDICIUM1 message |
| Software ID | 6 | SMD software identification number, BCD encoded. |
| Descending Register | 5 | Descending revenue register value. |
| Rate Category | 4 | Selected Postage class (ASCII code) from the INDICIUM1 message |

INIT1 message

Message Type Code (Hex): 0×20

Sender: host PC

Message Length (Bytes, Decimal): 553

This message instructs the SMD to begin an Initialization transaction. An Initialization transaction causes the SMD to initialize itself. Initialization is performed during final testing at the factory.

This message is processed in the states indicated in Appendix C. If this message is received while in any other state, the SMD responds with an ERROR message that includes an error code of BAD_STATE.

| Byte Address | Message Field Name | Field Length | Contents |
|---|---|---|---|
| 0x0000 | Message Type Code | 1 | INIT1 message type code. |
| | Init Data Field | 512 | Initialization data field described below, signed using the provider's private key. |
| | Digital Signature | 40 | Signature of above Init Data field using the provider's private key. SMD validates signature using the provider's public key included in the Provider X.509 Certificate. |

The Init Data Field is formatted as shown below.

| Field ID | Init Data Field Item Name | Item Length | Contents |
|---|---|---|---|
| SIT1b | Device ID | 8 | Identification number to be used in indicium creation. |
| SIT1c | Software ID | 6 | |
| SIT1d | Provider X.509 Certificate | 498 | The X.509 Certificate that includes the provider's public key. |

Upon receipt of an INIT1 message, the SMD pads the Init Data field as necessary under FIPS-180, and verifies the digital signature using the provider's public key included in the Provider X.509 Certificate, which is included in the Init Data field itself. If the signature is not valid, the SMD responds by sending the host PC an ERROR message with an error code of SIG_INVALID.

If the signature verifies, the SMD internally stores the values included in the Init Data field. The SMD then proceeds to generate its own private/public key pair. After generating the key pair, the SMD generates and sends an INIT2 message to the host PC.

INIT2 message

Message Type Code (Hex): 0×21

Sender: SMD

Message Length (Bytes, Decimal): 169

This message is sent by the SMD to the host PC to acknowledge the proper execution of an INIT1 message.

The INIT2 message is formatted as follows:

| Byte Address | Message Field Name | Field Length | Contents |
|---|---|---|---|
| 0x0000 | Message Type Code | 1 | INIT2 message type code. |
| 0x0001 | SMD Public Key | 128 | The SMD's public key to be transmitted to the system server. |
| | Digital Signature | 40 | Signature of the SMD's public key using the SMD's private key. The system server use SMD public key to validate the digital signature. |

PROCESS RESPONSE message

Message Type Code (Hex): 0×FE

Sender: SMD

Message Length (Bytes, Decimal): 4

This message is sent by the LMD to the host PC to inform the host PC of the completion status corresponding to the last CHECK PIN or CHANGE PIN message. A process completion code is returned, along with the SMD's current state.

| Byte Address | Message Field Name | Field Length | Contents |
|---|---|---|---|
| 0x0000 | Message Type Code | 1 | PROCESS RESPONSE message type code. |
| 0x0001 | LMD Process Status | 1 | Code number identifying the status from the last CHECK PIN or CHANGE PIN command. See table below. |
| 0x0002 | Current Log-in State | 1 | A code number identifying the current log-in state of the LMD. See table below. |
| 0x0003 | Current SMD State | 1 | A code number identifying the current state of the SMD. See STATECHG message for a list of state codes. |

The LMD process status codes are defined in the following table:

| Process Status | Process Status Number (Hex) | Description of Error |
|---|---|---|
| LMD_RSP_CMD_OK | 0x00 | The LMD completed the command successfully. |
| LMD_RSP_CMD_FAILED | 0x01 | The LMD failed to process the command. For example, an incorrect PIN may have been entered. |
| LMD_RSP_PROC_ERROR | 0x02 | A processing error occurred while the LMD was executing the command. |
| LMD_RSP_BAD_DATA | 0x03 | The input command message included invalid data. |
| LMD_RSP_INV_STATE | 0x04 | The input command was not processed due to the current state of the LMD. |

The LMD log-in state codes are defined in the following table:

| Process Status | Log-in State Number (Hex) | Description of Error |
|---|---|---|
| LMD_RSP_NOT_LOGGED_IN | 0x00 | The LMD completed the command successfully. |
| LMD_RSP_SSO_LOGGED_IN | 0x01 | The LMD has received a successful SSO CHECK PIN message. |
| LMD_RSP_USER_LOGGED_IN | 0x02 | The LMD has received a successful user CHECK PIN message. |

PWITHDRAW1 message

Message Type Code (Hex): 0×22

Sender: host PC

Message Length (Bytes, Decimal): 1

This message is sent to the SMD to initiate a Withdrawal transaction. The Message Type code is the only data.

This message is processed in the states indicated in Appendix C. If this message is received while in any other state, the SMD responds with an ERROR message that includes an error code of BAD_STATE.

The SMD processes this message if the amount in the Descending register is less than the Minimum Revenue amount. If the value of the Descending register is greater than or equal to the Minimum Revenue, the SMD sends the host PC an ERROR message that includes an error code of WITHDRAW_ERROR. The user prints indicia until the Descending register is less than the Minimum Revenue before a Withdrawal Transaction can be performed.

If the Descending register is less than the Minimum Revenue, the SMD processes the PWITHDRAW1 by sending a PWITHDRAW2 message to the host PC.

PWITHDRAW2 message

Message Type Code (Hex): 0×23

Sender: SMD

Message Length (Bytes, Decimal): 64

This message is sent to the host PC in response to a PWITHDRAW1 message. The PWITHDRAW2 message is formatted as follows:

| Byte Address | Message Field Name | Field Length | Contents |
|---|---|---|---|
| 0x0000 | Message Type Code | 1 | PWITHDRAW2 message type code. |
| | Withdrawal Data Field | 23 | Data field as formatted in the table below. |
| | Digital Signature | 40 | Signature of above fields (excluding the message type code) using the SMD's private key |

The SMD generates a Withdrawal Data field as shown in the table below. The field is padded as necessary according to FIPS-180, and is signed using the SMD's private key. After generating the signature, the field is inserted into the PWITHDRAW2 message, followed by the digital signature. The message is the transmitted to the host PC, and the SMD transitions to the Withdrawal-Intermediate State.

The Withdrawal Data field is formatted as follows:

| Withdrawal Data Field Item Name | Item Length | Contents |
|---|---|---|
| Device ID | 8 | SMD device number received in INIT1 message. |
| Descending Register | 5 | Descending revenue register value. |
| Control Total | 6 | Ascending register plus Descending register. The low order digit represents fractional cents. |
| Non-Zero Cycle Counter | 4 | Count of non-zero indicia printed since the SMD was last registered. |

REGISTER1 message

Message Type Code (Hex): 0×38

Sender: host PC

Message Length (Bytes, Decimal): 276

This message is sent to the SMD to begin a Registration transaction. It requests the SMD to accept parameters that register its use for a particular provider customer. It also transmits the SMD X.509 certificate to the SMD.

This message is processed in the states indicated in Appendix C. If this message is received while in any other state, the SMD responds with an ERROR message that includes an error code of BAD_STATE.

The SMD pads the SMD X.509 Certificate field as necessary under FIPS-180, and verifies the digital signature using the provider's public key included in the Provider X.509 Certificate loaded during the Initialization transaction. If the signature is not valid, the SMD responds by sending the host PC an ERROR message with an error code of SIG_INVALID and remaining in the Initialized state.

If the signature is valid, the SMD stores the SMD X.509 certificate in internal memory, generates a REGISTER2 message, and sending the message to the host PC. After sending the REGISTER2 message, the SMD transitions to the Register-Intermediate state.

REGISTER2 message

Message Type Code (Hex): 0×39

Sender: SMD

Message Length (Bytes, Decimal): 49

This message is part of the Registration transaction. It is sent to the host PC upon successful verification of the signature on the previously received REGISTER1 message.

This message is processed in the states indicated in Appendix C. If this message is received while in any other state, the SMD responds with an ERROR message that includes an error code of BAD_STATE.

The format of the REGISTER2 message is shown below:

| Byte Address | Message Field Name | Field Length | Contents |
|---|---|---|---|
| 0x0000 | Message Type Code | 1 | REGISTER1 message type code. |
| | SMD X.509 Certificate | 191 | Certificate generated by the system server. The SMD includes this centificate in each indicium. |
| | Digital Signature | 40 | Digital signature of the SMD X.509 Certificate, using the provider's private key. |

| Byte Address | Message Field Name | Field Length | Contents |
|---|---|---|---|
| 0x0000 | Message Type Code | 1 | REGISTER2 message type code. |
| | Device ID | 8 | SMD device number received in INIT1 message. |
| | Digital Signature | 40 | Signature of Device ID only using the SMD's private key |

The SMD pads the Device ID field as necessary under FIPS-180, and generates a digital signature using the SMD's private key. The Device ID and the signature are loaded into the REGISTER2 message and sent to the host PC. The SMD then transitions to the Registered-Intermediate state.

REGISTER3 message

Message Type Code (Hex): 0×3A

Sender: host PC

Message Length (Bytes, Decimal): 566

The REGISTER3 message is sent by the host PC to the SMD during the Registration transaction. This message is processed in the states indicated in Appendix C. If this message is received while in any other state, the SMD responds with an ERROR message that includes an error code of BAD_STATE.

The REGISTER3 message is formatted as follows:

| Byte Address | Message Field Name | Field Length | Contents |
|---|---|---|---|
| 0x0000 | Message Type Code | 1 | REGISTER3 message type code. |
| | Register3 Data Field | 525 | Signed data, described in table below. |
| | Digital Signature | 40 | Signature of Register3 Data Field using provider's private key. |

The Register3 Data field is formatted as shown in the following table.

| Register3 Data Field Item Name | Item Length | Contents |
|---|---|---|
| Account Number | 8 | User's Account Number |
| License ID | 5 | 10 digit BCD encoded number. |
| Licensing ZIP Code | 6 | 1 digit purpose code and 11 digit ZIP code, BCD encoded. |
| Maximum Postage | 3 | Maximum postage that can be printed in one indicium. Field to be BCD encoded with fractional cents in lowest order digit. |
| Minimum Postage | 3 | Minimum postage (other than zero) that can be printed in one indicium. Field to be BCD encolded with fractional cents in lowest order digit. |
| Watchdog Increment | 2 | Number of days between inspection time-outs. |
| USPS X.509 Certificate | 498 | Certificate that includes the USPS's public key to used in verification of signature in transactions with the provider. |

Upon receipt of an REGISTER3 message, the SMD pads the Register3 Data field as necessary under FIPS-180 and verifies the digital signature using the provider's public key included in the Provider X.509 Certificate loaded by the INIT1 message. If the signature is not valid, the SMD responds by sending the host PC an ERROR message that includes an error code of SIG_INVALID and changing to the Initialized state.

If the signature is valid, the SMD stores all items in the Register3 Data field into the appropriate form of SMD memory for further use. The SMD then transitions to the Registered state and sends a STATECHG message to the host PC.

REGISTER4 message

Message Type Code (Hex): 0×3B

Sender: host PC

Message Length (Bytes, Decimal): 259

The REGISTER4 message is used to change registration information in the SMD. This message is processed in the states indicated in Appendix C. If this message is received while in any other state, the SMD responds with an ERROR message that includes an error code of BAD_STATE.

Upon receipt, the SMD verifies the digital signature and if valid, stores the information included in the Register4 Data field in the SMD's non-volatile memory. The SMD signifies proper processing of this message by sending the host PC a: STATECHG message the Registered state number in both the previous and current state.

If the signature does not verify, the SMD sends the host PC an ERROR message that includes an error code of SIG_INVALID.

| Byte Address | Message Field Name | Field Length | Contents |
|---|---|---|---|
| 0x0000 | Message Type Code | 1 | REGISTER4 message type code. |
| | Register4 Data Field | 218 | Signed data, described in table below. |
| | Digital Signature | 40 | Signature of Register4 Data Field using the provider's private key |

The Register4 Data Field is formatted as follows:

| Register4 Data Field Item Name | Item Length | Contents |
|---|---|---|
| Account Number | 8 | User's Account Number |
| License ID | 5 | User's P.O. License number loaded in REGISTER3 message. |
| Licensing ZIP Code | 6 | 1 digit purpose code and 11 digit ZIP code, BCD encoded. |
| Maximum Postage | 3 | Maximum postage that can be printed in one indicium. Field to be BCD encoded with fraction cents in lowest order digit. |
| Minimum Postage | 3 | Minimum postage (other than zero) that can be printed in one indicium. Field to be BCD encoded with fractional cents in lowest order digit. |
| Watchdog Increment | 2 | Number of days between inspection time-outs. |
| Reserved | 191 | |

READ RTC message

Message Type Code (Hex): 0×41

Sender: host PC

Message Length (Bytes, Decimal): 1

This message is sent to the SMD to read the Real Time Clock. The message code is the only data.

This message is processed in the states indicated in Appendix C. If this message is received while in any other state, the SMD responds with an ERROR message that includes an error code of BAD_STATE.

The SMD processes the READ RTC by sending a RTC TIME message to the host PC.

RTC TIME message

Message Type Code (Hex): 0×40

Sender: SMD

Message Length (Bytes, Decimal): 9

This message is sent to the host PC in response to a READ RTC, CHANGE RTC, or SET RTC message. The RTC TIME message is formatted as follows:

| Byte Address | Message Field Name | Field Length | Contents |
|---|---|---|---|
| 0x0000 | Message Type Code | 1 | RTC TIME message type code. |
| 0x0001 | Current Date/Time | 8 | BCD encoded date and time. Format is: YYyyMMDDHHmmSSTT |

SEND AUX DATA message

Message Type Code (Hex): 0×52

Sender: host PC

Message Length (Bytes, Decimal): Variable: 4 to 131

This message is sent by the host PC to transmit data to the SMD's auxiliary port. This message is processed in the states indicated in Appendix C. If this message is received while in any other state, the SMD responds with an ERROR message that includes an error code of BAD_STATE.

The SEND AUX DATA message is formatted as follows:

| Byte Address | Message Field Name | Field Length | Contents |
|---|---|---|---|
| 0x0000 | Message Type Code | 1 | SEND AUX DATA message type code. |
| | Length of Data | 2 | The length of data string to be sent to the SMD's auxiliary port. |
| | Auxiliary Port Data Field | Variable: 1 to 128 | Data to be transferred to the SMD's auxiliary port. |

The SMD processes this message by transmitting the contents of the Auxiliary Port Data field to the device coupled to the auxiliary port.

SET RTC message

Message Type Code (Hex): 0×42

Sender: host PC

Message Length (Bytes, Decimal): 9

The host PC sends this message to the SMD while the SMD is in the factory during the initialization process. The purpose of this message is to initialize the SMD's real-time clock.

This message is processed in the states indicated in Appendix C. If this message is received while in any other state, the SMD responds with an ERROR message that includes an error code of BAD_STATE.

The SET RTC message is formatted as follows:

| Byte Address | Message Field Name | Field Length | Contents |
|---|---|---|---|
| 0x0000 | Message Type Code | 1 | SET RTC message type code. |
| 0x0001 | Current Date/Time | 8 | BCD encoded date and time. Format is: YYyyMMDDHHmmSSTT |

If this message was properly received, the SMD sets its real time clock to the date and time indicated in the message. The SMD then sends a RTC TIME message to the host PC.

SIGNED STATUS message

Message Type Code (Hex): 0×08

Sender: SMD

Message Length (Bytes, Decimal): 87

This message is sent to the host PC in response to a GET SIGNED STATUS message. It is formatted as follows:

| Byte Address | Message Field Name | Field Length | Contents |
|---|---|---|---|
| 0x0000 | Message Type Code | 1 | STATUS message type code. |
| | Signed Status Field | 46 | SMD's identification number. |
| | Digital Signature | 40 | Signature of Signed Status field using the SMD's private key |

The SMD assembles a Signed Status field as shown in the following table. The current Transaction ID is used to generate the Signed Status field. Any padding necessary under FIPS-180 for digital signature generation is added to the end of the field, and the field is signed using the SMD's private key. After signature, the field is inserted into the GET SIGNED STATUS message, and the message is transmitted to the host PC.

The Signed Status field is formatted as shown below.

| Signed Status Field Item Name | Item Length | Contents |
|---|---|---|
| Device ID | 8 | SMD device number received in INIT1 message. |
| Current SMD State | 1 | A code number identifying the current state of the SMD. See STATECHG message for a list of state codes. |
| Ascending Register | 6 | Secure revenue register. Contents are incremented by amount of postage printed on each transaction. |
| Descending Register | 5 | Secure revenue register. Represents the amount of money contained in meter. Contents are decremented by amount of postage printed on each transaction. |
| Non-zero Piece Count | 4 | Non-zero Print cycle count, Dword. |
| SMD Software Model | 2 | SMD Software Model. Three BCD digits. |
| Vendor ID | 2 | Provider ID, 3 BCD digits. |
| Licensing ZIP Code | 6 | 1 digit purpose code and 11 digit ZIP code, BCD encoded. |
| License ID | 5 | User's P.O. License number loaded in REGISTER3 message. |
| Init Date | 8 | Date of SMD Initialization. Format is: YYyyMMDDHHmmSSTT |
| Transaction ID | 3 | POC/Resetting System Transaction count |

STATECHG message

Message Type Code (Hex): 0×01

Sender: SMD

Message Length (Bytes, Decimal): 3

The SMD sends this message to the host PC when the SMD transitions from one state to another according to the state diagrams included in this specification. This message is also sent at the completion of certain transactions if the state does not change, as a confirmation to the host PC that the transaction was completed. The STATECHG message is formatted as follows.

| Byte Address | Message Field Name | Field Length | Contents |
|---|---|---|---|
| 0x0000 | Message Type Code | 1 | STATECHG message type code. |
| 0x0002 | Previous SMD State | 1 | A code number identifying the previous operating state of the SMD. See table below. This number identifies the state that the SMD is transitioning from. |
| 0x0003 | Current SMD State | 1 | A code number identifying the current operating state of the SMD. See table below. This number identifies the state that the SMD is transitioning to. |

The state codes are defined in the following table:

| State Name | Code Number (Hex) | Description of State |
|---|---|---|
| Uninitialized | 0x01 | BAM CRC does not check. Newly manufactured SMDs come up in this state. |
| Initialized | 0x02 | SMD has been initialized Can dispense a default zero-revenue indicium. |
| Registered | 0x03 | Newly registered SMD or an SMD that has run its descending register below the minimum value. Dispenses a zero revenue indicium using user data. |
| Timed-out | 0x04 | Watchdog Timer has expired. SMD executes an Audit transaction to confinue further normal operation. SMD returns to the Registered state after the Audit transaction. |
| | 0x05 | Not used. |
| | 0x06 | Not used. |
| Faulted | 0x07 | A security threat has been detected. SMD does not dispense revenue and only responds to the Status and Inspection transactions. |

STATUS message

Message Type Code (Hex): 0×05

Sender: SMD

Message Length (Bytes, Decimal): 71

This message is sent to the host PC in response to a GET STATUS message.

| Byte Address | Message Field Name | Field Length | Contents |
|---|---|---|---|
| 0x0000 | Message Type Code | 1 | STATUS message type code. |
| | Device ID | 8 | SMD's identification number. |
| | Watchdog Timer | 8 | BCD encoded date and time. Format is: YYyyMMDDHHmmSSTT |
| | Current SMD State | 1 | A code number identifying the current operating state of the SMD. See STATECHG message for a list of state codes. |
| | Pending Transaction | 1 | A bit-field indicating any pending transactions. More than one bit may be set concurrently to indicate multiple pending transactions. Bit 0 is the least significant bit, and if it were the only bit set word represent a byte value of 0x01. All bits = 0 = No pending transaction, Bit 0 = 1 = Funding transaction pending Audit for completion. |
| | Maximum Postage | 3 | Maximum postage that can be printed in one indicium. Field to be BCD encoded with fractional cents in the lowest order digit. |
| | Minimum Postage | 3 | Minimum postage that can be printed in one indicium. Field to be BCD encoded with fraction cents in the lowest order digit. |
| | Ascending Register | 6 | Secure revenue register. Contents are incremented by amount of postage printed on each transaction. |
| | Descending Register | 5 | Secure revenue register. Represents the amount of money contained in the SMD. Contents are decremented by amount of postage printed on each Indicium transaction. |
| | Non-zero Piece Count | 4 | Non-zero Print cycle count. Unsigned 4 bytes or Dword. |
| | Current Date/Time | 8 | BCD encoded current date and time. Format is: YYyyMMDDHHmmSSTT |
| | SMD Software Model | 2 | SMD Software Model. Three BCD digits. |
| | Vendor ID | 2 | Provider ID, 3 BCD digits. |
| | Licensing Zip Code | 6 | 1 digit purpose code and 11 digit ZIP code, BCD encoded. |
| | Init Date | 8 | Date of SMD Initilization. Format is: YYyyMMDDHHmmSSTT |
| | License ID | 5 | User's P.O. License number loaded in the REGISTER3 message. |

USER INFO1 message

Message Type Code (Rex): 0×70

Sender: host PC

Message Length (Bytes, Decimal): 198

The USER INFO1 and USER INFO2 messages are used to obtain the SMD's signature on specific user data. The user enters the data at the host PC and the host PC sends the data to the SMD for signature in a USER INFO1 message. The SMD adds some of its own information (to prevent fraud), signs the data and returns it to the host PC in a USER INFO2 message. These messages are generally used before performing a Registration transaction.

The SMD processes a USER INFO1 message by adding certain SMD data items to the items included in the message, signing the result, and sending it back to the host PC in the form of a USER INFO2 message.

This message is processed in the states indicated in Appendix C. If this message is received while in any other state, the SMD responds with an ERROR message that includes an error code of BAD_STATE.

The USER INFO1 is formatted as follows.

| Byte Address | Message Field Name | Field Length | Contents |
|---|---|---|---|
| 0x0000 | Message Type Code | 1 | USER INFO1 message type code. |
| | Customer Name | 32 | ASCII Customer Name string, trailing NULL padded. |

-continued

| Byte Address | Message Field Name | Field Length | Contents |
|---|---|---|---|
| | Customer Address Line 1 | 40 | ASCII Street Number and Name string, trailing NULL padded. |
| | Customer Address Line 2 | 40 | ASCII City, State string, trailing NULL padded. |
| | Credit Card Number | 30 | ASCII string, trailing NULL padded. |
| | Credit Card Type | 2 | "0" if using Direct Debit |
| | Direct Debit Account Number | 17 | |
| | Direct Debit Account Type | 1 | "0" if using Credit Card |
| | Meter License | 5 | |
| | Software License | 10 | Provider License Number |
| | Customer Account Number | 8 | "0" if new customer |
| | Credit Card Expiration Date | 4 | ASCII string, trailing NULL padded. |
| | Meter Lease Number | 4 | |
| | Direct Debit Routing Number | 4 | |

USER INFO2 message

Message Type Code (Rex): 0×71

Sender: SMD

Message Length (Bytes, Decimal): 284

In response to the USER INFO1 message, the SMD adds information to the information received from the host PC, signs the information with the SMD's private key, and sends it to the host PC in a USER INFO2 message.

The USER INFO2 message is formatted as follows:

| Byte Address | Message Field Name | Field Length | Contents |
|---|---|---|---|
| 0x0000 | Message Type Code | 1 | USER INFO2 message type code. |
| | Customer Name | 32 | (supplied in the USER INFO1 message) |
| | Customer Address Line 1 | 40 | Street Number and Name (supplied in USER INFO1) |
| | Customer Address Line 2 | 40 | City, State (supplied in the USER INFO1 message) |
| | Credit Card Number | 30 | (supplied in the USER INFO1 message) |
| | Credit Card Type | 2 | "0" if using Direct Debit (supplied in the USER INFO1 message) |
| | Direct Debit Account Number | 17 | (supplied in the USER INFO1 message) |
| | Direct Debit Account Type | 1 | "0" if using Credit Card (supplied in the USER INFO1 message) |
| | Meter License | 10 | ASCII representation of value supplied in the USER INFO1 message |
| | Software License | 10 | (supplied in the USER INFO1 message) |
| | Device ID | 8 | SMD device number received in INIT1 message. |
| | Transaction ID | 3 | |
| | Customer Account Number | 8 | (supplied in the USER INFO1 message) |

-continued

| Byte Address | Message Field Name | Field Length | Contents |
|---|---|---|---|
| | Credit Card Expiration Date | 4 | (supplied in the USER INFO1 message) |
| | Licensing ZIP Code | 6 | 1 digit purpose code and 11 digit ZIP code, BCD encoded. |
| | Descending Register | 5 | Descending revenue register value. |
| | Control Total | 6 | Ascending register plus descending register. The low order digit represents fractional cents. |
| | Init Date | 8 | Format is: YYyyMMDDHHmmSSTT |
| | New Meter Type | 1 | Constant 0x00 |
| | Cycle Counter | 4 | Count of indicia printed since registration. |
| | Meter Lease Number | 4 | (supplied in the USER INFO1 message) |
| | Direct Debit Routing Number | 4 | (supplied in the USER INFO1 message) |
| | Digital Signature | 40 | Signature of all fields listed except the Message Type code using the SMD's private Key |

USER INFO3 message

Message Type Code (Hex): 0×72

Sender: host PC

Message Length (Bytes, Decimal): 194

The USER INFO3 and USER INFO4 messages have the same purpose as the USER INFO1 and USER INFO2 messages, but are used in the context of Update Registration instead of Registration.

If the USER INFO3 message is received by the SMD, the SMD temporarily saves the information included in the message and uses it to generate a USER INFO4 message.

This message is processed in the states indicated in Appendix C. If this message is received while in any other state, the SMD responds with an ERROR message that includes an error code of BAD_STATE.

The USER INFO3 message is formatted as follows:

| Byte Address | Message Field Name | Field Length | Contents |
|---|---|---|---|
| 0x0000 | Message Type Code | 1 | USER INFO3 message type code. |
| | Customer Name | 32 | |
| | Customer Address Line 1 | 40 | Street Number and Name |
| | Customer Address Line 2 | 40 | City, State |
| | Credit Card Number | 30 | |
| | Credit Card Type | 2 | "0" if usin direct debit |
| | Direct Debit Account Number | 17 | |
| | Direct Debit Account Type | 1 | "0" if using credit card |
| | Meter License | 5 | |
| | Software License | 10 | Provider License Number |
| | Customer Account Number | 8 | "0" if new customer |
| | Credit Card Expiration Date | 4 | |
| | Direct Debit Routing Number | 4 | |

USER INFO4 message

Message Type Code 0×73

(Hex):

Sender: SMD

Message Length (Bytes, 256 Decimal):

In response to the USER INFO3 message, the SMD adds information to the information received from the host PC, signs the information with the SMD's private key, and sends it to the host PC in a USER INFO4 message.

The USER INFO4 message is formatted as follows:

| Byte Address | Message Field Name | Field Length | Contents |
|---|---|---|---|
| 0x0000 | Message Type Code | 1 | USER INFO4 message type code. |
| | Customer Name | 32 | |
| | Customer Address Line 1 | 40 | |
| | Customer Address Line 2 | 40 | |
| | Credit Card Number | 30 | |
| | Credit Card Type | 2 | |
| | Direct Debit Account Number | 17 | |
| | Direct Debit Account Type | 1 | |
| | Meter License | 10 | ASCII representation of input from the USER INFO3 message |
| | Software License | 10 | Provider License Number |
| | Device ID | 8 | SMD device number received in INIT1 message. |
| | Transaction ID | 3 | |
| | Customer Account Number | 8 | "0" if new customer |
| | Credit Card Expiration Date | 4 | |
| | Licensing ZIP Code | 6 | 1 digit purpose code and 11 digit ZIP code, BCD encoded. |
| | Direct Debit Routing Number | 4 | |
| | Digital Signature | 40 | Signature of the above fields (except the Message Type code) using the SMD's private key. |

WITHDRAW1 message

Message Type Code (Hex): 0×3C

Sender: host PC

Message Length (Bytes, Decimal): 1

The WITHDRAW1 message is processed in the states indicated in Appendix C. If this message is received while in any other state, the SMD responds with an ERROR message that includes an error code of BAD_STATE.

The SMD processes this message if the amount in the Descending register is less than the Minimum Revenue amount. If the value of the Descending register is greater than or equal to the Minimum Revenue, the user prints indicia until the Descending register is less than the Minimum Revenue before a Withdrawal transaction can be performed.

The host PC sends this message to the SMD to initiate a Withdrawal transaction. The Withdrawal transaction is used to remove the SMD from service.

The WITHDRAW1 message is formatted as follows.

| Byte Address | Message Field Name | Field Length | Contents |
|---|---|---|---|
| 0x0000 | Message Type Code | 1 | WITHDRAW1 message type code. |

WITHDRAW2 message

Message Type Code (Hex): 0×3D

Sender: SMD

Message Length (Bytes, Decimal): 63

This message is sent to the host PC in response to a WITHDRAW1 message.

The WITHDRAW2 message is formatted as follows:

| Byte Address | Message Field Name | Field Length | Contents |
|---|---|---|---|
| 0 × 0000 | Message Type Code | 1 | WITHDRAW2 message type code. |
| | Withdrawal Data Field | 22 | Data field as formatted in the table below. |
| | Digital Signature | 40 | Signature of above fields (excluding the message type code) using the SMD's private key |

The SMD generates a Withdrawal Data field as shown in the table below. The current contents of the Ascending register, Descending register, and Transaction ID are used to construct the field. Any padding necessary under FIPS-180 for digital signature is added to the end of the field, and the field is signed using the SMD's private key. After signature, the field is inserted into the WITHDRAW2 message, followed by the digital signature.

The Withdrawal Data field is formatted as follows:

| Withdrawal Data Field Item Name | Item Length | Contents |
|---|---|---|
| Device ID | 8 | SMD device number received in INIT1 message. |
| Transaction ID | 3 | Current value of the Transaction ID number. |
| Ascending Register | 6 | Current value of the Ascending register. |
| Descending Register | 5 | Current value of the Descending register. |

X.509 CERTIFICATE message

Message Type Code (Hex): 0×0C

Sender: SMD

Message Length (Bytes, Decimal): variable

This message is sent by the SMD in response to a GET X.509 CERTIFICATE message from the host PC.

| Byte Address | Message Field Name | Field Length | Contents |
|---|---|---|---|
| 0 × 0000 | Message Type Code | 1 | X.509 CERTIFICATE message type code. |
| | Certificate ID | 1 | Certificate identification number. See GET X.509 CERTIFICATE message. |
| | X.509 Certificate | variable | X.509 Certificate |

Exhibit B

Message Definition and Structure

| Name | Type Number | Length | Sent By | Description |
|---|---|---|---|---|
| ERROR | 0 × 00 | 4 | SMD | Informs the host PC that an error occurred during the processing of a message. |
| STATECHG | 0 × 01 | 3 | SMD | Indicates that the SMD changed state. |
| GET STATUS | 0 × 04 | 1 | host PC | Instructs the SMD to return a STATUS message. |
| STATUS | 0 × 05 | 54 | SMD | Indicates the current SMD status. |
| GET SIGNED STATUS | 0 × 07 | 1 | host PC | Instructs the SMD to return a SIGNED STATUS message. |
| SIGNED STATUS | 0 × 08 | 87 | SMD | Indicates the current SMD status, signed. |
| GET X.509 CERTIFICATE | 0 × 0B | 2 | host PC | Requests the SMD to transmit a copy of a Certificate to the host PC. |
| X.509 CERTIFICATE | 0 × 0C | Variable | SMD | The SMD sends the Certificate with ID to the host PC. |
| FUND1 | 0 × 10 | 6 | host PC | Instructs the SMD to prepare to receive additional funding. |
| FUND2 | 0 × 11 | 281 | SMD | Indicates that the SMD is ready to receive new funding. Includes "Postage Value Request" field for the system server. |
| FUND3 | 0 × 12 | 62 | host PC | Instructs the SMD to increase revenue. Includes the "Postage Value Download" field from the system server. |
| FUND4 | 0 × 13 | 292 | SMD | Indicates that the SMD has incremented its revenue registers. Includes "Funding Status" field for the system server. |
| FUND5 | 0 × 14 | 52 | host PC | Instructs the SMD to abort the funding transaction without incrementing the revenue registers. Includes the "Postage Value Download Error" field from the system server. |

-continued

Exhibit B
Message Definition and Structure

| Name | Type Number | Length | Sent By | Description |
|---|---|---|---|---|
| INIT1 | 0 × 20 | 553 | host PC | Instructs a new or reset SMD to accept the vendor's X.509 certificate, public key, ID number, and other data, and to zero out the revenue registers. |
| INIT2 | 0 × 21 | 169 | SMD | Acknowledges the receipt of an INIT1 message and confirms that the SMD has been initialized. |
| AUDIT1 | 0 × 30 | 1 | host PC | Instructs the SMD to create a message that includes a Device Audit field for transmittal to the server system. |
| AUDIT2 | 0 × 31 | 1 | SMD | Includes the Device Audit field for transmission to the system server. |
| AUDIT3 | 0 × 32 | 52 | host PC | Instructs the SMD to reset the Watchdog Timer. Includes a "signed" DEVICE AUDIT RESPONSE message from the system server. |
| INDICIUM1 | 0 × 36 | 20 | host PC | Instructs the SMD to create an indicium and return it to the host PC. |
| INDICIUM2 | 0 × 37 | 288 | SMD | Includes the indicium field. Indicates that the SMD has deducted revenue from the internal registers. |
| REGISTER1 | 0 × 38 | 276 | host PC | Instructs the SMD to accept registration data and generate a private/public key pair. |
| REGISTER2 | 0 × 39 | 49 | SMD | Indicates that the SMD has accepted the registration data and has generated the key pair. This message includes the SMD's public key. |
| REGISTER3 | 0 × 3A | 566 | host PC | Instructs the SMD to store the SMD X.509 certificate. |
| REGISTER4 | 0 × 3B | 259 | host PC | Instructs the SMD to store the new registration data. |
| PWITHDRAW2 | 0 × 22 | 1 | host PC | |
| PWITHDRAW2 | 0 × 23 | 64 | SMD | |
| WITHDRAW1 | 0 × 3C | 1 | host PC | Instructs the SMD to be in a Withdrawal transaction. |
| WITHDRAW2 | 0 × 3D | 62 | SMD | Confirms a Withdrawal transaction. |
| READ RTC | 0 × 41 | 1 | host PC | Instructs the SMD to send the current value of its real time clock (RTC) to the host PC. |
| RTC TIME | 0 × 40 | 9 | SMD | The SMD sends the value of the real time clock to the host PC in this message in response to a READ RTC message. |
| SET RTC | 0 × 42 | 9 | host PC | Instructs the SMD to set its real time clock. |
| CHANGE RTC | 0 × 43 | 3 | host PC | Change value of the real time clock within the SMD. |
| GET VALID ID1 | 0 × 48 | 1 | host PC | Instructs the SMD to send information that identifies that particular SMD. |
| GET VALID ID2 | 0 × 49 | 249 | SMD | The SMD sends information that identifies that particular SMD. |
| AUX DATA | 0 × 50 | Variable: 3 to 131 | SMD | Sends data from the SMD's auxiliary buffer on the auxiliary port to the host PC. |
| GET AUX DATA | 0 × 51 | 1 | host PC | Instructs the SMD to capture data on the auxiliary port (e.g., scale data). |
| SEND AUX DATA | 0 × 52 | Variable: 4 to 131 | host PC | Instructs the SMD to send the data contained within this message to the auxiliary port |
| CONFIG AUX PORT | 0 × 53 | 6 | host PC | Configure the auxiliary port baud rate, parity, and so on |
| ENABLE AUX PORT | 0 × 54 | 2 | host PC | Instructs the SMD to enable or disable the auxiliary port. |
| USER INFO1 | 0 × 70 | 193 | host PC | Sends user information to the SMD for signature. |
| USER INFO2 | 0 × 71 | 279 | SMD | The SMD adds information to the user information and signs in response to a USER INFO1 message. |
| USER INFO3 | 0 × 72 | 171 | host PC | Sends user information to the SMD for signature. |
| USER INFO4 | 0 × 73 | 238 | SMD | The SMD adds information to the user information and signs in response to a USER INFO3 message. |
| ACCESS REQUEST | 0 × FA | Variable: 11 + N | host PC | Access request for the LMD to read or write to the Fortezza card common or attribute memory. |
| ACCESS RESPONSE | 0 × FB | Variable: 11 + N | SMD | Access response from the LMD return read data or acknowledge a write to the Fortezza card common or attribute memory. |
| CHECK PIN | 0 × FC | Variable: 4 + N | host PC | Check PIN phrase for LMD access control for the user or the SSO (Site Security or Crypto Officer), or to get the current access control log-in state. |
| CHANGE PIN | 0 × FD | Variable: 6 + M + N | host PC | Change LMD access control PIN phrase for the user or the SSO (Site Security or Crypto Officer) |
| PROCESS RESPONSE | 0 × FE | 4 | SMD | Process response from the LMD to indicate the status of the command execution. |

EXHIBIT C

Exhibit C summarizes the messages that can be processed by the SMD for each of the operating states. The following codes are used in the following table.

E (Error) Message cannot be processed in this state. If the message is received in this state, the SMD responds by sending an ERROR message with a $BAD_{13}$ STATE error code.

P (Proccessed) The message is processed in this state.

Allowable States for Message Processing

| | Uninitialized | Initialized | Timed-Out | Faulted | Funding-Intermediate | Audit-Intermediate 1 | Audit-Intermediate 2 | Registered | Registered-Intermediate | Withdrawal-Intermediate |
|---|---|---|---|---|---|---|---|---|---|---|
| ACCESS REQUEST | P | P | P | P | P | P | P | P | P | P |
| AUDIT1 | E | E | P | E | E | E | E | P | E | E |
| AUDIT3 | E | E | E | E | E | P | P | E | E | E |
| CHANGE PIN | P | P | P | P | P | P | P | P | P | P |
| CHANGE RTC | E | P | E | E | E | E | E | P | E | E |
| CHECK PIN | P | P | P | P | P | P | P | P | P | P |
| CONFIG AUX PORT | E | P | E | E | E | E | E | P | E | E |
| ENABLE AUX PORT | E | P | E | E | E | E | E | P | E | E |
| FUND1 | E | E | E | E | E | E | E | P | E | E |
| FUND3 | E | E | E | E | P | E | E | E | E | E |
| FUND5 | E | E | E | E | P | E | E | E | E | E |
| GET AUX DATA | E | P | E | E | E | E | E | P | E | E |
| GET AUX STATUS | E | P | E | E | E | E | E | P | E | E |
| GET SIGNED STATUS | E | P | P | P | E | E | E | P | E | E |
| GET VALID ID1 | E | E | E | E | E | E | E | P | E | E |
| GET X.509 CERTIFICATE | E | P | P | P | E | E | E | P | E | E |
| ACCESS REQUEST | P | P | P | P | P | P | P | P | P | P |
| INDICIUM1 | E | P(1) | E | E | E | E | E | P | E | E |
| INIT1 | P | E | E | E | E | E | E | E | E | E |
| REGISTER1 | E | P | E | E | E | E | E | E | E | E |
| REGISTER3 | E | E | E | E | E | E | E | E | P | E |
| REGISTER5 | E | E | E | E | E | E | E | P | E | E |
| READ RTC | P | P | P | P | E | E | E | P | E | E |
| SEND AUX DATA | E | P | E | E | E | E | E | P | E | E |
| SET RTC | P | E | E | E | E | E | E | E | E | E |
| USER INFO1 | E | P | E | E | E | E | E | E | E | E |
| USER INFO3 | E | P | E | E | E | E | E | P | E | E |
| WITHDRAW1 | E | E | E | E | E | E | E | P | E | E |
| WITHDRAW3 | E | E | E | E | E | E | E | E | E | P |

Note:
1) Only zero valued indicia may be generated in this state, for testing purposes.

Exhibit D
Definition and Structure of Message Parameters

| Data Item Name | Length and Format | Contents |
|---|---|---|
| Account Number | 8 bytes BCD | Customers account number, assigned during a Registration transaction. |
| Ascending Register | 6 bytes BCD | Ascending revenue register value. Cleared to zero during a Registration transaction. Incremented by the revenue amount during an Indicium transaction. The low order digit represents fractional cents. |
| Audit Status Code | 1 byte binary | Values are TBD. Values to be supplied by USPS. |
| Aux Data Length | 2 bytes binary | The length of the data string captured from the auxiliary port and transmitted to the host PC in an AUX DATA message. |
| Aux Port Received Data | up to 128 bytes binary | Data received by the SMD from the device coupled to the auxiliary port. This data is transmitted to the host PC. |
| Aux Port Transmit Data | Up to 128 bytes binary | Data obtained from the host PC to be transmitted to the device coupled to the auxiliary port. |
| Baud Rate | 2 bytes binary | Line configuration parameter sent to the SMD by the host PC to configure the auxiliary port. |
| Certificate Serial Number | 4 | (Where does this come from?) |
| Certificate ID | 1 byte binary | Certificate identification number. It identifies the certificate requested by a GET X.509 CERTIFICATE message and sent by the X.509 CERTIFICATE message. |
| Control Total | 6 byte BCD | Ascending register plus Descending register. The low order digit represents fractional cents. |
| Credit Card Expiration Date | 4 | |
| Credit Card Number | 30 | |

-continued

Exhibit D

Definition and Structure of Message Parameters

| Data Item Name | Length and Format | Contents |
|---|---|---|
| Credit Card Type | 2 | |
| Current Date/Time | 8 bytes BCD | Date and time at present. Format is: YYyyMMDDHHmmSSTT |
| Current SMD State | 1 byte binary | A code number identifying the current operating state of the SMD. See the STATECHG message for a list of state codes. |
| Customer Account Number | 8 byte binary | 0x00 if new customer. |
| Customer Address Line1 | 40 ASCII | Street Number and Name. |
| Customer Address Line2 | 40 ASCII | City, State. |
| Customer Name | 32 ASCII | |
| Cycle Counter | 4 bytes binary | Counter that increments by one each time an indicium is printed, regardless of the amount of the indicium. The cycle counter is incremented for zero as well as non-zero indicia printed. |
| Data bits | 1 byte binary | Auxiliary port configuration parameter. Can take on the values of 7 or 8, indicating 7 or 8 data bits, respectively. |
| Descending Register | 5 bytes BCD | Descending revenue register value. Cleared to zero during a Registration transaction. Decremented by the revenue amount during an Indicium transaction. Incremented by the revenue amount during a Funding transaction. The low order digit represents fractional cents. |
| Destination ZIP Code | 6 bytes BCD | Destination ZIP code, to be included in signed portion of indicium. |
| Device ID | 8 bytes BCD | The SMD device number received in an INIT1 message. |
| Digital Signature | 40 bytes binary | The signature using the SMD's private key. |
| Direct Debit Account Number | 17 | |
| Direct Debit Account Type | 1 | "0" if using Credit Card |
| Direct Debit Routing Number | 4 | |
| Enable Flag | 1 byte binary | 0x00 to disable the auxiliary port, 0xFF to enable the auxiliary port. |
| Funding Error Code | 1 byte binary | Values are TBD. To be specified by the USPS. |
| Funding Revenue | 3 byte BCD | The revenue amount to be added to the Descending register during a funding transaction. Low order digit represents whole cents. |
| Funding Status Code | 1 byte binary | Values are TBD. To be specified by USPS. |
| Indicium Revenue | 3 byte BCD | This field contains the revenue amount, which is being dispensed by an INDICIUM2 message. This amount is deducted from the Descending register and added to the Ascending register before the INDICIUM2 message, including the indicium, is transmitted to the host PC. The low order digit represents fractional cents. |
| Indicium Version Number | 1 | TBD |
| Init Date | 8 bytes BCD | Date of SMD Initialization. Format is: YYyyMMDDHHmmSSTT |
| License ID | 5 bytes BCD | 10 digit Customer's P.O. License number loaded in an REGISTER3 message. |
| Licensing ZIP Code | 6 bytes BCD | 1 digit purpose code and 11 digit ZIP code, BCD encoded. |
| Maximum Postage | 3 bytes BCD | Maximum postage that can be printed in one indicium. Encoded with fractional cents in lowest order digit. |
| Message Type Code | 1 byte binary | A number, which uniquely identifies each message, sent from or received by the SMD. |
| Meter Lease Number | 4 | TBD |
| Meter License | 5 bytes BCD | Different format of License ID |
| Minimum Postage | 3 bytes BCD | Minimum postage (other than zero) that can be printed in one indicium. Encoded with fractional cents in lowest order digit. |
| Provide X.509 Certificate | 498 bytes binary | Contains the provider's (e.g., or a vendor such as Neopost Inc.) public key. |
| New Meter Type | 1 byte binary | Constant 0x00 |
| Non-zero Cycle Counter | 4 bytes binary | Counter that increments by 1 each time an indicium is printed with a non-zero amount. |
| Parity | 1 byte binary | Line configuration parameter sent to the SMD by the host PC to configure the auxiliary port. 0 => none, 1 => odd, 2 => even |
| Previous Funding Date/Time | 6 bytes BCD | The date and time of the most recent Funding transaction. Format is: YYyyMMDDHHmm |
| Previous Funding Postage Value | 3 bytes BCD | Amount of postage added to the Descending register during the most recent Funding transaction. Low order digit represents fractional cents. |
| Previous SMD-State | 1 byte binary | A code number identifying the current operating state of the SMD. This number identifies the state that the SMD is transitioning from. |
| Rate Category | 4 ASCII | Selected Postage class, as ASCII code. |
| Requested Revenue Amount | 5 bytes BCD | The revenue amount to include in an indicium. Nine significant BCD digits. Last digit (fractional cents) must be zero. |
| RTC Time Increment | 2 bytes binary | This field is an integer value that ranges from −5 to +5. The SMD clamps value to minimum or maximum if the value is out of range. Value represents number of hours to increment or decrement the RTC in a CHANGE RTC message. |
| Signature/Algorithm Flag | 1 byte binary | Signature algorithm flag in indicium. 0x00 for DSA, 0x01 for RSA. |
| SMD Error Code | 2 bytes binary | Code number identifying the nature of the error. See definition of ERROR message in Exhibit A. |

-continued

Exhibit D

Definition and Structure of Message Parameters

| Data Item Name | Length and Format | Contents |
|---|---|---|
| SMD Public Key | 128 bytes binary | The SMD's public key to be transmitted to the system server. If 512 bit keys are being used, only the first 64 bytes are significant. |
| Software ID | 6 bytes BCD | An ID code to be inserted into the indicium. |
| Software License | 10 ASCII | (Different format of Meter License) |
| SMD Software Model | 2 byte BCD | Three BCD digits identifying the software application running on the host PC? |
| SMD X.509 Certificate | 191 bytes binary | The X.509 certificate that includes the SMD's public key used to verify the SMD's digital signature. |
| Stop Bits | 1 byte binary | Line configuration parameter sent by the host PC to the SMD to configure the auxiliary port. Can take on values of 1 or 2, indicating 1 or 2 stop bits, respectively. |
| Transaction ID | 3 bytes BCD | Serial number identifying this particular secure transaction. Initialized to zero during a Registration transaction. Incremented during other transactions as indicated in the message's description. |
| Transaction Date/Time | 6 bytes BCD | YYyyMMDDHHmm |
| USPS X.509 Certificate | 498 bytes binary | Certificate containing USPS's public key to be used to verify signature in transactions with the provider. |
| Vendor ID | 2 bytes BCD | Provider or vendor (e.g., Neopost Inc.) ID, 3 BCD digits. |
| Watchdog Increment | 2 bytes BCD | Number of days between inspection time-outs. This value is used to increment the Watchdog Timer during an Audit transaction. This value is initialized by the Registration transaction. |

EXHIBIT E

Security Relevant Data Items (SRDIs)

This Exhibit lists the security relevant data items and provides a short description of each item.

Account Number: User account number. Loaded into the SMD during a Registration transaction.

Ascending Register: Ascending revenue register value that represents an accumulated amount of revenue dispensed by the SMD. Cleared to zero during a Registration transaction. Incremented by the dispensed revenue amount during an Indicium transaction.

Current Date/Time: Date and time at present.

Descending Register: Descending revenue register value that represents the amount of available funds for the SMD. Cleared to zero during a Registration transaction. Decremented by revenue amount during an Indicium transaction. Incremented by the authorized revenue amount during a Funding transaction. The low order digit represents fractional cents.

Device ID: SMD device number. Loaded into the SMD during factory initialization (Initialization transaction).

Fault Code: A code number that indicates the reason the SMD is faulted (if it in fact is faulted, as indicated by the contents of the operating state variable).

Fraud Counter: A counter that counts the number of times a particular secure operation is performed in error. If the Fraud Counter exceeds the Fraud Counter Limit, the SMD faults.

Fraud Counter Limit: A number, maintained in the SMD's EPROM, which is compared against the Fraud Counter each time the Fraud Counter is incremented.

g: DSA parameter used in signature verification. Loaded during factory initialization (Initialization transaction).

Indicium Date: This value is derived from the RTC at the time the indicium is created.

Init Date: Date of SMD Initialization. Loaded during factory initialization (Initialization transaction).

Licensing ZIP Code: 11 digit ZIP code of installation location of SMD. Loaded into the SMD during a Registration transaction.

License ID: 10-digit ID number. Loaded into the SMD by the REGISTER3 message.

Maximum Postage: Maximum postage that can be printed in one indicium. Loaded into the SMD during a Registration transaction.

Minimum Postage: Minimum postage (other than zero) that can be printed in one indicium. Loaded into the SMD during a Registration transaction.

Provider X.509 Certificate: Contains the provider's public key. Loaded during factory initialization (Initialization transaction).

Non-zero Piece Count: Non-zero Print cycle count. Cleared to zero during the Registration transaction. Incremented by each Indicium transaction that dispenses non-zero revenue amount.

p: DSA parameter used in signature verification. Loaded during factory initialization (Initialization transaction).

Previous Funding Date/Time: The date and time of the most recent Funding transaction. Stored at the end of each Funding transaction.

Previous Funding Postage Value: Amount of postage added to the Descending register during the most recent Funding transaction. Stored at the end of each Funding transaction.

q: DSA parameter used in signature verification. Loaded during factory initialization (Initialization transaction).

State: A code number that identifies the current operating state of the SMD. See STATECHG message for a list of state codes. Set to the Uninitialized state whenever the BBRAM CRC is bad and the FIT jumper is present.

Software ID: An ID code to be inserted into the indicium. Stored in software EPROM when the EPROM is created at the factory.

SMD Private Key: The SMD's private key generated by the SMD during factory initialization (Initialization transaction). Stored in the SMD cryptographic module.

Kept secret and not exported. Used to sign SMD generated data during Audit, Registration, Funding, Indicium, Initialization, Status, and Withdrawal transactions.

SMD Public Key: The SMD's public key that is transmitted to the system server during factory initialization (Initialization transaction).

SMD Software Model: Three BCD digits identifying the SMD software. Stored in software EPROM when EPROM is created at the factory.

SMD X.509 Certificate: The X.509 certificate that includes the SMD's public key used to verify the SMD's digital signatures. Loaded into the SMD during the Registration transaction.

Transaction ID: Serial number that identifies this particular secure transaction. Initialized to zero during a Registration transaction. Incremented during Audit, Funding, and Withdrawal transactions.

USPS X.509 Certificate: Certificate that includes the USPS public key used to verify signature in transactions with the provider. Loaded into the SMD during a Registration transaction.

Watchdog Timer: Number of days to next watchdog time-out. Initialized to the current time plus the Watchdog Increment value during a Registration transaction. Incremented by an Audit transaction.

Watchdog Increment: Number of days between inspection time-outs. This value is used to increment the Watchdog Timer during an Audit transaction. This value is initialized by the Registration transaction.

SRDI Modes of Access

This section includes a table that specifies the modes of access for the SRDIs. The modes of access are defined as follows:

Read Access: An "R" indicates that the SRDI is output to the SMD's main port during the performance of the specified service.

Write Access: A "W" indicates that the SRDI is received via the SMD's main port and stored in SMD memory as a result of performing the specified service.

Cleared: A "C" indicates that the SMD clears the SRDI to all zeros as a result of performing the specified service.

Generated: A "G" indicates that the SMD internally generates the SRDI as a result of performing the specified service.

Any messages not part of transactions specified in the following table neither transmit nor receive SRDIs.

SRDI Modes of Access

| SRDI Name | Read and Adjust RTC | Registration | Audit | Read X.509 Cert. | Initialization | Funding | Indicium | Inspection | Auxiliary Port Ops | Status Read | Withdrawal |
|---|---|---|---|---|---|---|---|---|---|---|---|
| Account Number | | W | | | C | | | | | | |
| Ascending Register | | C | R | | C | R | R | | | R | R |
| Current Date/Time | R W | | R | | W | R | R | | | | |
| Descending Register | | C | R | | C | R W | R | | | R | R |
| Device ID | | R | R | | W | R | R | | | R | R |
| "g" | | | | | W | | | | | | |
| Init Date | | | | | W | | | | | R | |
| Licensing ZIP Code | | W | | | C | | R | | | R | |
| License ID | | W | | | C | | R | | | R | |
| Maximum Postage | | W | | | C | | | | | | |
| Minimum Postage | | W | | | C | | | | | | |
| Neopost X.509 Certificate | | | | R | W | | | | | | |
| Non-zero Piece Count | | C | | | C | | | | | R | |
| "p" | | R | | | W | | | | | | |
| Previous Funding Date/Time | | C | R | | C | R | | | | | |
| Previous Funding Postage Value | | C | R | | C | R | | | | | |
| "q" | | R | | | W | | | | | | |
| Current SMD State | | W | | | W | W | W | | | R | |
| Software ID | | | | | | R | | | | | |
| SMD Private Key | | | | | G | | | | | | |
| SMD Public Key | | R | | | G R | | | | | | |
| SMD Software Model | | | | | | | | | | R | |
| SMD X.509 Certificate | | W | R | R | C | R | R | | | | |
| Transaction ID | | C | R | | C | R W | | | | R | R |
| USPS X.509 Certificate | | W | | R | C | | | | | | |
| Watchdog Timer | | W | W | | C | | | | | | |
| Watchdog Increment | | W | | | C | | | | | | |

What is claimed is:

1. A metering device comprising:

a memory element configured to store accounting information and information related to an operation of the metering device;

an interface circuit configured to receive a message, wherein the message includes a code that identifies the message;

a processor operatively coupled to the memory element and the interface circuit, wherein the processor is configured to receive the message, process the message to generate an indicium, and update the accounting information to account for the generated indicium; and an enclosure that houses the processor and indicates tampering of elements within the enclosure, wherein a predetermined time out period is reset upon completion of an audit transaction.

2. The device of claim 1 further comprising:

a clock circuit operatively coupled to the processor, wherein the clock circuit is configured to provide timing information upon request.

3. The device of claim 1 wherein the memory element retains the accounting information when power is removed from the metering device.

4. The device of claim 1 wherein the accounting information includes an amount of available funds.

5. The device of claim 1 further comprising:

a printer operatively coupled to the interface circuit, wherein the meter generates a message directing the printer to print the generated indicium, and wherein the printer receives and prints the generated indicium.

6. The device of claim 1 wherein the device couples to a computer and receives messages directing the processor to process transactions.

7. The device of claim 1 wherein operation of the meter is enabled for a predetermined time out period.

8. The device of claim 7 wherein the predetermined time out period is reset upon completion of a funding transaction.

9. The device of claim 1 wherein the available funds are increased by performing a funding transaction.

10. The device of claim 9 further comprising:

a input circuit to receive a command to print indicium, wherein the device is configured to operate as a stand-alone unit and dispense an indicium having a predetermined value upon receiving the print command.

11. A secure metering device (SMD) comprising:

a memory configured to store information indicative of a current operating state of the SMD, wherein the current operating state is one of a plurality of valid operating states, wherein each of the plurality of valid operating states is associated with a set of permissible operations by the SMD; and a processor coupled to the memory and configured to operate in the operating state indicated by the information stored in the memory, wherein the plurality of valid operating states include an initialized state, a funded state, and a withdrawal state, wherein the withdrawal state is characterized, in part, by a restriction from updating content of a revenue register within the SMD.

12. The SMD of claim 11, wherein the information indicative of the current operating state of the SMD is provided upon receiving a status request.

13. The SMD of claim 11, wherein the plurality of valid operating states further includes an uninitialized state.

14. The SMD of claim 13, wherein the uninitialized state is characterized, in part, by a restriction from updating, except via an initialization transaction, security relevant data items stored within the SMD memory.

15. The SMD of claim 11, wherein the plurality of valid operating states further includes a registered state.

16. The SMD of claim 15, wherein the registered state is characterized, in part, by an association of the SMD with a specific account.

17. The SMD of claim 11, wherein the initialized state is characterized, in part, by an assignment of a set of keys to the SMD.

18. The SMD of claim 17, wherein the set of keys is generated by the SMD based on a set of parameters provided to the SMD.

19. The SMD of claim 18, wherein the set of keys includes a private key retained by the SMD and a public key exported by the SMD.

20. The SMD of claim 11, wherein the plurality of valid operating states further includes a faulted state.

21. The SMD of claim 20, wherein the faulted state is characterized, in part, by a restriction from updating security relevant data items stored within the SMD memory.

22. The SMD of claim 20, wherein the SMD makes a transition to the faulted state upon detection of a security threat.

23. The SMD of claim 11, wherein the memory is further configured to store accounting information, wherein modification of the accounting information is allowed in a first subset of the plurality of valid operating states.

24. The SMD of claim 23, wherein modification of the accounting information is performed via a secure transaction.

25. The SMD of claim 23, wherein a set of permissible operations in the first subset of valid operating state includes updating content of a revenue register with a funding amount via a secure transaction.

26. The SMD of claim 23, wherein access to the accounting information is allowed in a second subset of the plurality of valid operating states.

27. The SMD of claim 11, wherein the plurality of valid operating states further includes a timed-out state.

28. The SMD of claim 27, wherein the SMD transitions from the funded state to the timed-out state upon expiration of a time-out timer.

29. The SMD of claim 15, wherein the timed-out state is characterized, in part, by a restriction from printing an indicium having a non-zero value.

30. The SMD of claim 15, wherein the SMD makes a transition from the timed-out state to the funded state by resetting the time-out timer to a predetermined value during an audit transaction.

31. The SMD of claim 11, wherein the funded state is characterized, in part, by storage in a revenue register of a non-zero value indicative of funds available for dispensing by the SMD.

32. The SMD of claim 31, wherein the set of permissible operations in the funded state includes updating content of the revenue register with a funding amount via a secure transaction.

33. The SMD of claim 31, wherein the funding amount is based on a user request.

34. The SMD of claim 31, wherein the set of permissible operations in the funded state includes printing of an indicium having a value limited to the non-zero value stored in the revenue register.

35. The SMD of claim 34, wherein the indicium value is further limited to a predetermined range of values.

36. The SMD of claim 35, wherein the indicium value is based on a user request.

37. A secure metering device (SMD) comprising:

a memory configured to store information indicative of a current operating state of the SMD, wherein the current operating state is one of a plurality of valid operating states, wherein each of the plurality of valid operating states is associated with a set of permissible operations by the SMD; and a processor coupled to the memory and configured to operate in the operating state indicated by the information stored in the memory, wherein the plurality of valid operating states include an initialized state, a funded state, and a withdrawal state, wherein the withdrawal state is characterized, in part, by a restriction from updating content of a revenue register within the SMD, wherein the SMD makes a transition from the current operating state to a new operating state upon occurrence of a particular event or by performing a particular transaction, wherein the SMD transitions from the funded state to the withdrawal state by performing a withdrawal transaction.

38. The SMD of claim 37, wherein the SMD transitions from the initialized state to the funded state by performing a funding transaction.

* * * * *